US011000744B2

(12) United States Patent
Solheim et al.

(10) Patent No.: US 11,000,744 B2
(45) **Date of Patent: *May 11, 2021**

(54) GOLF CLUB HEADS WITH APERTURES AND FILLER MATERIALS

(71) Applicant: KARSTEN MANUFACTURING CORPORATION, Phoenix, AZ (US)

(72) Inventors: John A. Solheim, Phoenix, AZ (US); Eric J. Morales, Laveen, AZ (US); Erik M. Henrikson, Phoenix, AZ (US); Eric V. Cole, Phoenix, AZ (US); Paul D. Wood, Phoenix, AZ (US); Martin R. Jertson, Cave Creek, AZ (US); Ryan M. Stokke, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/814,853

(22) Filed: Mar. 10, 2020

(65) Prior Publication Data

US 2020/0206592 A1 Jul. 2, 2020

Related U.S. Application Data

(63) Continuation of application No. 16/160,754, filed on Oct. 15, 2018, now Pat. No. 10,625,129, which is a continuation of application No. 15/148,814, filed on May 6, 2016, now Pat. No. 10,124,224, which is a continuation-in-part of application No. 14/312,087, filed on Jun. 23, 2014, now Pat. No. 9,776,052, which is a continuation of application No. 14/064,528, filed (Continued)

(51) Int. Cl.
*A63B 53/04* (2015.01)
*A63B 60/50* (2015.01)
*A63B 60/52* (2015.01)

(52) U.S. Cl.
CPC ..... *A63B 60/50* (2015.10); *A63B 53/0466* (2013.01); *A63B 53/045* (2020.08); *A63B 53/0408* (2020.08); *A63B 53/0437* (2020.08); *A63B 60/52* (2015.10)

(58) Field of Classification Search
CPC .. A63B 53/04; A63B 53/0437; A63B 53/0466
USPC ..... 473/324–350
See application file for complete search history.

(56) References Cited

U.S. PATENT DOCUMENTS 1,877,820 A * 9/1932 Costello ..... A63B 69/3632 473/235
3,695,618 A 10/1972 Woolley et al.
(Continued)

FOREIGN PATENT DOCUMENTS

GB 2417909 8/2008
JP 3028211 8/1996
(Continued)

OTHER PUBLICATIONS

PCT International Search Report and Written Opinion dated Jul. 25, 2012 from corresponding PCT Application No. PCT/US2012/020107.

*Primary Examiner* — Alvin A Hunter

(57) ABSTRACT

Embodiments of golf club heads with apertures and methods to manufacture golf club heads are generally described herein. Other embodiments may be described and claimed.

12 Claims, 26 Drawing Sheets

Related U.S. Application Data on Oct. 28, 2013, now Pat. No. 8,790,196, which is a continuation-in-part of application No. 13/342,847, filed on Jan. 3, 2012, now Pat. No. 8,777,778.

(60) Provisional application No. 62/159,127, filed on May 8, 2015, provisional application No. 61/774,224, filed on Mar. 7, 2013, provisional application No. 61/429,692, filed on Jan. 4, 2011.

(56) References Cited

U.S. PATENT DOCUMENTS 3,997,170 A * 12/1976 Goldberg ..... A63B 53/0466 473/327
4,065,133 A * 12/1977 Gordos ..... A63B 53/0466 473/327
4,313,607 A * 2/1982 Thompson ..... A63B 60/00 473/328
4,319,752 A * 3/1982 Thompson ..... A63B 53/04 473/328
4,535,990 A * 8/1985 Yamada ..... A63B 60/00 473/346
4,754,974 A * 7/1988 Kobayashi ..... A63B 53/04 473/327
4,944,515 A * 7/1990 Shearer ..... A63B 60/00 473/337
5,464,211 A * 11/1995 Atkins, Sr. ..... A63B 53/0466 473/377
5,518,243 A 5/1996 Redman
5,547,427 A * 8/1996 Rigal ..... A63B 60/00 473/345
5,672,120 A * 9/1997 Ramirez ..... B29C 70/66 473/347
5,700,208 A * 12/1997 Nelms ..... A63B 60/00 473/324
5,772,529 A * 6/1998 Ruth, Jr. ..... A63B 53/04 473/327
5,797,807 A 8/1998 Moore
5,800,285 A * 9/1998 Thorne ..... A63B 53/04 473/324
5,921,872 A * 7/1999 Kobayashi ..... A63B 53/0466 473/345
5,997,415 A * 12/1999 Wood ..... A63B 53/04 473/346
6,001,029 A * 12/1999 Kobayashi ..... A63B 53/0466 473/327
6,027,414 A * 2/2000 Koebler ..... A63B 53/02 473/228
6,089,070 A * 7/2000 Hancock ..... A63B 60/00 72/340
6,183,381 B1 * 2/2001 Grant ..... A63B 53/047 473/342
6,244,976 B1 6/2001 Murphy et al.
6,332,849 B1 * 12/2001 Beasley ..... A63B 53/04 473/332
6,354,961 B1 * 3/2002 Allen ..... A63B 53/0466 473/329
6,354,963 B1 3/2002 Kodama et al.
6,380,349 B1 * 4/2002 Rajagopalan ..... C08F 8/44 206/315.3
6,381,828 B1 * 5/2002 Boyce ..... A63B 53/02 29/527.4
6,623,378 B2 9/2003 Beach et al.
6,776,725 B1 * 8/2004 Miura ..... A63B 53/0466 473/327
6,783,465 B2 * 8/2004 Matsunaga ..... A63B 60/52 473/329
6,792,972 B2 9/2004 Poulsen
6,896,006 B2 5/2005 Lindsay
6,932,716 B2 8/2005 Ehlers et al.
6,945,876 B2 9/2005 Nakahara et al.
6,955,612 B2 10/2005 Lu
7,025,692 B2 4/2006 Erickson et al.
RE39,178 E * 7/2006 Allen ..... A63B 53/0466 473/287
7,074,136 B2 7/2006 Noguchi et al.
7,108,614 B2 * 9/2006 Lo ..... A63B 53/0466 473/345
7,140,977 B2 * 11/2006 Atkins, Sr. ..... A63B 60/00 473/346
7,147,575 B2 12/2006 Galloway
7,166,038 B2 1/2007 Williams et al.
7,166,041 B2 1/2007 Evans
7,250,007 B2 * 7/2007 Lu ..... A63B 60/52 473/329
7,258,624 B2 8/2007 Kobayashi
7,303,487 B2 12/2007 Kumamoto
7,338,390 B2 3/2008 Lindsay
7,445,564 B2 11/2008 Kusumoto
7,448,961 B2 * 11/2008 Lin ..... A63B 53/047 473/332
7,510,485 B2 3/2009 Yamamoto
7,510,486 B2 * 3/2009 Werner ..... A63B 53/0466 473/345
7,621,822 B2 * 11/2009 Roach ..... A63B 60/02 473/329
7,641,568 B2 * 1/2010 Hoffman ..... A63B 53/0466 473/327
7,699,719 B2 4/2010 Sugimoto
7,892,111 B2 * 2/2011 Morales ..... A63B 60/00 473/345
8,172,697 B2 * 5/2012 Cackett ..... A63B 60/52 473/329
8,540,590 B2 9/2013 Tsukada et al.
8,556,742 B2 * 10/2013 John ..... A63B 53/0466 473/219
8,608,587 B2 * 12/2013 Henrikson ..... A63B 60/52 473/324
8,632,419 B2 * 1/2014 Tang ..... A63B 60/52 473/329
8,678,946 B2 * 3/2014 Boyd ..... A63B 53/0466 473/327
8,721,471 B2 * 5/2014 Albertsen ..... A63B 53/047 473/328
8,777,778 B2 * 7/2014 Solheim ..... A63B 53/0466 473/346
8,790,196 B2 * 7/2014 Solheim ..... A63B 53/08 473/344
9,138,619 B2 * 9/2015 Takechi ..... A63B 60/52
9,174,100 B2 11/2015 Takechi
9,694,254 B2 7/2017 Ashino
10,124,224 B2 * 11/2018 Solheim ..... A63B 53/0466
2002/0019265 A1 2/2002 Allen
2003/0130059 A1 7/2003 Billings
2004/0192468 A1 * 9/2004 Onoda ..... A63B 53/0466 473/345
2004/0266551 A1 * 12/2004 Noguchi ..... A63B 53/0466 473/345
2005/0096154 A1 5/2005 Chen
2005/0143189 A1 * 6/2005 Lai ..... A63B 53/0466 473/335
2005/0261082 A1 * 11/2005 Yamamoto ..... A63B 53/0466 473/345
2006/0052181 A1 3/2006 Serrano et al.
2007/0032313 A1 2/2007 Serrano et al.
2007/0155533 A1 7/2007 Solheim et al.
2008/0045356 A1 2/2008 Lin et al.
2008/0070721 A1 * 3/2008 Chen ..... A63B 53/0475 473/346
2008/0113825 A1 * 5/2008 Funayama ..... A63B 60/02 473/291
2011/0306441 A1 * 12/2011 Tsukada ..... A63B 60/52 473/345
2013/0344987 A1 * 12/2013 Takechi ..... A63B 60/52 473/345

(56) References Cited

U.S. PATENT DOCUMENTS

2015/0273289 A1* 10/2015 Ashino ..... A63B 60/00
473/332

FOREIGN PATENT DOCUMENTS

| | | | | | |
|---|---|---|---|---|---|
| JP | 2000005353 | | | 1/2000 | |
| JP | 2000005353 | A | * | 1/2000 | |
| JP | 2003111874 | | | 4/2003 | |
| JP | 2004159794 | | | 6/2004 | |
| JP | 2004159794 | A | * | 6/2004 | |
| JP | 2005230472 | | | 9/2004 | |
| JP | 2004305724 | | | 11/2004 | |
| JP | 2004305724 | A | * | 11/2004 | ..... A63B 53/0466 |
| JP | 2005230472 | A | * | 9/2005 | |
| JP | 2005323686 | | | 11/2005 | |
| JP | 2005323686 | A | * | 11/2005 | |
| JP | 2005329154 | | | 12/2005 | |
| JP | 2005329154 | A | * | 12/2005 | ..... A63B 53/0466 |
| JP | 2006020860 | | | 1/2006 | |
| JP | 2006230953 | | | 9/2006 | |
| JP | 2006230953 | A | * | 9/2006 | |
| JP | 2007325859 | | | 12/2007 | |
| JP | 2007325859 | A | * | 12/2007 | |
| JP | 2008035963 | | | 2/2008 | |
| JP | 2008035963 | A | * | 2/2008 | |
| JP | 2008148762 | | | 7/2008 | |
| JP | 2009011839 | | | 1/2009 | |
| JP | 2010183969 | | | 8/2010 | |

* cited by examiner

Fig. 27
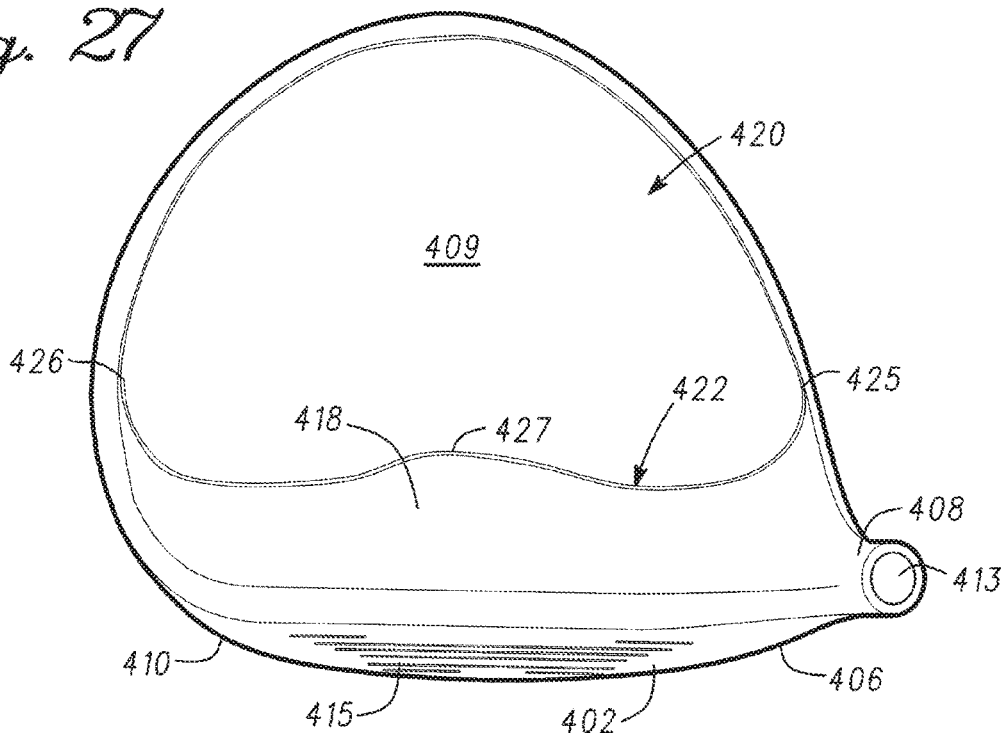
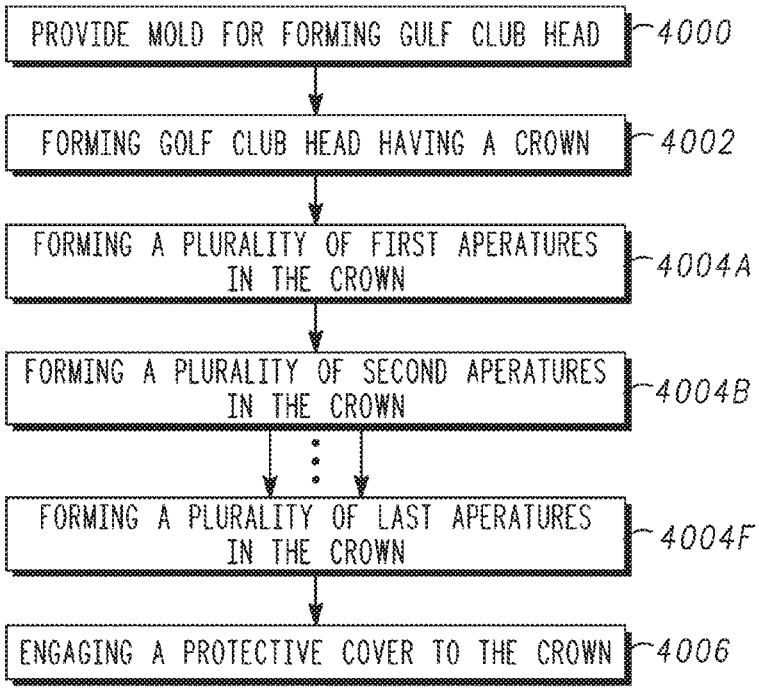
Fig. 28

GOLF CLUB HEADS WITH APERTURES AND FILLER MATERIALS

CROSS REFERENCE TO RELATED APPLICATIONS

This is a continuation of U.S. Non-Provisional Patent Application No. 16/160,754, filed on Oct. 15, 2018, which claims benefit of U.S. Non-Provisional Patent Application No. 15/148,814, now U.S. Pat. No. 10,124,224, filed on May 6, 2016, which claims the benefit of U.S. Provisional Patent Application No. 62/159,127, filed on May 8, 2015, and is a continuation in part of U.S. Non-Provisional Patent Application No. 14/312,087, now U.S. Pat. No. 9,776,052, filed on Jun. 23, 2014, which is a continuation of U.S. Non-Provisional Patent Application No. 14/064,528, now U.S. Pat. No. 8,790,196, filed on Oct. 28, 2013, which is a continuation in part of U.S. Non-Provisional Patent Application No. 13/342,847, now U.S. Pat. No. 8,777,778, filed on Jan. 3, 2013, which claims the benefit of U.S. Provisional Patent Application No. 61/429,692, filed on Jan. 4, 2011. U.S. Non-Provisional Patent Application No. 14/064,528 also claims the benefit of U.S. Provisional Patent Application No. 61/774,224, filed on Mar. 7, 2013. All of the above described references are incorporated herein by reference in their entirety.

FIELD

The present application generally relates to golf clubs, and more particularly, to golf club heads with apertures and methods to manufacture golf club heads.

BACKGROUND

A golf club head, and in particular the crown of the golf club head, may be divided into several regions for purposes of illustrating the effects of forces generated by the impact of a golf ball against the face of the golf club head. The first region is in communication with the impact surface defined by the face of the golf club head such that the impact of a golf ball at the face directly causes internal stresses to be generated by the impact force of the golf ball that travels through and directly affects the first region of the crown. In addition, a second region of the golf club head may be defined along the crown between the first region and the back of the golf club head such that relatively lower stress and vibration should be felt in the second region by the forces generated after the impact of a golf ball against the face in comparison to the first region of the golf club head.

Many golf club heads are formed with a number of relatively large apertures defined along the second region of the crown in order to lessen the weight of the golf club head and/or change its center of gravity. However, this arrangement of large apertures can cause a disproportionate or uneven distribution of internal stresses through the second region of the crown when a golf ball strikes the face of the golf club head. In particular, stress risers, which are pockets of concentrated stress, can develop in the material of the crown between the apertures. Stress risers are caused when internal stresses generated by the impact force of a golf ball are distributed unevenly through the second region of the crown and focused on particular portions of the golf club head. This disproportional distribution of internal stresses through the second region of the crown can cause the structural failure of the golf club head over time as the area between the apertures crack or otherwise fail because of the excessive internal stresses being generated in the second region of the crown due to the bending forces being focused on a particular area of the crown after repeated impacts with a golf ball.

BRIEF DESCRIPTION OF THE DRAWINGS

FIG. 27 is a top view of the golf club head of FIG. 24 showing the division of the golf club head into the first region and the second region by a bell-shaped curve established by the first plane.

FIG. 28 is a flow chart illustrating a method of manufacturing the golf club head of FIG. 24.

Corresponding reference characters indicate corresponding elements among the view of the drawings. The headings used in the figures should not be interpreted to limit the scope of the claims.

DETAILED DESCRIPTION

A golf club head may be divided into several regions for purposes of illustrating the effects of forces generated by the impact of a golf ball against face of the golf club head. As noted above, the first region is in communication with the impact surface defined by the face of the golf club head such that the impact of a golf ball at the face directly causes internal stresses generated by the force of the impact with the golf ball to travel through and directly affect the first region of the golf club head. A second region of the golf club head may be defined between the first region and the back of the golf club head such that a relatively lower stress and vibration are experienced in the second region by the forces generated after the impact of a golf ball against the face in comparison to the first region.

Figure 1:
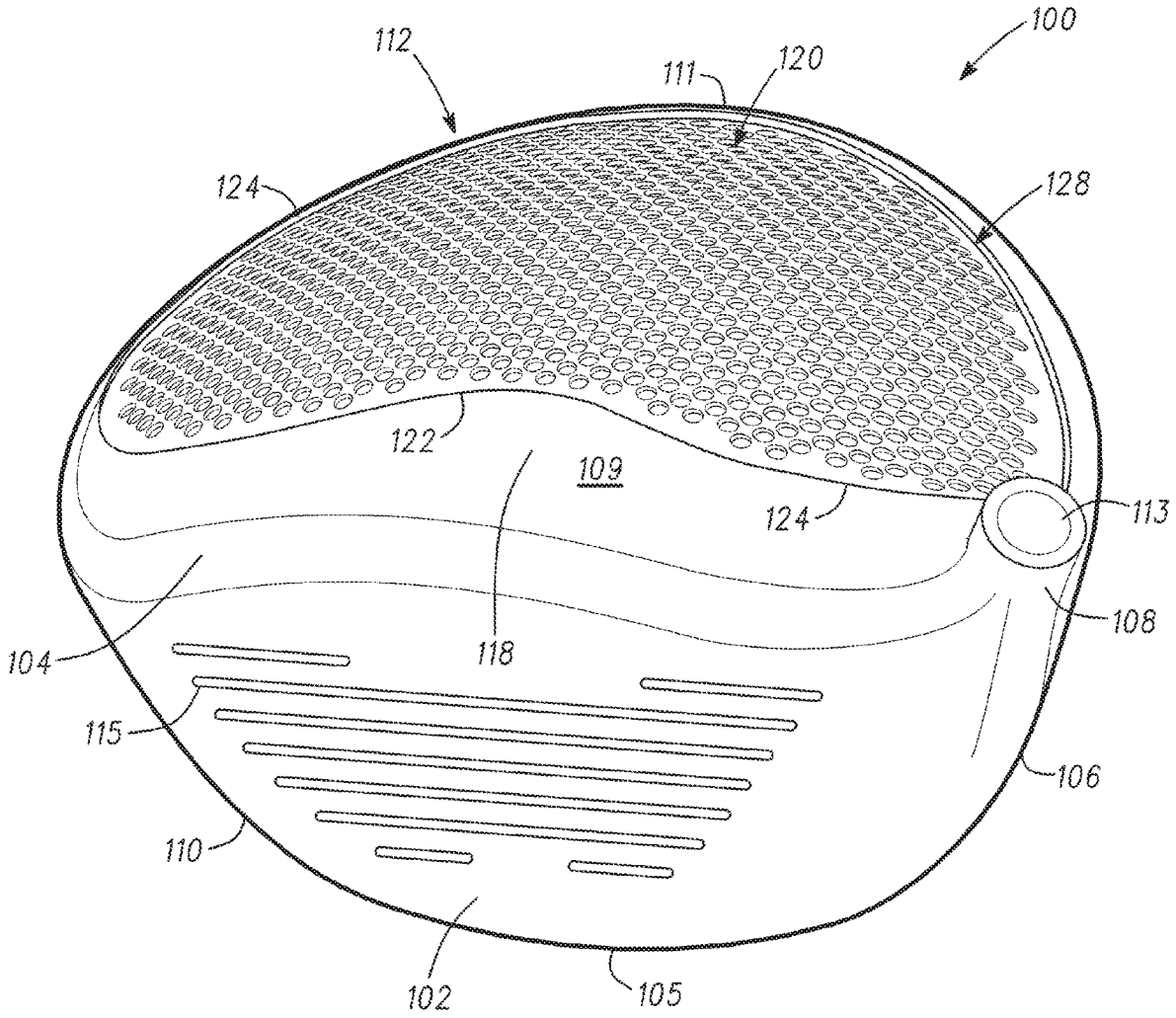
FIG. 1 is a perspective front view of one embodiment of a golf club head illustrating a plurality of apertures.
Figure 2:
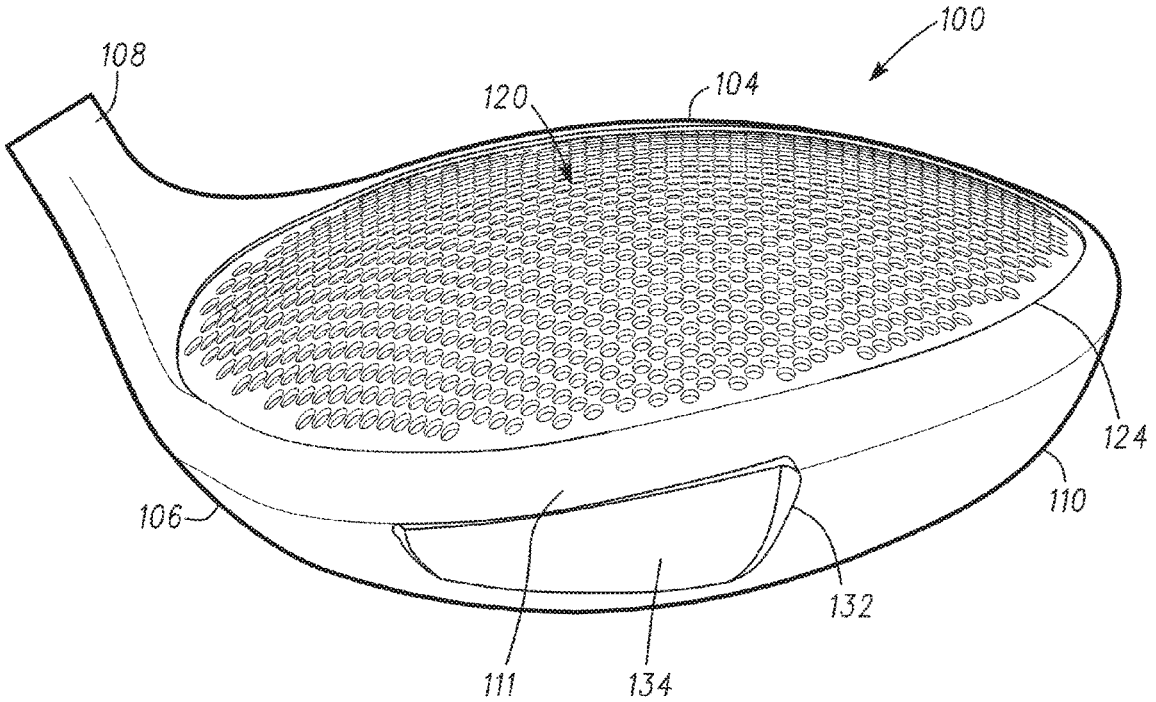
FIG. 2 is a perspective rear view of the golf club head of FIG. 1.
Figure 3:
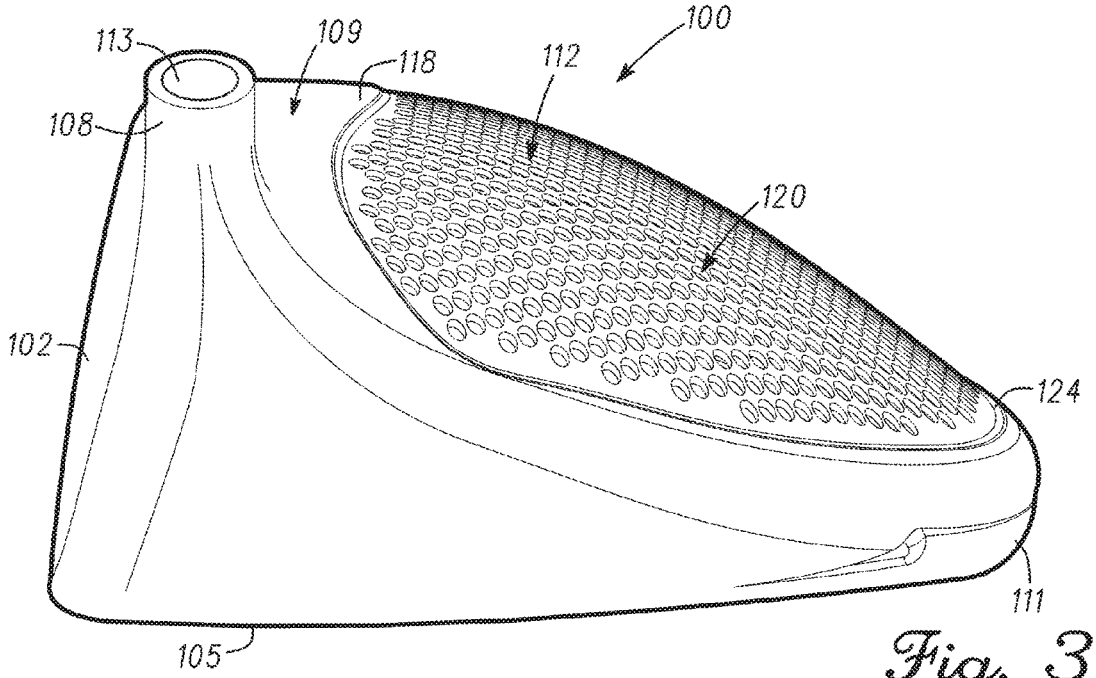
FIG. 3 is a perspective side view of the golf club head of FIG. 1.
Figure 4:
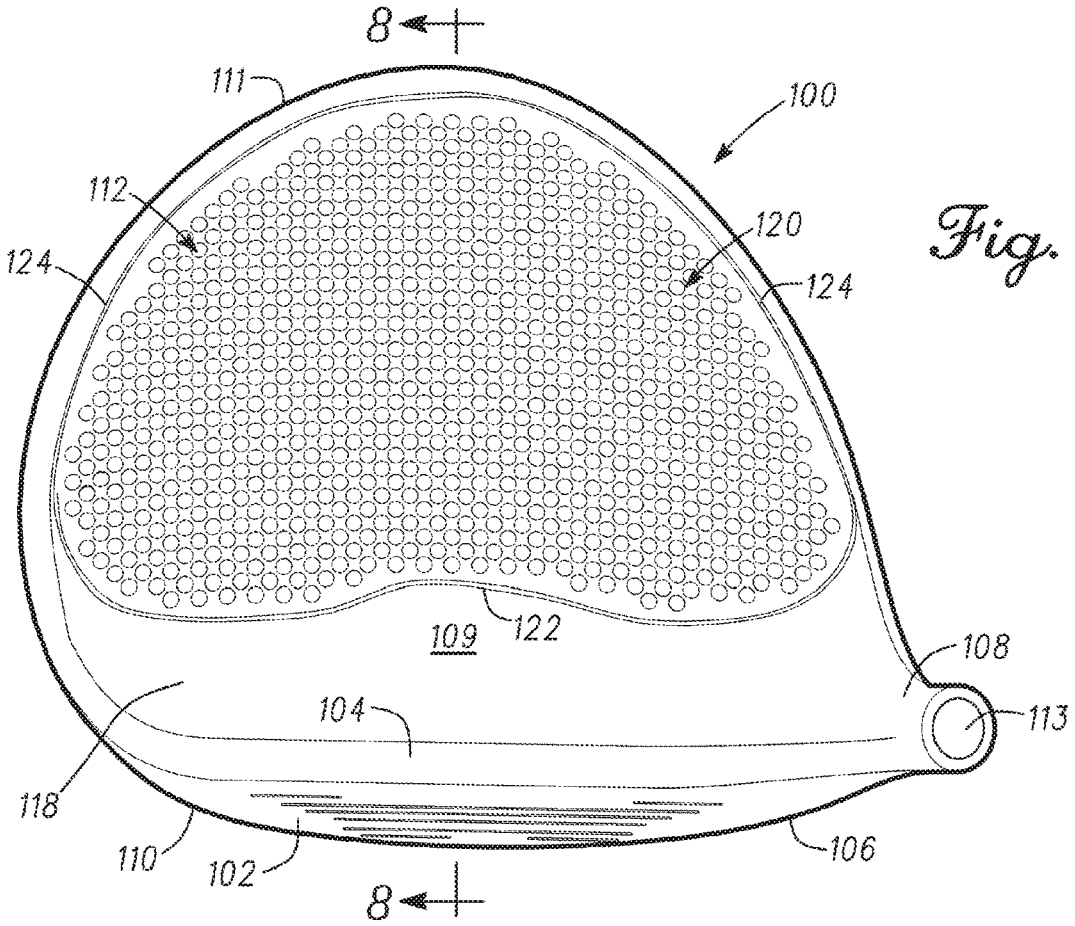
FIG. 4 is a top view of the golf club head of FIG. 1 illustrating the arrangement of the plurality of apertures along the crown of the golf club head.
Figure 5:
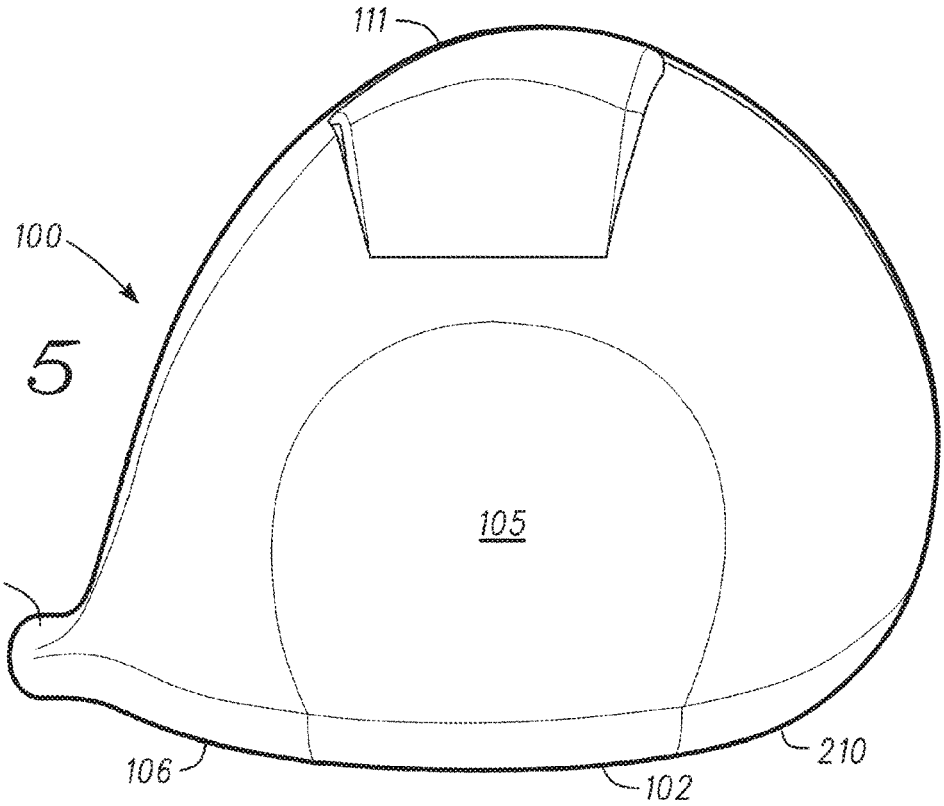
FIG. 5 is a bottom view of the golf club head of FIG. 1.
Figure 6:
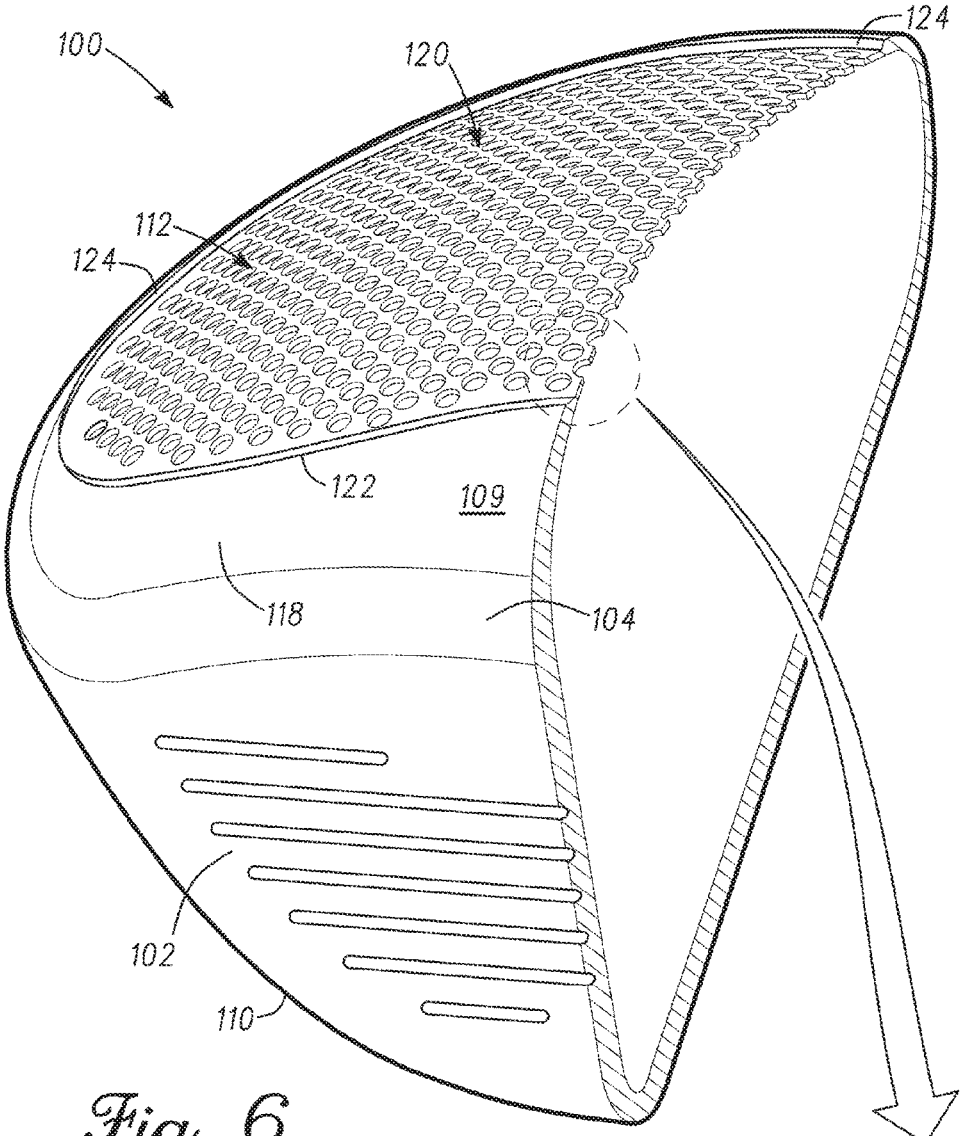
FIG. 6 is a cross-sectional view of the golf club head of FIG. 1.
Figure 7:
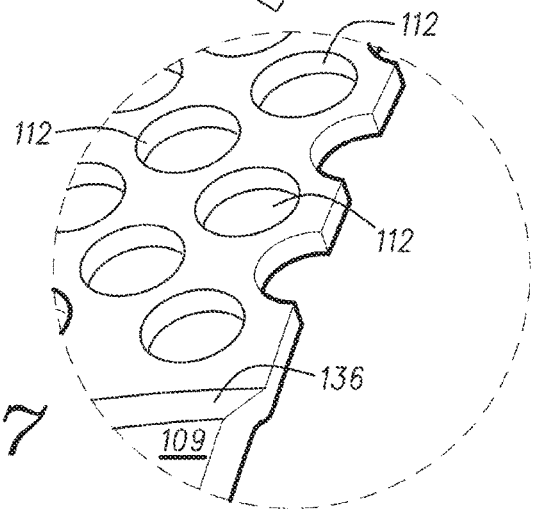
FIG. 7 is an enlarged view of FIG. 6 illustrating the plurality of apertures defined within a recess of the golf club head.

Referring to the drawings, an embodiment of a golf club head is illustrated and generally indicated as 100 in FIG. 1. In general, the golf club head 100 may include a face 102, a sole 105, a heel 106, a toe 110, and a plurality of grooves 115. The golf club head 100 may be a single piece or include multiple portions manufactured together. In one example, the golf club head 100 may be a hollow body formed by a casting process or other suitable type of manufacturing process. In addition, the face 102 may be an integral part of the golf club head 100. Alternatively, the face 102 may be a separate piece from or an insert for a body of the golf club head 100.

The golf club head 100 includes a hosel 108 that defines an aperture 113 configured to engage a shaft (not shown). In particular, the shaft may engage the golf club head 100 on one end and engage a grip (not shown) on an opposite end. For example, the golf club head 100 may be a wood-type golf club, such as a driver-type golf club head, a fairway wood-type golf club head (e.g., 2-wood golf club, 3-wood golf club, 4-wood golf club, 5-wood golf club, 6-wood golf club, 7-wood golf club, 8-wood golf club, or a 9-wood golf club), a hybrid-type golf club head or any other suitable type of golf club head with a hollow body or a body with one or more cavities, apertures, recesses or channels. Although the above examples may depict and/or describe a wood-type golf club head (e.g., driver-type golf club head, a fairway-type golf club head, a hybrid-type golf club head), the apparatus, articles of manufacture, and methods described herein may be applicable to other suitable types of golf club heads.

In addition, the face 102 may be formed adjacent the hosel 108 and provides a surface for striking a golf ball (not shown). The face 102 may be made from one or more metals or metal alloys such as a steel material, a titanium material, a titanium alloy material, a titanium-based material, a combination thereof, one or more composite materials, one or more plastic materials, or other suitable type of materials; however, the face 102 may be made from the same material(s) that constitute the golf club head 100 as described in greater detail below. In particular, the face 102 may include a plurality of grooves, generally shown as 115 in FIG. 1. The golf club head 100 further includes a back 111 formed opposite the face 102 with the sole 105 being defined between the back 111 and the face 102. As further shown, a crown 109 is formed opposite the sole 105, while the face 102 is defined by the heel 106 formed adjacent the hosel 108 and the toe 110 defined at the far end of the face 102. The face 102 further includes a top edge 104 defined between the crown 109 and the face 102 as well as a leading edge 103 defined between the sole 105 and the face 102. In one embodiment, the back 111 may define a cavity 132 configured to receive an insert 134 in order to change the center of gravity and the moment of inertia of the golf club head 100; however, the apparatus, articles of manufacture, and methods described herein are not limited in this regard. Although the golf club head 100 may conform to rules and/or standards of golf defined by various golf standard organizations, governing bodies, and/or rule establishing entities, the apparatus, articles of manufacture, and methods described herein are not limited in this regard.

Figure 9:
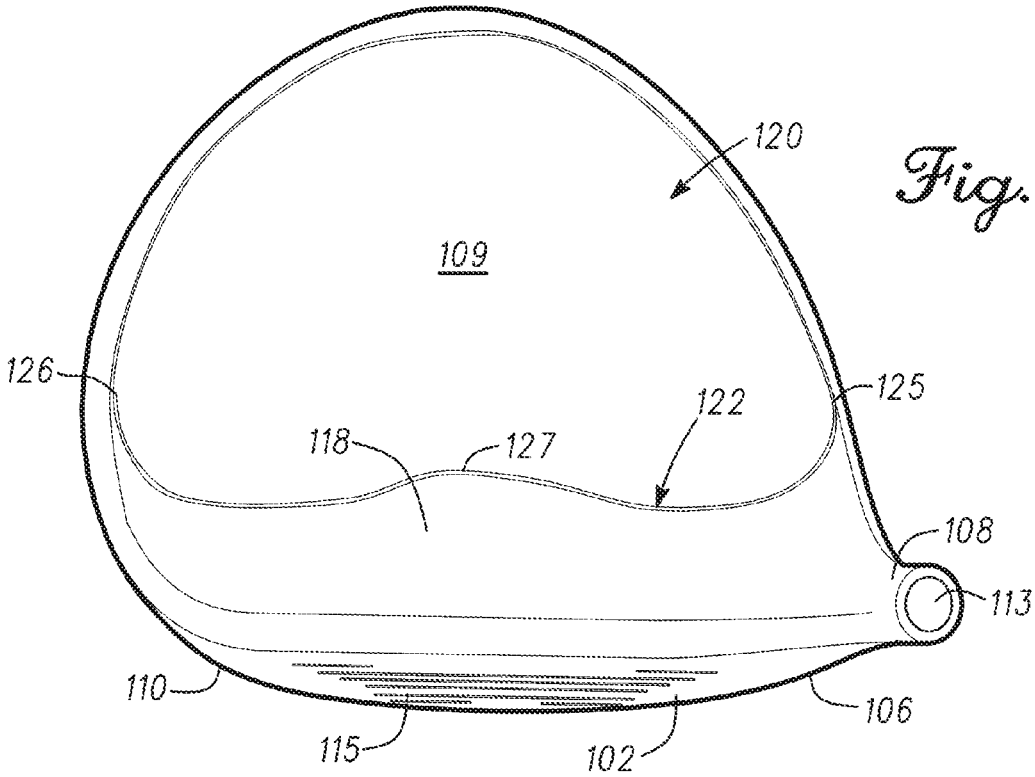
FIG. 9 is a top view of the golf club head of FIG. 1 showing the division of the golf club head into the first region and the second region by a bell-shaped curve established by the first plane.

Referring to FIG. 9, in one embodiment the crown 109 may include a first region 118 and a second region 120 with a bell-shaped curve 122 that may define the boundary between the first and second regions 118 and 120. Details of the bell-shaped curve are provided in U.S. Pat. No. 7,892,111, the entire disclosure of which is incorporated by reference. The first region 118 may sustain and endure relatively more stress than the second region 120 in response to an impact on the face 102 of the golf club head 100 by an object such as a golf ball (not shown). In one example, the bell-shaped curve 122 may include a first point 125, a second point 126 and a third point 127. The first point 125 may be located at or proximate the toe 110 of the golf club head 100, while the second point 126 may be located at or proximate the heel 106 of the golf club head 100. The third point 127 may be located at or proximate a midpoint defined between the first and second points 125 and 126 with the third point 127 being defined closer to the back 111 of the golf club head 100 than first and second points 125 and 126.

Figure 8:
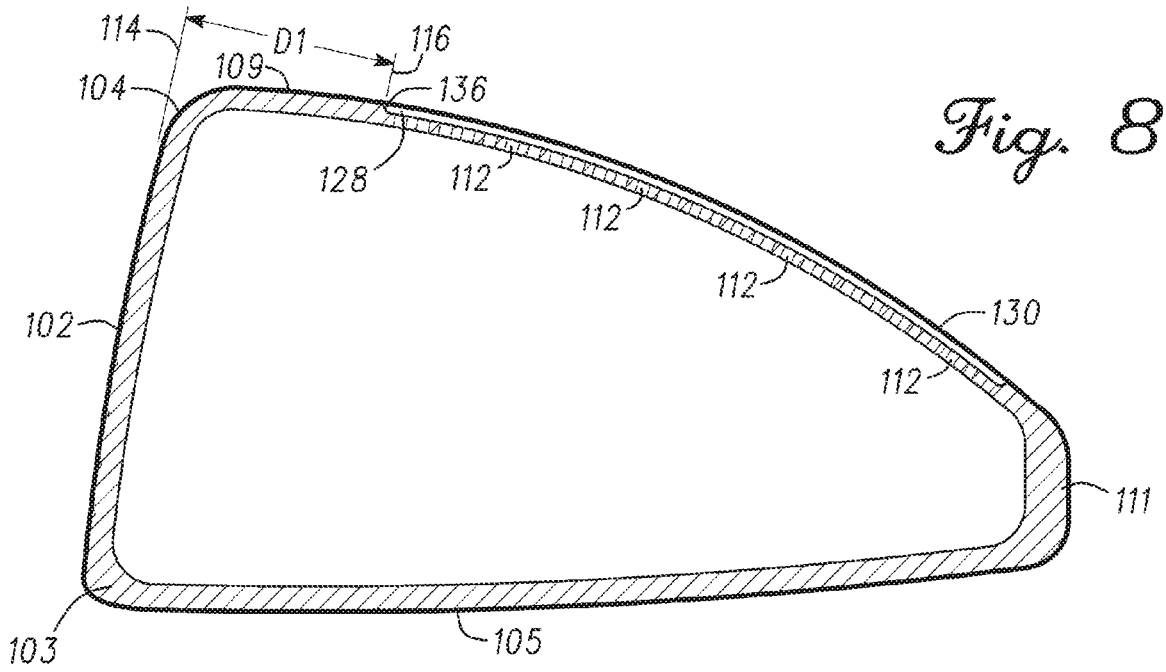
FIG. 8 is a simplified illustration of the golf club head of FIG. 1 showing a first plane and the parallel association of the first plane with a loft plane defined by a face of the golf club head for illustrating the division between a first region and a second region of the golf club head.

As shown in FIG. 8, the bell-shaped curve 122 that defines the boundary between the first and second regions 118 and 120 of the crown 109 may be determined by the relationship between a loft angle 114 of the face 102 and a first plane 116 separated by a predetermined distance D1. In one embodiment, the predetermined distance D1 may be defined as the distance between the top edge 104 of the face 102 and the first plane 116 at the location where first plane 116 intersects the crown 109. For example, the predetermined distance D1 may be greater than one inch. Alternatively, the predetermined distance D1 may be defined as the distance between the leading edge 103 of the face 102 and the location of the first plane 116 where the first plane 116 intersects the sole 105. In addition, the position of the first plane 116 may be established by the orientation or angle of the loft angle 114 of the golf club head 100. In one embodiment, the loft angle 114 may be established by the angle of the face 102 for a particular golf club head 100. For example, the loft angle 114 for a driver-type golf club head may range between 6° to 16°, while the loft angle 114 for a fairway-type golf club head may range between 12° to 30°. The loft angle 114 for a hybrid-type golf club head may range between 16° to 34°. As such, the location of the bell-shaped curve 122 along the crown 109, may be determined by the intersection of the first plane 116 with the crown 109 to establish the location of either the first and second points 125 and 126 (FIG. 9), or the third point 127 of the bell-shaped curve 122.

Referring to FIGS. 1-7, one embodiment of the golf club head 100 may further include a plurality of apertures 112 formed within a recess 128 defined by a perimeter 124 located in the second region 120 of the crown 109. In one example, the bell-shaped curve 122 may define a portion of the perimeter 124 that communicates with the first region 118. The recess 128 may also form a recess lip 136 defined along the perimeter 124 such that the recess 128 is positioned relatively lower on the crown 109 than the first region 118.

Figure 10:
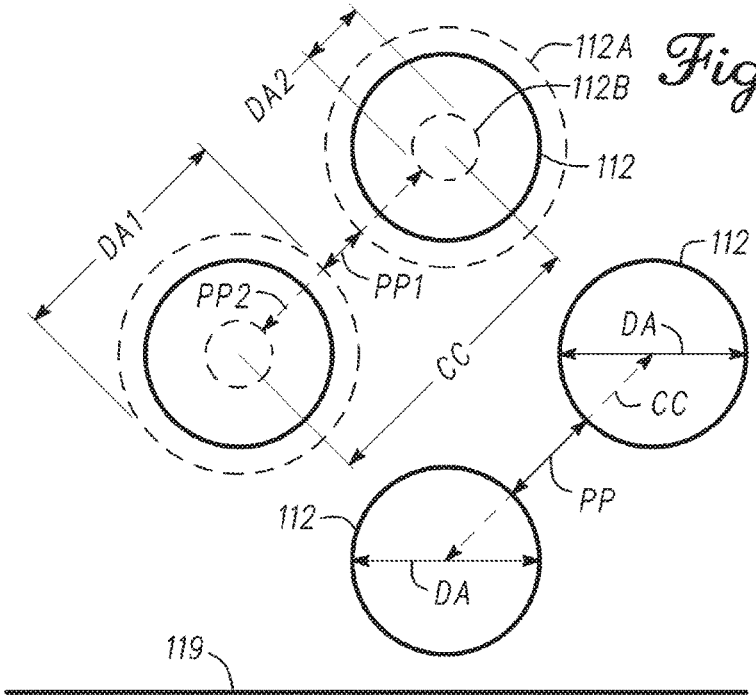
FIG. 10 is a schematic diagram of four apertures of the plurality of apertures of the golf club head of FIG. 1.

FIG. 10 shows a schematic view of four of the apertures 112. Each aperture 112 may have a diameter DA and be spaced apart from an adjacent aperture by a perimeter-to-perimeter distance PP and a center-to-center distance CC. If the apertures 112 are spaced apart at a fixed distance CC, the diameter DA and the distance PP inversely affect each other since increasing the diameter DA reduces the distance PP and decreasing the diameter DA increases the distance PP. For example, as shown by the apertures 112A (i.e., larger aperture shown with dashed lines), the diameter DA1 is larger than the diameter DA of the apertures 112. Accordingly, the distance PP1 is smaller than the distance PP. In another example, as shown by apertures 112B (i.e., smaller aperture shown with dashed lines); the diameter DA2 is smaller than the diameter DA of the apertures 112. Accordingly, the distance PP2 is larger than the distance PP.

The apertures 112A may represent a maximum aperture size for the fixed distance CC. Any aperture size larger than the noted maximum may reduce the distance PP to such an extent that the strength and structural resilience of the golf club head 100 may be compromised. The maximum aperture size, however, may vary depending on physical properties of the golf club head, such as materials from which the crown 109 is constructed and/or thickness of the crown 109. For example, increased rigidity in the material from which the crown 109 is constructed may allow a greater maximum aperture size.

The apertures 112B may represent a minimum aperture size for the fixed distance CC. Any aperture size smaller than the noted minimum may diminish the properties imparted on the golf club head due to having the apertures 112 on the crown 109 as described herein. The minimum aperture size, however, may vary depending on physical properties of the golf club head, such as materials from which the crown is constructed and/or thickness of the crown. For example, reduced rigidity in the material from which the crown 109 is constructed may reduce the minimum allowable aperture size.

Referring to FIG. 10, a line 119 schematically and generally represents the face 102. The apertures 112 are arranged in a diamond pattern relative to the line 119. However, any aperture pattern and/or orientation may be used to provide the properties for the golf club head as described herein.

Figure 11A:
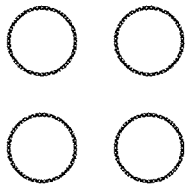
FIGS. 11A-E are schematic diagrams of a plurality of apertures according to various embodiments.
Figure 11B:
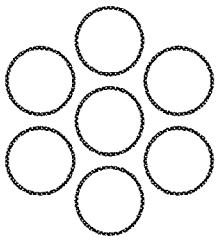
Figure 11C:
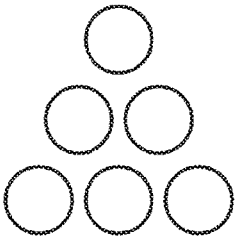
Figure 11D:
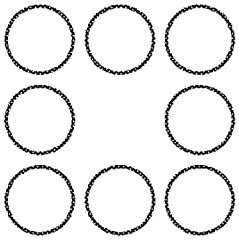
Figure 11E:
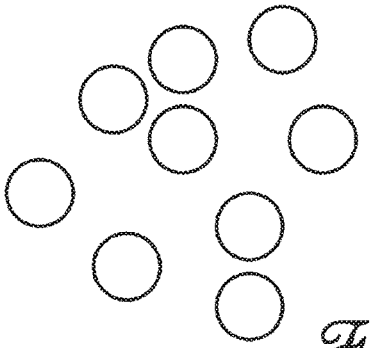

Referring to FIGS. 11A-E, several examples of different aperture patterns are shown. In FIG. 11A, the apertures 112 are arranged in a square pattern. In FIG. 11B, six apertures 112 surround a center aperture 112 to resemble a hexagonal pattern. In FIG. 11C, the apertures 112 are arranged in a triangular pattern. In FIG. 11D, the apertures 112 are arranged in a large square pattern with a large center section 121 that does not include any apertures. In FIG. 11E, the apertures 112 are arranged in a random pattern. The patterns of FIGS. 11A-E are exemplary and illustrate the numerous possibilities for aperture patterns on the crown. Furthermore, if the apertures 112 have different sizes, then the number of possible aperture patterns may increase.

In the above exemplary description of FIG. 10, the distance CC was assumed to be fixed while the diameter DA and the distance PP are varied. However, as illustrated in FIGS. 11A-E, any of the parameters DA, PP or CC may be varied or fixed to provide a certain aperture size, distance, pattern, orientation and/or distribution on the crown 109. For example, if the diameter DA is fixed, i.e., a certain aperture size is preferred, then the distance CC and the distance PP directly affect each other. For example, reducing the distance CC also reduces the distance PP. In another example, if the distance PP is fixed, i.e., apertures having the same perimeter-to-perimeter distance PP are preferred, then both the distance CC and the diameter DA may be varied to provide a preferred distribution configuration of apertures 112 on the crown 109. Thus, any one or more of the parameters DA, PP and CC can be changed for each pair of adjacent apertures 112 to provide certain aperture sizes, inter-aperture distances, patterns, orientation and/or distribution patterns on the crown 109.

In one example, a ratio of the distance PP to the diameter DA may be fixed according to the following formula:

$$PP=DA\cdot R$$

Where R represents a constant. R may be determined based on experimental results, some of which are provided in detail below. According to one example, experimental results with different aperture configurations have pointed to R having a value of 1.23 for a golf club head having certain physical characteristics and material properties to provide sufficient strength and structural resilience to the golf club head while removing near optimum or optimum amount of mass from the crown. The noted experimental results are described in detail herein. Accordingly, if the diameter DA is 0.093" (0.2 cm), the distance PP is 0.115" (0.3 cm).

In one aspect, the plurality of apertures 112 located in the recess within the second region 120 of the crown 109 removes mass from one portion of the golf club head 100 and moves that mass to another more optimal location of the golf club head 100, while still providing sufficient strength and structural resilience to the golf club head 100. In addition, the plurality of apertures 112 provides a generally more even distribution of forces through the crown 109 after impact of the face 102 with a golf ball (not shown) as compared to a crown 109 without having any apertures. This structural arrangement of a plurality of apertures 112 prevents impact forces on the face 102 from being focused at particular portions of the golf club head 100 during travel of these forces through the second region 120 of the crown 109, and in particular to those portions of the crown 109 defined between the plurality of apertures 112. This generally more even distribution of force through the crown 109 after impact by the plurality of apertures 112 also prevents structural failure of the golf club head 100 over time that can be caused by stress risers or stress collectors focusing impact forces at particular areas of the crown 109 caused by the uneven distribution of these forces through the second region 120 after impact as discussed above.

In one embodiment, a protective cover 130 may be engaged to the crown 109 to cover the plurality of apertures 112. The protective cover 130 may be constructed from any type of metallic, artificial or natural materials. For example, the protective cover 130 may be a film or tape made from a polycarbonate or polymeric material having an adhesive on one side that permits the protective cover 130 to adhere to and cover either a portion or the entire crown 109. In some embodiments, the protective cover 130 may be made from a polycarbonate material that exhibits high impact-resistance, while also having low scratch-resistance. In other embodiments, the protective cover 130 may be made from any type of polymeric material, such as polyethylene, neoprene, nylon, polystyrene, polypropylene or combinations thereof. In another embodiment the protective cover 130 may be a rigid cover made from the same material(s) discussed above that allow for structural engagement of the protective cover 130 along the perimeter 124 of the recess 128 to cover the plurality of apertures 112. In either of these arrangements, the protective cover 130 permits the area of the second region 120 of the crown 109, for example the area of the recess 128, to be at the same level as the first region 118 of the crown 109; however, the protective cover 130 does not have to provide any structural reinforcement to the crown 109 that is necessary for protective covers used with prior art golf club heads having larger apertures. The apparatus, articles of manufacture, and methods described herein are not limited in this regard.

While the above embodiments may describe a golf club head 100 including a recess (e.g., recess 128), the apparatus, articles of manufacture, and methods described herein may not include a recess. For example, the plurality of apertures 112 may be defined along the second region 120 of the crown 109 such that the second region 120 is flush with the first region 118. As such, some embodiments of the golf club head 100 do not require either a recess 128 to define an area for forming the plurality of apertures 112 and/or a protective cover 130 to encase or otherwise cover the plurality of apertures 112.

In other embodiments, each of the plurality of apertures 112 may have a range of diameters. The diameter of each aperture 112 of the plurality of apertures 112 may be between 0.005 inches to 0.40 inches (e.g., 0.0127 cm to 1.016 cm). The lower range values may be 0.005 inches (0.0127 cm), 0.006 inches (0.0152 cm), 0.007 inches (0.0178 cm), 0.008 inches (0.0203 cm), 0.009 inches (0.0229 cm), 0.01 inches (0.0254 cm), 0.02 inches (0.0508 cm), 0.03 inches (0.0762 cm), or 0.04 inches (0.1016 cm). The upper range of the diameter of the apertures 112 may be 0.32 inches (0.813 cm), 0.33 inches (0.838 cm), 0.34 inches (0.864 cm), 0.35 inches (0.889 cm), 0.36 inches (0.914 cm), 0.37 inches (0.940 cm), 0.39 inches (0.991 cm), or 0.40 inches (0.1.016 cm).

In another example, the range of the diameter of each aperture 112 of the plurality of apertures 112 may be between 0.05 inches (0.127 cm) to 0.31 inches (e.g., 0.05 inches (0.127 cm), 0.06 inches (0.152 cm), 0.07 inches (0.179 cm), 0.08 inches (0.203 cm), 0.09 inches (0.229 cm), 0.10 inches (0.254 cm), 0.11 inches (0.279 cm), 0.12 inches (0.305 cm), 0.13 inches (0.330 cm), 0.14 inches (0.356 cm), 0.15 inches (0.381 cm), 0.16 inches (0.406 cm), 0.17 inches (0.432 cm), 0.18 inches (0.457 cm), 0.19 inches (0.483 cm), 0.20 inches (0.508 cm), 0.21 inches (0.533 cm), 0.22 inches (0.559 cm), 0.23 inches (0.584 cm) 0.24 inches (0.610 cm), 0.25 inches (0.635 cm), 0.26 inches (0.660 cm), 0.27 inches (0.686 cm), 0.28 inches (0.711 cm), 0.29 inches (0.737 cm), 0.30 inches (0.762 cm), or 0.31 inches (0.787 cm)). In yet another example, the diameter of each aperture 112 of the plurality of apertures 112 may be 0.022 inches (0.0559 cm), 0.020 inches (0.0508 cm), 0.018 inches (0.0457), or 0.016 inches (0.0406 cm), or may be 0.26 inches (0.660 cm), 0.27 inches (0.689), 0.28 inches (0.711 cm), or 0.29 inches (0.737 cm). In another embodiment, the diameter of each aperture 112 of the plurality of apertures 112 may be 0.093 inches (0.236 cm).

Although some of the above examples may describe all of the plurality of apertures 112 having an identical diameter or a substantially similar diameter, the apparatus, articles of manufacture, and methods are not limited in this regard, For example, two or more apertures of the plurality of apertures 112 may have different diameters (e.g., the diameters of the plurality of apertures 112 may vary from one aperture to another). In particular, as described in detail below, a first aperture may be associated with a first diameter and a second aperture may be associated with a second diameter. The first diameter being greater than the second diameter.

In one embodiment, each aperture 112 of the plurality of apertures 112 may have a diameter no greater than 0.30 inches (0.762 cm). In another embodiment, each aperture 112 of the plurality of apertures 112 may have a diameter no greater than 0.25 inches (0.635 cm). In other embodiments, the plurality of apertures 112 may have diameters no greater than 0.20 inches (0.508 cm), while other embodiments, each of the plurality of apertures 112 may have diameters no greater than 0.175 inches (0.444 cm), 0.150 inches (0.381 cm), 0.125 inches (0.312 cm), 0.100 inches (0.254), 0.093 inches (0.236 cm), 0.075 (0.191 cm), or 0.050 (0.127 cm), respectively. In addition, the number of apertures 112 defined along the second region 120 of the crown 109 depends on the diameter of the plurality of apertures 112. For example, a golf club head 100 having an aperture diameter of 0.25 inches (0.635 cm) may have about 60 apertures, while a golf club head 100 having an aperture diameter of 0.093 inches (0.236 cm) may have about 576 apertures. In another example, a golf club head 100 having a combination of aperture diameters of 0.093 inches (0.236 cm) and 0.040 inches (0.102 cm) may have about 1500 apertures; however, the apparatus, articles of manufacture, and methods described herein are not limited in this regard. In particular, the number and/or size of the plurality of apertures 112 may vary based on the volume of the golf club head 100 (e.g., a golf club head less than or equal to 470 cc).

The plurality of apertures 112 may also define different configurations and sizes. For example, the plurality of apertures 112 may have a round-shaped configuration, an oval-shaped configuration, a diamond-shaped configuration, a square-shaped configuration, a rectangular-shaped configuration, a hexagon-shaped configuration, a pentagon-shaped configuration, a linear-shaped configuration, and/or a non-linear-shaped configuration. In addition, the plurality of apertures 112 may have different diameters or configurations within a particular pattern. Finally, the pattern of the apertures 112 within the second region 120 may define a repeating pattern, non-repeating pattern, symmetrical pattern and/or non-symmetrical pattern; however, the apparatus, articles of manufacture, and methods described herein are not limited in this regard. Further, while the above examples may describe the plurality of apertures 112 being located on the crown 109 of the golf club head 100, the plurality of apertures 112 may be located on other portion(s) of a golf club head (e.g., the sole only, the crown and the sole, etc).

In one embodiment, the golf club head 100 may be made from steel, steel alloy, titanium, titanium alloy (e.g., titanium 6-4 or titanium 8-1-1). In other embodiments, the golf club head 100 may be made from one or more materials including titanium, titanium alloys, magnesium, magnesium alloys, titanium aluminides, fiber-based composites, and metal matrix composites or mixtures thereof. In some embodiments, the fiber-based composite may be carbon fiber, fiberglass, or KEVLAR® or combinations thereof. In some embodiments, the percentage of titanium may be 10%, 20%, 30%, 40%, 50%, 60%, 70%, 80%, 90%, or 99% for titanium alloys and 100% for a golf club head 100 made entirely of 100% titanium. In other embodiments, the percentage of fiberglass may be 10%, 20%, 30%, 40%, 50%, 60%, 70%, 80%, 90%, or 100% . In yet other embodiments, the percentage of KEVLAR® may be 10%, 20%, 30%, 40%, 50%, 60%, 70%, 80%, 90%, or 100%. In some embodiments, the KEVLAR® may be any type of para-aramid synthetic fiber. In some embodiments the percentage of carbon fiber may be 10%, 20%, 30%, 40%, 50%, 60%, 70%, 80%, 90%, or 100%. In some embodiments, the golf club head 100 may be 50% titanium and 50% of one or more of the fiber-based composite(s), although in other embodiments a golf club head according to the disclosure may constitute any of the percentages for titanium noted above in combination with one or more respective percentages of the fiber-based composite(s).

Figure 12:
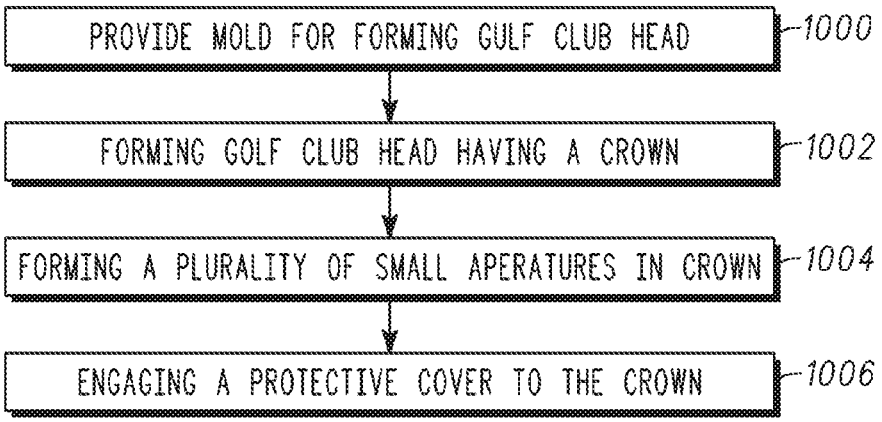
FIG. 12 is a flow chart illustrating a method of manufacturing the golf club head of FIG. 1.

Referring to FIG. 12, a flow chart illustrates one method for manufacturing the golf club head 100 with a plurality of apertures 112. At block 1000, a mold (not shown) is provided for forming the golf club head 100. At block 1002, the golf club head 100 is formed using the mold having the face 102, sole 105, heel 106, toe 110, back 111, crown 109, and hosel 108 defining the aperture 113 configured to engage the shaft. In one embodiment, the crown 109 formed by the mold is defined between the back 111 and front edge 104 of the golf club head 100. In addition, the recess 128 may be defined along the crown 109 using the mold. At block 1004, the plurality of apertures 112 is formed along the crown 109. The plurality of apertures 112 may be formed using a stamping process that forms the apertures 112 entirely through the material of the crown 109. In the alternative, a plurality of small recesses (not shown) may be formed into but not entirely through the material of the crown 109 rather than the plurality of apertures 112; however, the apparatus, articles of manufacture, and methods described herein are not limited in this regard. At block 1006, the protective cover 130 may be configured to engage and cover the plurality of apertures 112 within the perimeter 124 defined along the portion of the crown 109. As discussed above, the protective cover 130 may be a film or tape made from a polycarbonate or plastic material having an adhesive on one side that permits the protective cover 130 to adhere to and cover either a portion or the entire crown 109, while in another embodiment the protective cover 130 may be rigid cover that is structurally engaged along the perimeter 124 defined by the recess 128 to cover the plurality of apertures 112. In either of these arrangements, the protective cover 130 permits the area of the second region 120 of the crown 109, for example the recess 128, to be at the same level as the first region 118 of the crown 109; however, the apparatus, articles of manufacture, and methods described herein are not limited in this regard.

Although a particular order of actions is illustrated in FIG. 12, these actions may be performed in other temporal sequences. For example, two or more actions depicted in FIG. 12 may be performed sequentially, concurrently, or simultaneously. Alternatively, two or more actions depicted may be performed in reversed order. Further, one or more actions depicted in FIG. 12 may not be performed at all. The apparatus, methods, and articles of manufacture described herein are not limited in this regard.

Referring to FIG. 13-17, another embodiment of a golf club head is illustrated and generally indicated as 200. In general, the golf club head 200 may include a face 202, a sole 205, a heel 206, and a toe 210. The golf club head 200 may also include a plurality of grooves 215 on the face 202. The golf club head 200 may be a single piece or include multiple portions manufactured together. In one example, the golf club head 200 may be a hollow body formed by a casting process or other suitable type of manufacturing process. In addition, the face 202 may be an integral part of the golf club head 200. Alternatively, the face 202 may be a separate piece from or an insert for a body of the golf club head 200.

The golf club head 200 includes a hosel 208 that defines an aperture 213 configured to engage a shaft (not shown). In particular, the shaft may engage the golf club head 200 on one end and engage a grip (not shown) on an opposite end. For example, the golf club head 200 may be a wood-type golf club, such as a driver-type golf club head, a fairway wood-type golf club head (e.g., 2-wood golf club, 3-wood golf club, 4-wood golf club, 5-wood golf club, 6-wood golf club, 7-wood golf club, 8-wood golf club, or a 9-wood golf club), a hybrid-type golf club head or any other suitable type of golf club head with a hollow body or a body with one or more cavities, apertures, recesses or channels. Although the above examples may depict and/or describe a wood-type golf club head (e.g., driver-type golf club head, a fairway-type golf club head, a hybrid-type golf club head), the apparatus, articles of manufacture, and methods described herein may be applicable to other suitable types of golf club heads.

In addition, the face 202 may be formed adjacent the hosel 208 and provides a surface for striking a golf ball (not shown). The face 202 may be made from one or more metals or metal alloys such as a steel material, a titanium material, a titanium alloy material, a titanium-based material, a combination thereof, one or more composite materials, one or more plastic materials, or other suitable type of materials; however, the face 202 may be made from the same material(s) that constitute the golf club head 200 as described in greater detail below. In particular, the face 202 may include a plurality of grooves 215. The golf club head 200 further includes a back 211 formed opposite the face 202 with the sole 205 being defined between the back 211 and the face 202. As further shown, a crown 209 is formed opposite the sole 205, while the face 202 is defined by the heel 206 formed adjacent the hosel 208 and the toe 210 defined at the far end of the face 202. The face 202 further includes a top edge 204 defined between the crown 209 and the face 202 as well as a leading edge 203 defined between the sole 205 and the face 202. Although the golf club head 200 may conform to rules and/or standards of golf defined by various golf standard organizations, governing bodies, and/or rule establishing entities, the apparatus, articles of manufacture, and methods described herein are not limited in this regard.

Figure 16:
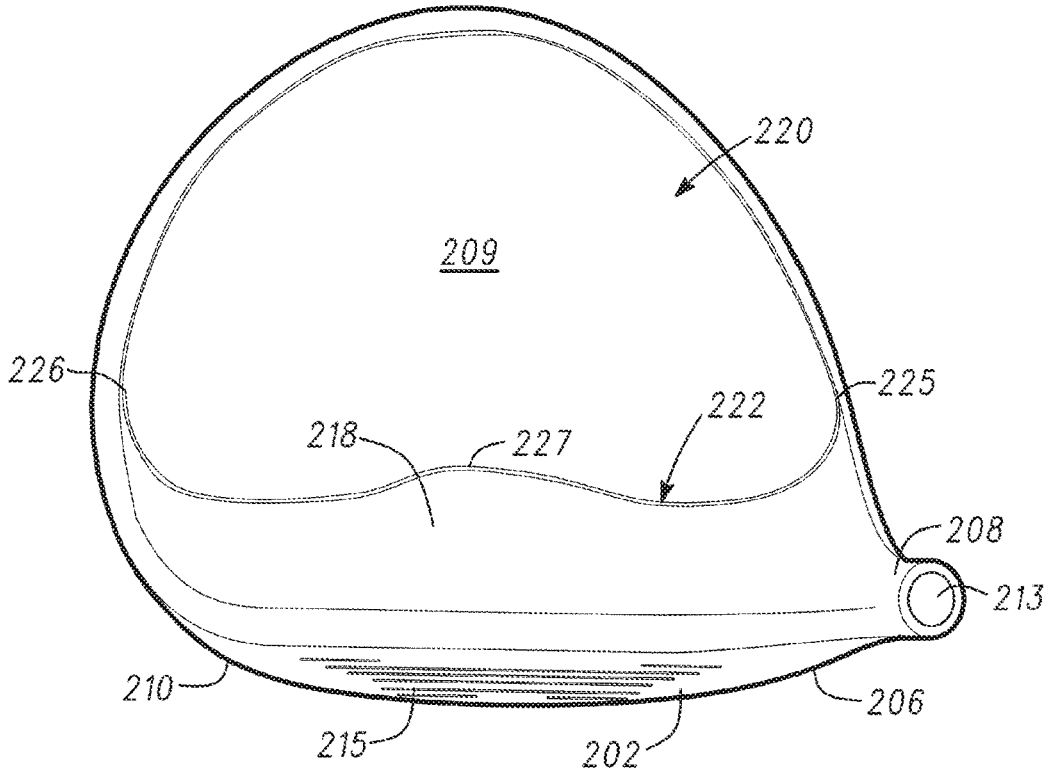
FIG. 16 is a top view of the golf club head of FIG. 13 showing the division of the golf club head into the first region and the second region by a bell-shaped curve established by the first plane.

Referring to FIG. 16, in one embodiment the crown 209 may include a first region 218 and a second region 220 with a bell-shaped curve 222 that may define the boundary between the first and second regions 218 and 220. Details of the bell-shaped curve are provided in U.S. Pat. No. 7,892,111. The first region 218 may sustain and endure relatively more stress than the second region 220 in response to an impact on the face 202 of the golf club head 200 by an object such as a golf ball (not shown). In one example, the bell-shaped curve 222 may include a first point 225, a second point 226 and a third point 227. The first point 225 may be located at or proximate the toe 210 of the golf club head 200, while the second point 226 may be located at or proximate the heel 206 of the golf club head 200. The third point 227 may be located at or proximate a midpoint defined between the first and second points 225 and 226 with the third point 227 being defined closer to the back 211 of the golf club head 200 than first and second points 225 and 226.

Figure 15:
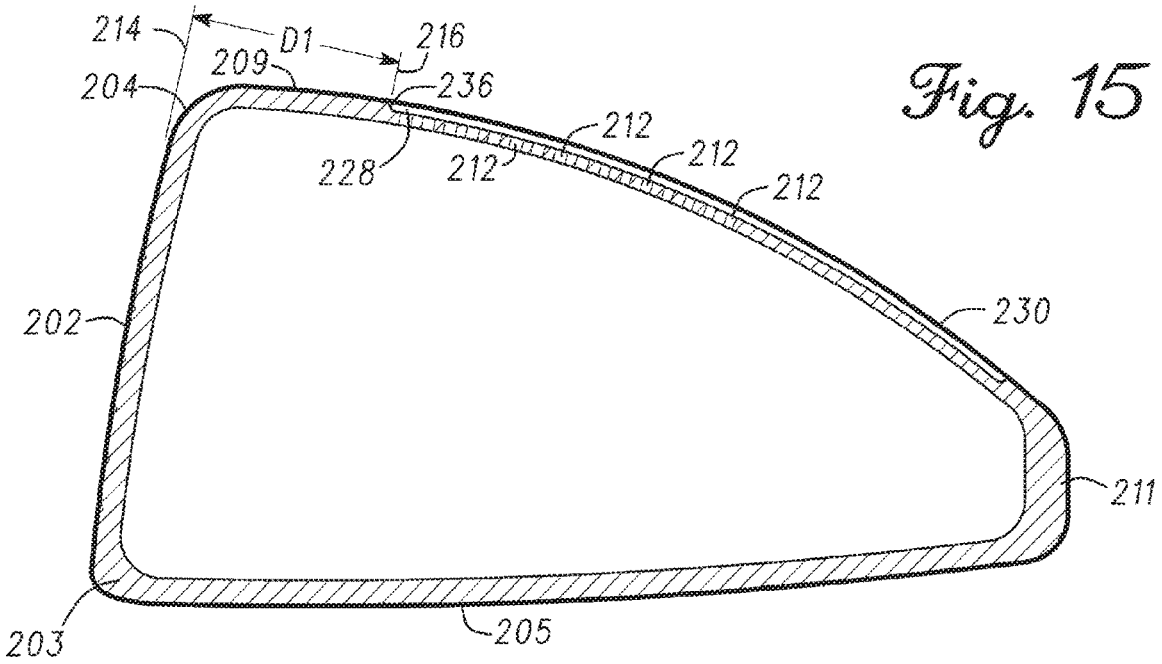
FIG. 15 is a simplified illustration of the golf club head of FIG. 13 showing a first plane and the parallel association of the first plane with a loft plane defined by a face of the golf club head for illustrating the division between a first region and a second region of the golf club head.

As shown in FIG. 15, the bell-shaped curve 222 that defines the boundary between the first and second regions 218 and 220 of the crown 209 may be determined by the relationship between a loft angle 214 of the face 202 and a first plane 216 separated by a predetermined distance D1. In one embodiment, the predetermined distance D1 may be defined as the distance between the top edge 204 of the face 202 and the first plane 216 at the location where first plane 216 intersects the crown 209. For example, the predetermined distance D1 may be greater than one inch. Alternatively, the predetermined distance D1 may be defined as the distance between the leading edge 203 of the face 202 and the location of the first plane 216 where the first plane 216 intersects the sole 205. In addition, the position of the first plane 216 may be established by the orientation or angle of the loft angle 214 of the golf club head 200. In one embodiment, the loft angle 214 may be established by the angle of the face 102 for a particular golf club head 200. For example, the loft angle 214 for a driver-type golf club head may range between 6° to 16°, while the loft angle 214 for a fairway-type golf club head may range between 12° to 30°. The loft angle 214 for a hybrid-type golf club head may range between 16° to 34°. As such, the location of the bell-shaped curve 222 along the crown 209, may be determined by the intersection of the first plane 216 with the crown 209 to establish the location of either the first and second points 225 and 226 (FIG. 16), or the third point 227 of the bell-shaped curve 122.

Figure 13:
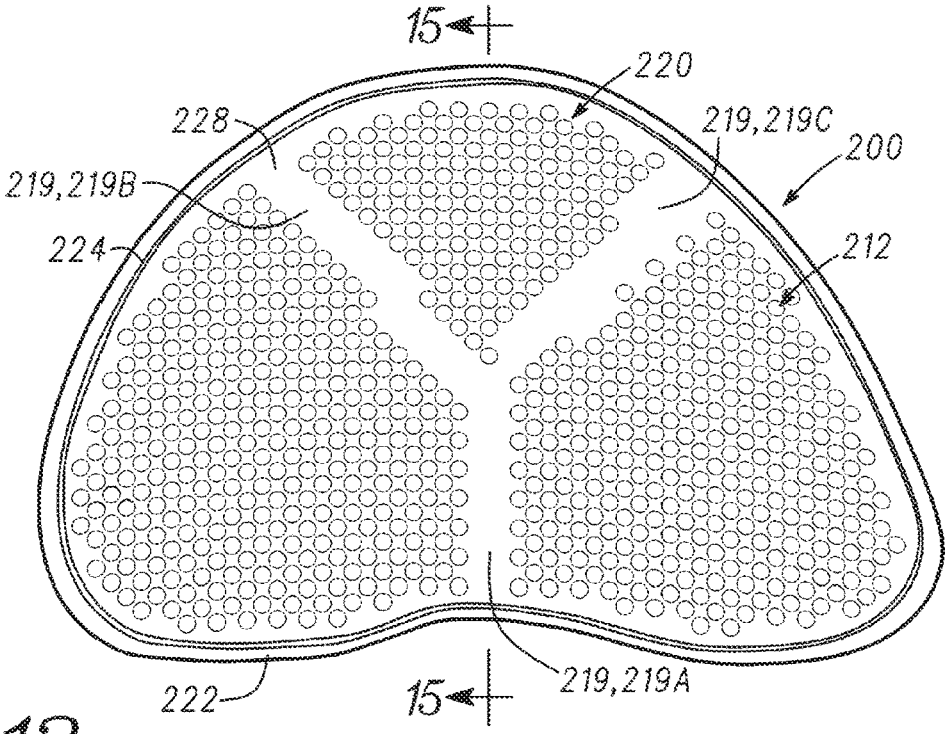
FIG. 13 is a top view of a portion of a crown of a golf club head according to another embodiment illustrating the arrangement of the plurality of apertures along the crown of the golf club head.
Figure 14:
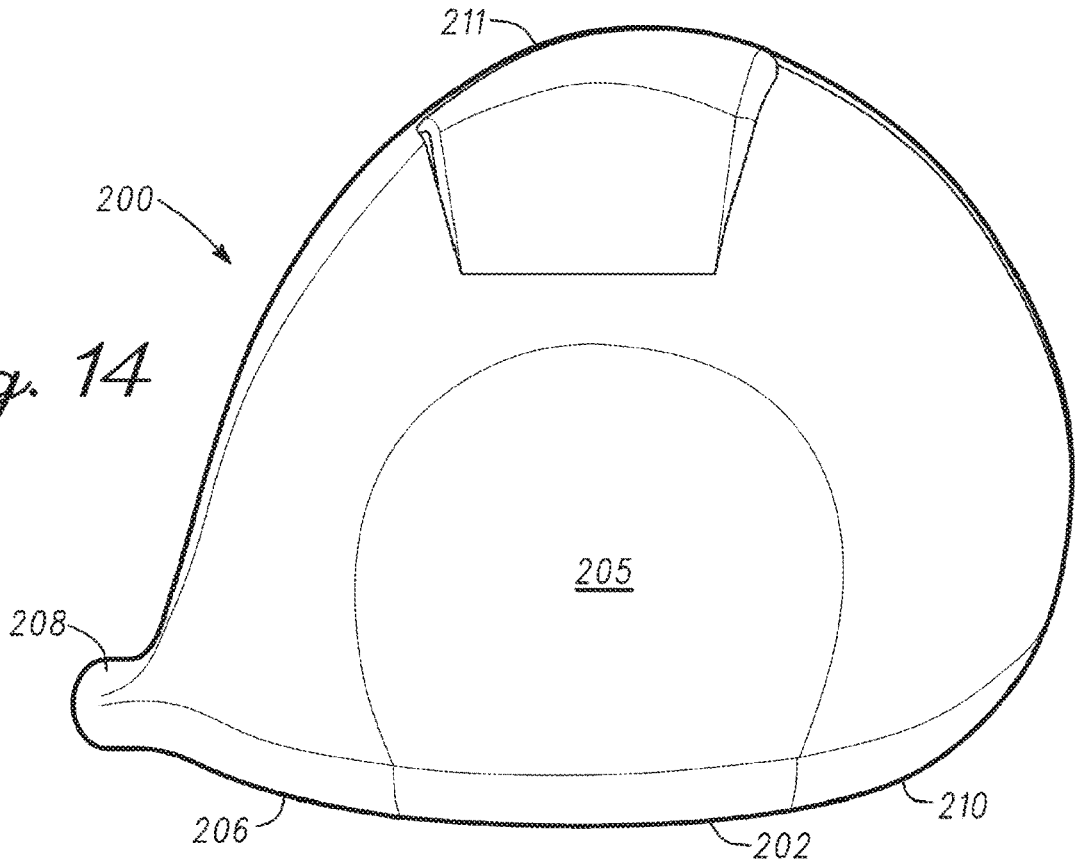
FIG. 14 is a bottom view of the golf club head of FIG. 13.

Referring to FIG. 13, one embodiment of the golf club head 200 may further include a plurality of apertures 212 formed within a recess 228 defined by a perimeter 224 located in the second region 220 of the crown 209. In one example, the bell-shaped curve 222 may define a portion of the perimeter 224 that communicates with the first region 218. The recess 228 may also form a recess lip 236 defined along the perimeter 224 such that the recess 228 is positioned relatively lower on the crown 209 than the first region 218. The golf club head 200 also may include reinforcing ribs 219 in the second region 220 for increasing rigidity of the crown 209 at certain locations on the crown 209. In the example of FIG. 13, three reinforcing ribs, which are referred to as reinforcing ribs 219A-C are provided on the crown 209. The reinforcing ribs 219A-C may be defined by areas of the crown 209 that do not include the apertures 212. Accordingly, the reinforcing ribs 219 may be formed on the crown 209 by not forming apertures 212 on portions of the crown 209 that define the reinforcing ribs 219.

As shown in the example of FIG. 13, the reinforcing rib 219A may be generally perpendicular to the face 202 and bifurcate into the reinforcing ribs 219B and 219C to form a generally Y-shaped reinforcing structure. The reinforcing rib 219A may extend from the proximate to the third point 227 of the bell-shaped curve 222 toward the back 211. Accordingly, the impact force on the face 202 may be partly transferred to the reinforcing rib 219A. At a certain location in the second region 220, the reinforcing ribs 219B and 219C disperse or spread the impact force to the back 211. FIG. 13 shows one example of the reinforcing ribs 219, which are specifically shown as reinforcing ribs 219A-C. However, any reinforcing rib configuration can be provided on the crown 209. The width, length, orientation of each reinforcing rib 219 may depend on the size of the crown 209, the thickness or the crown 209, the sizes, distribution patterns, and other properties of the apertures 212, and/or the materials from which the crown 209 is constructed. For example, the reinforcing ribs 219A-C can be strategically located on the crown 220 to coincide with the highest stress locations on the crown 209 resulting from impact forces on the face 202. Generally, the width of a reinforcing rib may be greater than the greatest dimension of the apertures 212. For example, if the apertures 212 are circular, then the width of the reinforcing ribs 219 may be greater than the diameter of the apertures 212. Furthermore, the width of the reinforcing ribs 219 may be greater than the largest distance between any two adjacent apertures 212.

The reinforcing ribs 219 provide structural reinforcement for the crown 209 or regions of the crown 209 that experience large impact forces or high stresses. The reinforcing ribs 219 may also assist in evenly distributing the high stresses throughout the crown 209.

Accordingly, due to the presence of the reinforcing ribs 219, the sizes, patterns, orientations, shapes and/or distribution of the apertures 212 may be different as compared to the apertures 112 of the embodiment described above according to FIGS. 1-12. For example, having reinforcement ribs 219 on the crown 209 may allow a larger aperture density (i.e., apertures per area), which may be achieved by having a larger number of apertures that are closer to each other. In another example, the size of the apertures 212 may be increased while the distance between the apertures 212 may be reduced as compared to the apertures 112 due to the presence of the reinforcing ribs 219. Therefore, the shapes, sizes, orientations, patterns or other characteristics of the reinforcing ribs 219 may directly affect the shapes, sizes, orientations, distribution patterns, or other characteristics of the apertures 212 to achieve similar results as the embodiments of FIGS. 1-12.

In one aspect, the plurality of apertures 212 located within the second region 220 of the crown 209 removes mass from one portion of the golf club head 200 and moves that mass to another more optimal location of the golf club head 200, while still providing sufficient strength and structural resilience to the golf club head 200. In addition, the plurality of apertures 212 provides a generally more even distribution of forces through the crown 209 after impact of the face 202 with a golf ball (not shown) as compared to a crown 209 without having any apertures. This structural arrangement of a plurality of apertures 212 prevents impact forces on the face 202 from being focused at particular portions of the golf club head 200 during travel of these forces through the second region 220 of the crown 209, and in particular to those portions of the crown 209 defined between the plurality of apertures 212. However, at the particular locations where stresses are high relative to other regions of the crown 209, reinforcing ribs 219 can be provided. This generally more even distribution of force through the crown 209 after impact by the plurality of apertures 212 and the reinforcing ribs 219 also prevents structural failure of the golf club head 200 over time that can be caused by stress risers or stress collectors focusing impact forces at particular areas of the crown 209 caused by the uneven distribution of these forces through the second region 220 after impact as discussed above.

In one embodiment, a protective cover 230 may be engaged to the crown 209 to cover the plurality of apertures 212. The protective cover 230 may be constructed from any type of metallic, artificial or natural materials. For example, the protective cover 230 may be a film or tape made from a polycarbonate or polymeric material having an adhesive on one side that permits the protective cover 230 to adhere to and cover either a portion or the entire crown 209. In some embodiments, the protective cover 230 may be made from a polycarbonate material that exhibits high impact-resistance, while also having low scratch-resistance. In other embodiments, the protective cover 230 may be made from any type of polymeric material, such as polyethylene, neoprene, nylon, polystyrene, polypropylene or combinations thereof. In another embodiment the protective cover 230 may be a rigid cover made from the same material(s) discussed above that allow for structural engagement of the protective cover 230 along the perimeter 224 of the recess 228 to cover the plurality of apertures 212. In either of these arrangements, the protective cover 230 permits the area of the second region 220 of the crown 209, for example the area of the recess 228, to be at the same level as the first region 218 of the crown 209; however, the protective cover 230 does not have to provide any structural reinforcement to the crown 209 that is necessary for protective covers used with prior art golf club heads having larger apertures. The apparatus, articles of manufacture, and methods described herein are not limited in this regard.

While the above embodiments may describe a golf club head 200 including a recess (e.g., recess 228), the apparatus, articles of manufacture, and methods described herein may not include a recess. For example, the plurality of apertures 212 and the reinforcing ribs 219 may be defined along the second region 220 of the crown 209 such that the second region 220 is flush with the first region 218. As such, some embodiments of the golf club head 200 do not require either a recess 228 to define an area for forming the plurality of apertures 212 and the reinforcing ribs 219 and/or a protective cover 230 to encase or otherwise cover the plurality of apertures 212.

In other embodiments, each of the plurality of apertures 212 may have a range of diameters. The diameter of each aperture 212 of the plurality of apertures 212 may be between 0.005 inches to 0.40 inches (e.g., 0.0127 cm to 1.016 cm). The lower range values may be 0.005 inches (0.0127 cm), 0.006 inches (0.0152 cm), 0.007 inches (0.0178 cm), 0.008 inches (0.0203 cm), 0.009 inches (0.0229 cm), 0.01 inches (0.0254 cm), 0.02 inches (0.0508 cm), 0.03 inches (0.0762 cm), or 0.04 inches (0.1016 cm). The upper range of the diameter of the apertures 112 may be 0.32 inches (0.813 cm), 0.33 inches (0.838 cm), 0.34 inches (0.864 cm), 0.35 inches (0.889 cm), 0.36 inches (0.914 cm), 0.37 inches (0.940 cm), 0.39 inches (0.991 cm), or 0.40 inches (0.1.016 cm).

In another example, the range of the diameter of each aperture 212 of the plurality of apertures 212 may be between 0.05 inches (0.127 cm) to 0.31 inches (e.g., 0.05 inches (0.127 cm), 0.06 inches (0.152 cm), 0.07 inches (0.179 cm), 0.08 inches (0.203 cm), 0.09 inches (0.229 cm), 0.10 inches (0.254 cm), 0.11 inches (0.279 cm), 0.12 inches (0.305 cm), 0.13 inches (0.330 cm), 0.14 inches (0.356 cm), 0.15 inches (0.381 cm), 0.16 inches (0.406 cm), 0.17 inches (0.432 cm), 0.18 inches (0.457 cm), 0.19 inches (0.483 cm), 0.20 inches (0.508 cm), 0.21 inches (0.533 cm), 0.22 inches (0.559 cm), 0.23 inches (0.584 cm) 0.24 inches (0.610 cm), 0.25 inches (0.635 cm), 0.26 inches (0.660 cm), 0.27 inches (0.686 cm), 0.28 inches (0.711 cm), 0.29 inches (0.737 cm), 0.30 inches (0.762 cm), or 0.31 inches (0.787 cm)).

In yet another example, the diameter of each aperture 212 of the plurality of apertures 212 may be 0.022 inches (0.0559 cm), 0.020 inches (0.0508 cm), 0.018 inches (0.0457), or 0.016 inches (0.0406 cm), or may be 0.26 inches (0.660 cm), 0.27 inches (0.689), 0.28 inches (0.711 cm), or 0.29 inches (0.737 cm). In another embodiment, the diameter of each aperture 212 of the plurality of apertures 212 may be 0.093 inches (0.236 cm).

Although some of the above examples may describe all of the plurality of apertures 212 having an identical diameter or a substantially similar diameter, the apparatus, articles of manufacture, and methods are not limited in this regard, For example, two or more apertures of the plurality of apertures 212 may have different diameters (e.g., the diameters of the plurality of apertures 212 may vary from one aperture to another). In particular, as described in detail below, a first aperture may be associated with a first diameter and a second aperture may be associated with a second diameter. The first diameter being greater than the second diameter.

In one embodiment, each aperture 212 may have a diameter no greater than 0.30 inches (0.762 cm). In another embodiment, each aperture 212 may have a diameter no greater than 0.25 inches (0.635 cm). In other embodiments, the plurality of apertures 212 may have diameters no greater than 0.20 inches (0.508 cm), while other embodiments, each of the plurality of apertures 212 may have diameters no greater than 0.175 inches (0.444 cm), 0.150 inches (0.381 cm), 0.125 inches (0.312 cm), 0.100 inches (0.254), 0.093 inches (0.236 cm), 0.075 (0.191 cm), or 0.050 (0.127 cm), respectively. In addition, the number of apertures 212 defined along the second region 220 of the crown 209 depends on the diameter of the plurality of apertures 212. For example, a golf club head 200 having an aperture diameter of 0.25 inches (0.635 cm) may have about 60 apertures, while a golf club head 200 having an aperture diameter of 0.093 inches (0.236 cm) may have about 576 apertures. In another example, a golf club head 100 having a combination of aperture diameters of 0.093 inches (0.236 cm) and 0.040 inches (0.102 cm) may have about 1500 apertures; however, the apparatus, articles of manufacture, and methods described herein are not limited in this regard. In particular, the number and/or size of the plurality of apertures 212 may vary based on the volume of the golf club head 200 (e.g., a golf club head less than or equal to 470 cc).

The plurality of apertures 212 may also define different configurations and sizes. For example, the plurality of apertures 212 may have a round-shaped configuration, an oval-shaped configuration, a diamond-shaped configuration, a square-shaped configuration, a rectangular-shaped configuration, a hexagon-shaped configuration, a pentagon-shaped configuration, a linear-shaped configuration, and/or a non-linear-shaped configuration. In addition, the plurality of apertures 212 may have different diameters or configurations within a particular pattern. Furthermore, the apertures may be in any shape, size and/or configuration. Finally, the pattern of the apertures 212 within the second region 220 may define a repeating pattern, non-repeating pattern, symmetrical pattern and/or non-symmetrical pattern; however, the apparatus, articles of manufacture, and methods described herein are not limited in this regard. Further, while the above examples may describe the plurality of apertures 212 being located on the crown 209 of the golf club head 200, the plurality of apertures 212 may be located on other portion(s) of a golf club head (e.g., the sole only, the crown and the sole, etc).

The number and size of the apertures 212 and the number and size of the reinforcing ribs 219 may affect each other. For example, a crown having large apertures that are relatively close to each other may require a greater number of reinforcing ribs or wider/larger reinforcing ribs to provide sufficient strength and structural resilience for the golf club head. Smaller apertures that are relatively far apart from each other, however, may not need a larger number of reinforcing ribs or wider/larger reinforcing ribs to provide sufficient strength and structural resilience for the crown.

In one embodiment, the golf club head 200 may be made from steel, steel alloy, titanium, titanium alloy (e.g., titanium 6-4 or titanium 8-1-1). In other embodiments, the golf club heads according to the disclosure may be made from one or more materials including titanium, titanium alloys, magnesium, magnesium alloys, titanium aluminides, fiber-based composites, and metal matrix composites or mixtures thereof. In some embodiments, the fiber-based composite may be carbon fiber, fiberglass, or KEVLAR® or combinations thereof. In some embodiments, the percentage of titanium may be 10%, 20%, 30%, 40%, 50%, 60%, 70%, 80%, 90%, or 99% for titanium alloys and 100% for a golf club head 200 made entirely of 100% titanium. In other embodiments, the percentage of fiberglass may be 10%, 20%, 30%, 40%, 50%, 60%, 70%, 80%, 90%, or 100% . In yet other embodiments, the percentage of KEVLAR® may be 10%, 20%, 30%, 40%, 50%, 60%, 70%, 80%, 90%, or 100%. In some embodiments, the KEVLAR® may be any type of para-aramid synthetic fiber. In some embodiments the percentage of carbon fiber may be 10%, 20%, 30%, 40%, 50%, 60%, 70%, 80%, 90%, or 100%. In some embodiments, the golf club head 200 may be 50% titanium and 50% of one or more of the fiber-based composite(s), although in other embodiments a golf club head according to the disclosure may constitute any of the percentages for titanium noted above in combination with one or more respective percentages of the fiber-based composite(s).

Figure 17:
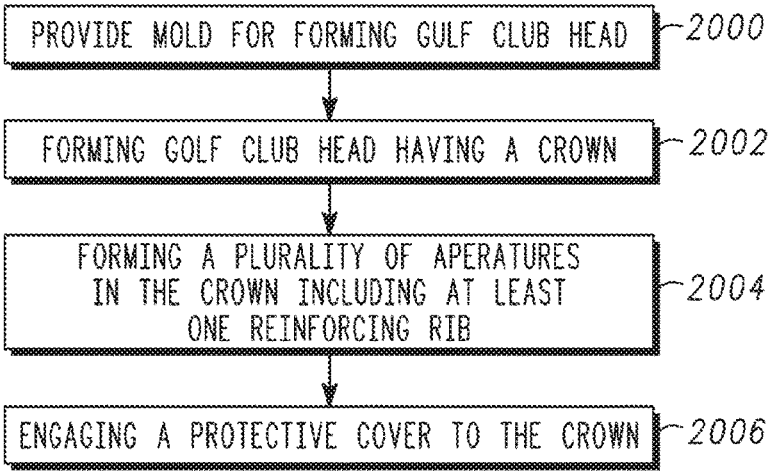
FIG. 17 is a flow chart illustrating a method of manufacturing the golf club head of FIG. 13.

Referring to FIG. 17, a flow chart illustrates one method for manufacturing a golf club head 200 with a plurality of apertures 212. At block 2000, a mold (not shown) is provided for forming the golf club head 200. At block 2002, the golf club head 200 is formed using the mold having the face 202, sole 205, heel 206, toe 210, back 211, crown 209, and hosel 208 defining the aperture 213 configured to engage the shaft. In one embodiment, the crown 209 formed by the mold is defined between the back 211 and front edge 204 of the golf club head 200. In addition, the recess 228 may be defined along the crown 209 using the mold. At block 2004, the plurality of apertures 212 is formed along the crown 109. The plurality of apertures 212 may be formed using a stamping process that forms the apertures 212 entirely through the material of the crown 209. In the alternative, a plurality of small recesses (not shown) may be formed into but not entirely through the material of the crown 209 rather than the plurality of apertures 212; however, the apparatus, articles of manufacture, and methods described herein are not limited in this regard. In one example, the reinforcing ribs 219 may be formed at block 2004 by not forming the apertures 212 on sections of the crown 209 that correspond to the locations of the reinforcing ribs 219. However, other methods for providing the reinforcing ribs 219 may be used. For example, after forming the plurality of apertures at block 2004, the reinforcing ribs 219 may be formed by attaching rib-shaped pieces to the crown 209 with an adhesive, by welding, soldering or other fixation methods.

At block 2006, the protective cover 230 may be configured to engage and cover the plurality of apertures 212 within the perimeter 224 defined along the portion of the crown 209. As discussed above, the protective cover 230 may be a film or tape made from a polycarbonate or plastic material having an adhesive on one side that permits the protective cover 230 to adhere to and cover either a portion or the entire crown 209, while in another embodiment the protective cover 230 may be rigid cover that is structurally engaged along the perimeter 224 defined by the recess 228 to cover the plurality of apertures 212. In either of these arrangements, the protective cover 230 permits the area of the second region 220 of the crown 209, for example the recess 228, to be at the same level as the first region 218 of the crown 209; however, the apparatus, articles of manufacture, and methods described herein are not limited in this regard.

Although a particular order of actions is illustrated in FIG. 17, these actions may be performed in other temporal sequences. For example, two or more actions depicted in FIG. 17 may be performed sequentially, concurrently, or simultaneously. Alternatively, two or more actions depicted may be performed in reversed order. Further, one or more actions depicted in FIG. 17 may not be performed at all. The apparatus, methods, and articles of manufacture described herein are not limited in this regard.

Referring to FIG. 18-23, another embodiment of a golf club head is illustrated and generally indicated as 300. In general, the golf club head 300 may include a face 302, a sole 305, a heel 306, and a toe 310. The golf club 300 may also include a plurality of grooves 315 on the face 302. The golf club head 300 may be a single piece or include multiple portions manufactured together. In one example, the golf club head 300 may be a hollow body formed by a casting process or other suitable type of manufacturing process. In addition, the face 302 may be an integral part of the golf club head 300. Alternatively, the face 302 may be a separate piece from or an insert for a body of the golf club head 300.

The golf club head 300 includes a hosel 308 that defines an aperture 317 configured to engage a shaft (not shown). In particular, the shaft may engage the golf club head 300 on one end and engage a grip (not shown) on an opposite end. For example, the golf club head 300 may be a wood-type golf club, such as a driver-type golf club head, a fairway wood-type golf club head (e.g., 2-wood golf club, 3-wood golf club, 4-wood golf club, 5-wood golf club, 6-wood golf club, 7-wood golf club, 8-wood golf club, or a 9-wood golf club), a hybrid-type golf club head or any other suitable type of golf club head with a hollow body or a body with one or more cavities, apertures, recesses or channels. Although the above examples may depict and/or describe a wood-type golf club head (e.g., driver-type golf club head, a fairway-type golf club head, a hybrid-type golf club head), the apparatus, articles of manufacture, and methods described herein may be applicable to other suitable types of golf club heads.

In addition, the face 302 may be formed adjacent the hosel 308 and provides a surface for striking a golf ball (not shown). The face 302 may be made from one or more metals or metal alloys such as a steel material, a titanium material, a titanium alloy material, a titanium-based material, a combination thereof, one or more composite materials, one or more plastic materials, or other suitable type of materials; however, the face 302 may be made from the same material(s) that constitute the golf club head 300 as described in greater detail below. In particular, the face 302 may include a plurality of grooves 315. The golf club head 300 further includes a back 311 formed opposite the face 302 with the sole 305 being defined between the back 311 and the face 302. As further shown, a crown 309 is formed opposite the sole 305, while the face 302 is defined by the heel 306 formed adjacent the hosel 308 and the toe 310 defined at the far end of the face 302. The face 302 further includes a top edge 304 defined between the crown 309 and the face 302 as well as a leading edge 303 defined between the sole 305 and the face 302. Although the golf club head 300 may conform to rules and/or standards of golf defined by various golf standard organizations, governing bodies, and/or rule establishing entities, the apparatus, articles of manufacture, and methods described herein are not limited in this regard.

Figure 21:
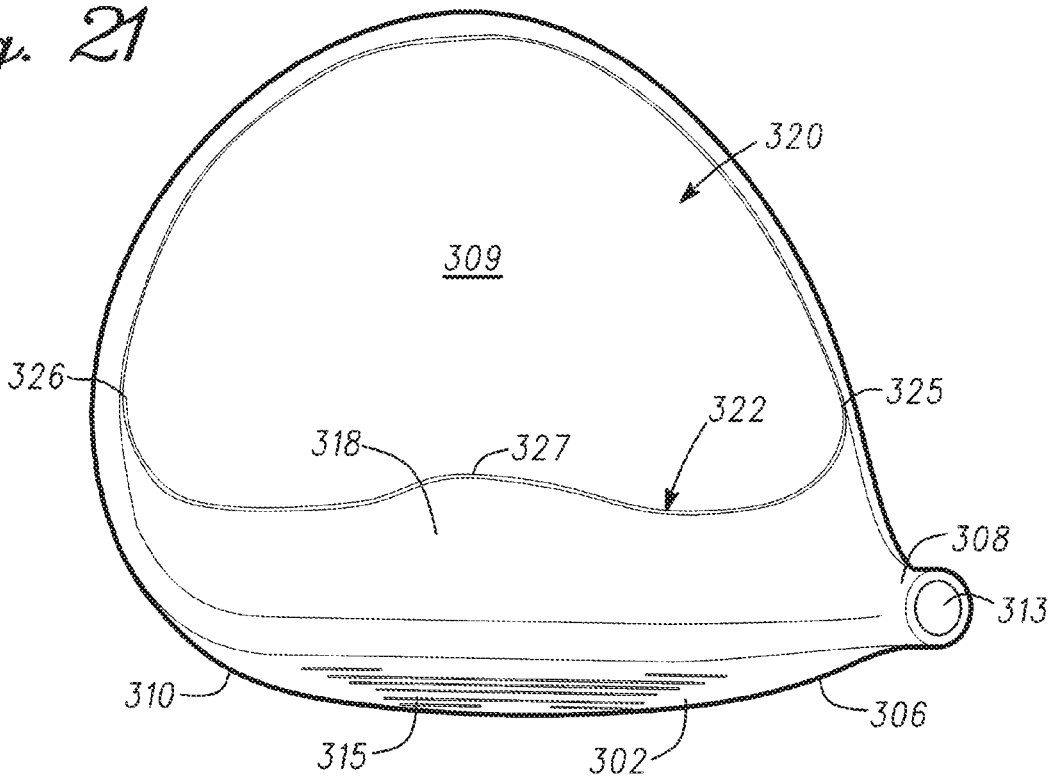
FIG. 21 is a top view of the golf club head of FIG. 18 showing the division of the golf club head into the first region and the second region by a bell-shaped curve established by the first plane.

Referring to FIG. 21, in one embodiment the crown 309 may include a first region 318 and a second region 320 with a bell-shaped curve 322 that may define the boundary between the first and second regions 318 and 320. Details of the bell-shaped curve are provided in U.S. Pat. No. 7,892,111. The first region 318 may sustain and endure relatively more stress than the second region 320 in response to an impact on the face 302 of the golf club head 300 by an object such as a golf ball (not shown). In one example, the bell-shaped curve 322 may include a first point 325, a second point 326 and a third point 327. The first point 325 may be located at or proximate the toe 310 of the golf club head 300, while the second point 326 may be located at or proximate the heel 306 of the golf club head 300. The third point 327 may be located at or proximate a midpoint defined between the first and second points 325 and 326 with the third point 327 being defined closer to the back 311 of the golf club head 300 than first and second points 325 and 326.

As shown in FIG. 21, the bell-shaped curve 322 that defines the boundary between the first and second regions 318 and 320 of the crown 309 may be determined by the relationship between a loft angle 314 of the face 302 and a first plane 316 separated by a predetermined distance D1. In one embodiment, the predetermined distance D1 may be defined as the distance between the top edge 304 of the face 302 and the first plane 316 at the location where first plane 316 intersects the crown 309. For example, the predetermined distance D1 may be greater than one inch. Alternatively, the predetermined distance D1 may be defined as the distance between the leading edge 303 of the face 302 and the location of the first plane 316 where the first plane 316 intersects the sole 305. In addition, the position of the first plane 316 may be established by the orientation or angle of the loft angle 314 of the golf club head 300. In one embodiment, the loft angle 314 may be established by the angle of the face 302 for a particular golf club head 300. For example, the loft angle 314 for a driver-type golf club head may range between 6° to 16°, while the loft angle 314 for a fairway-type golf club head may range between 12° to 30°. The loft angle 314 for a hybrid-type golf club head may range between 16° to 34°. As such, the location of the bell-shaped curve 322 along the crown 309, may be determined by the intersection of the first plane 316 with the crown 309 to establish the location of either the first and second points 325 and 326 (FIG. 21), or the third point 327 of the bell-shaped curve 132.

Figure 18:
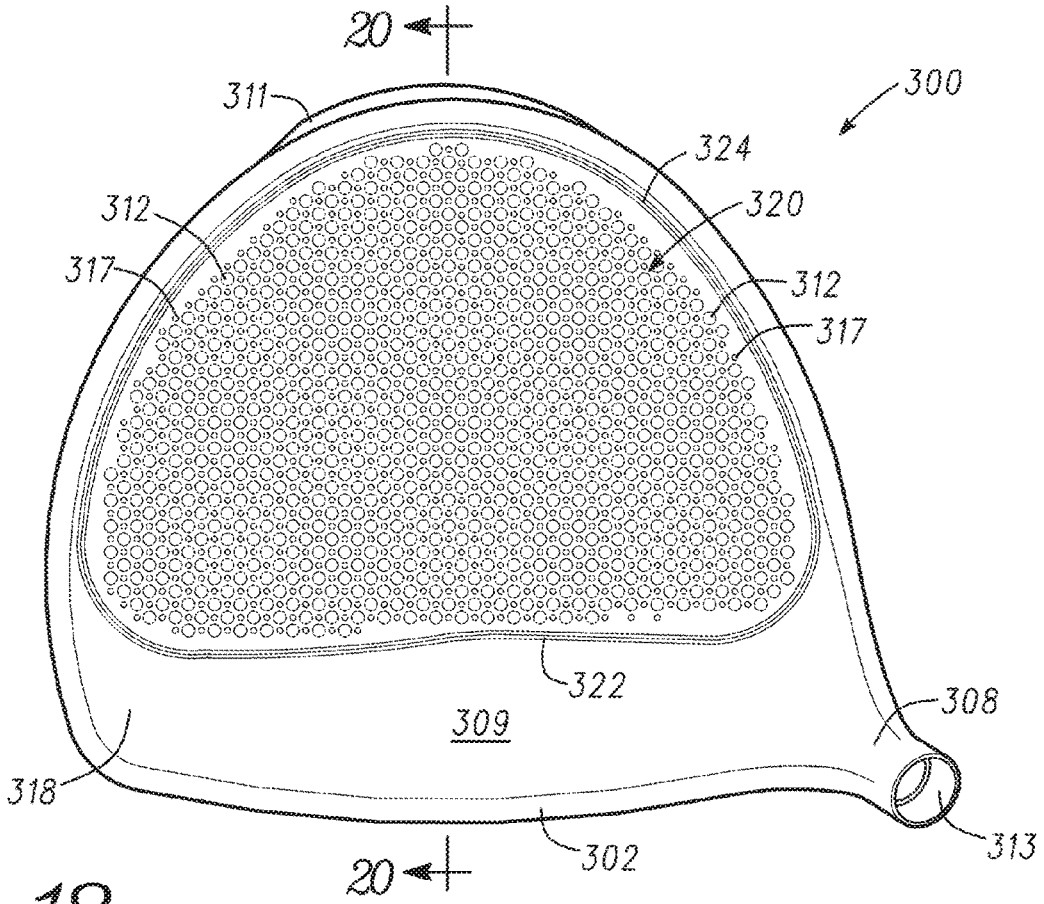
FIG. 18 is a top view of a golf club head according to another embodiment illustrating the arrangement of the plurality of apertures along the crown of the golf club head.
Figure 19:
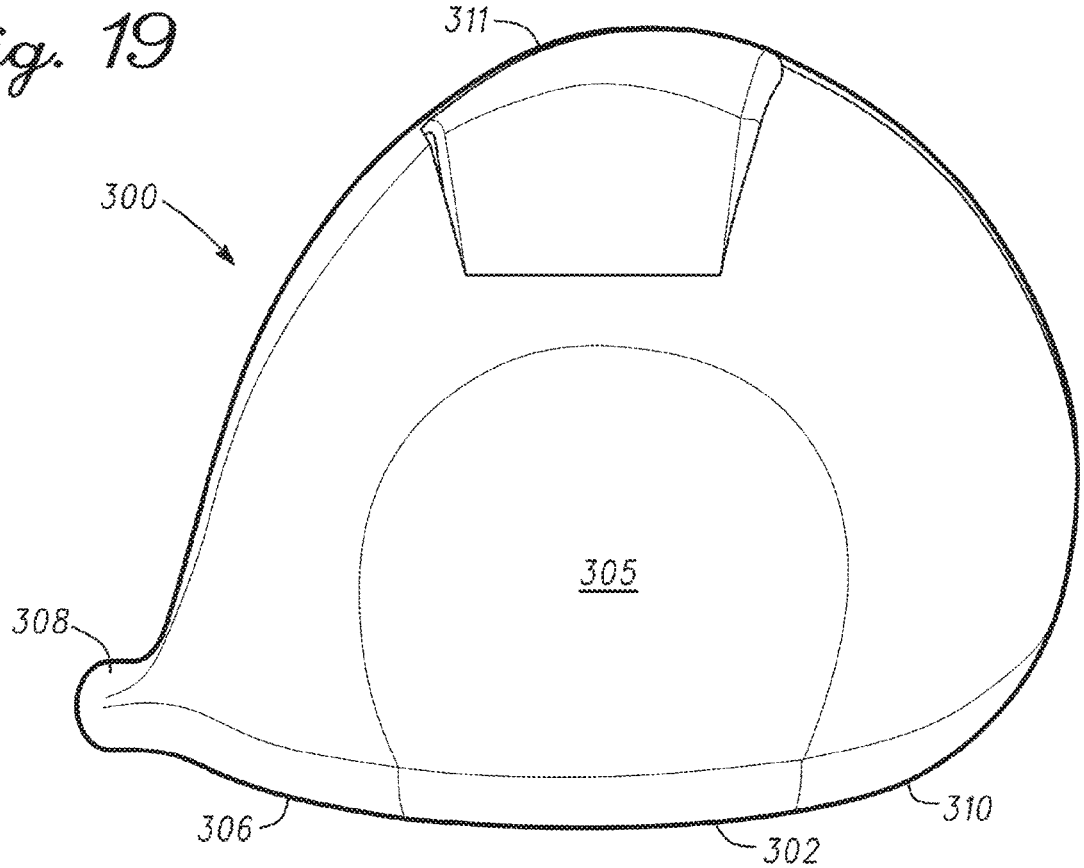
FIG. 19 is a bottom view of the golf club head of FIG. 18.
Figure 20:
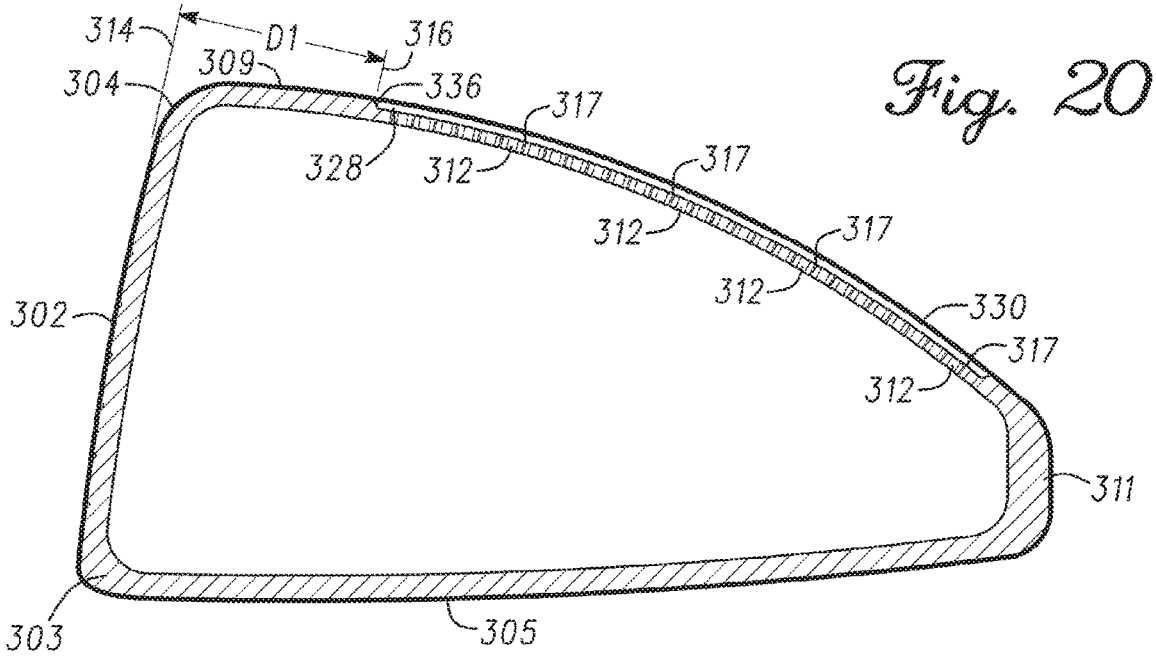
FIG. 20 is a simplified illustration of the golf club head of FIG. 18 showing a first plane and the parallel association of the first plane with a loft plane defined by a face of the golf club head for illustrating the division between a first region and a second region of the golf club head.
Figure 22:
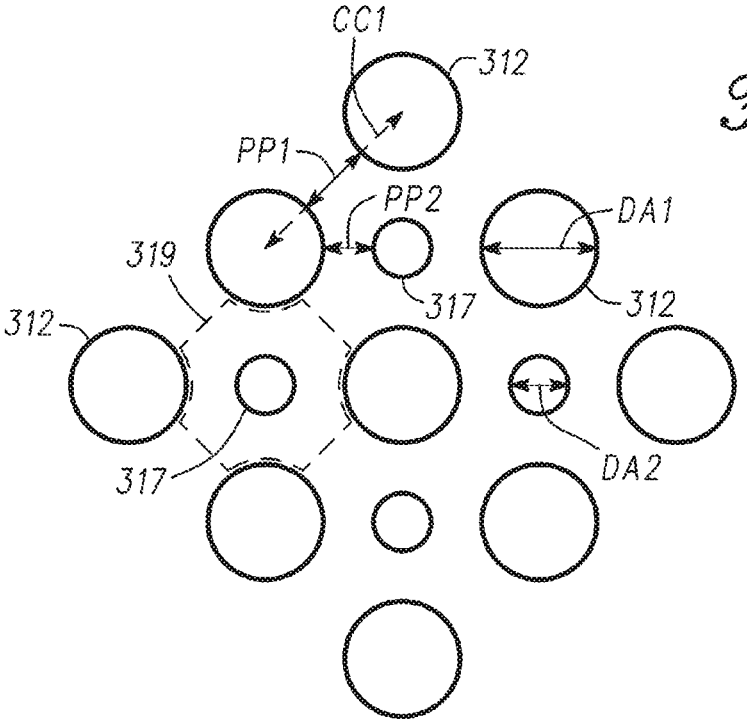
FIG. 22 is a schematic diagram of several apertures of the plurality of apertures of the golf club head of FIG. 18.

Referring to FIGS. 18 and 22, one embodiment of the golf club head 300 may further include a plurality of first apertures 312 and a plurality of second apertures 317 formed within a recess 328 defined by a perimeter 234 located in the second region 320 of the crown 309. The second apertures 317 are smaller than the first apertures 312 as described in detail below. In one example, the bell-shaped curve 322 may define a portion of the perimeter 334 that communicates with the first region 318. The recess 328 may also form a recess lip 336 defined along the perimeter 334 such that the recess 328 is positioned relatively lower on the crown 309 than the first region 318.

In one aspect, the plurality of apertures 312 and 317 located within the second region 320 of the crown 309 removes mass from one portion of the golf club head 300 and moves that mass to another more optimal location of the golf club head 300, while still providing sufficient strength and structural resilience to the golf club head 300. In addition, the plurality of apertures 312 and 317 provides a generally even distribution of forces through the crown 309 after impact of the face 302 with a golf ball (not shown) as compared to a crown 309 without having any apertures. This structural arrangement of a plurality of apertures 312 and 317 prevents impact forces on the face 302 from being focused at particular portions of the golf club head 300 during travel of these forces through the second region 320 of the crown 309, and in particular to those portions of the crown 309 defined between the plurality of apertures 312 and 317. This generally even distribution of force through the crown 309 after impact by the plurality of apertures 312 also prevents structural failure of the golf club head 300 over time that can be caused by stress risers or stress collectors focusing impact forces at particular areas of the crown 309 caused by the uneven distribution of these forces through the second region 320 after impact as discussed above.

Referring to FIG. 22, an enlarged schematic view showing the arrangement of the apertures 312 and 317 is shown. The configuration and arrangement of the apertures 312 may be similar to the apertures 112 described above. Accordingly, each aperture 312 may have a diameter DA1, be spaced apart from an adjacent aperture 312 by a perimeter-to-perimeter distance PP1, and have a center-to-center distance CC1 with an adjacent aperture 312. A group of four apertures 312 defines a center section 319 (shown with dashed lines), which may be smaller, as large as, or larger than each aperture 312. Depending on the physical properties of a club head 300 and/or the crown 309, such as materials of construction, dimensions, thicknesses, etc., additional mass may be removed from the center sections 319 without degrading the strength and structural resilience of the crown 309. The additional mass to be removed from the crown 309 may be realized by the apertures 317 in the center sections 319. The apertures 317 may be sized according to the physical properties of the club head so that the remaining portions of the center sections 319 can provide sufficient strength and structural resilience for the crown 309. Thus, the sizes, spacing, patterns, orientations, distribution and other characteristics of the apertures 312 and 317 can be determined to provide optimum or near optimum removal of mass from the crown 309 without negatively affecting the strength and structural resilience of the crown 209.

In one embodiment, a protective cover 330 may be engaged to the crown 309 to cover the plurality of apertures 312 and 317. The protective cover 330 may be constructed from any type of metallic, artificial or natural materials. For example, the protective cover 330 may be a film or tape made from a polycarbonate or polymeric material having an adhesive on one side that permits the protective cover 330 to adhere to and cover either a portion or the entire crown 309. In some embodiments, the protective cover 330 may be made from a polycarbonate material that exhibits high impact-resistance, while also having low scratch-resistance. In other embodiments, the protective cover 330 may be made from any type of polymeric material, such as polyethylene, neoprene, nylon, polystyrene, polypropylene or combinations thereof. In another embodiment the protective cover 330 may be a rigid cover made from the same material(s) discussed above that allow for structural engagement of the protective cover 330 along the perimeter 234 of the recess 328 to cover the plurality of apertures 312 and 317. In either of these arrangements, the protective cover 330 permits the area of the second region 320 of the crown 309, for example the area of the recess 328, to be at the same level as the first region 318 of the crown 309; however, the protective cover 330 does not have to provide any structural reinforcement to the crown 309 that is necessary for protective covers used with prior art golf club heads having larger apertures. The apparatus, articles of manufacture, and methods described herein are not limited in this regard.

While the above embodiments may describe a golf club head 300 including a recess (e.g., recess 328), the apparatus, articles of manufacture, and methods described herein may not include a recess. For example, the plurality of apertures 312 and 317 may be defined along the second region 320 of the crown 309 such that the second region 320 is flush with the first region 318. As such, some embodiments of the golf club head 300 do not require either a recess 328 to define an area for forming the plurality of apertures 312 and 317 and/or a protective cover 330 to encase or otherwise cover the plurality of apertures 312 and 317.

In other embodiments, each of the plurality of apertures 312 and 317 may have a range of diameters. The diameter of each aperture 312 may be between 0.005 inches to 0.40 inches (e.g., 0.0127 cm to 1.016 cm). The lower range values may be 0.005 inches (0.0127 cm), 0.006 inches (0.0152 cm), 0.007 inches (0.0178 cm), 0.008 inches (0.0303 cm), 0.009 inches (0.0329 cm), 0.01 inches (0.0254 cm), 0.02 inches (0.0508 cm), 0.03 inches (0.0762 cm), or 0.04 inches (0.1016 cm). The upper range of the diameter of the apertures 312 may be 0.32 inches (0.813 cm), 0.33 inches (0.838 cm), 0.34 inches (0.864 cm), 0.35 inches (0.889 cm), 0.36 inches (0.914 cm), 0.37 inches (0.940 cm), 0.39 inches (0.991 cm), or 0.40 inches (0.1.016 cm). In another embodiment, the diameter of each aperture 312 of the plurality of apertures 312 may be 0.093 inches (0.236 cm)

In another example, the range of the diameter of each aperture 312 may be between 0.05 inches (0.127 cm) to 0.31 inches (e.g., 0.05 inches (0.127 cm), 0.06 inches (0.152 cm), 0.07 inches (0.179 cm), 0.08 inches (0.303 cm), 0.09 inches (0.329 cm), 0.10 inches (0.254 cm), 0.11 inches (0.279 cm), 0.12 inches (0.305 cm), 0.13 inches (0.330 cm), 0.14 inches (0.356 cm), 0.15 inches (0.381 cm), 0.16 inches (0.406 cm), 0.17 inches (0.432 cm), 0.18 inches (0.457 cm), 0.19 inches (0.483 cm), 0.30 inches (0.508 cm), 0.31 inches (0.533 cm), 0.32 inches (0.559 cm), 0.33 inches (0.584 cm) 0.34 inches (0.610 cm), 0.25 inches (0.635 cm), 0.26 inches (0.660 cm), 0.27 inches (0.686 cm), 0.28 inches (0.711 cm), 0.29 inches (0.737 cm), 0.30 inches (0.762 cm), or 0.31 inches (0.787 cm)).

In yet another example, the diameter of each aperture 312 may be 0.022 inches (0.0559 cm), 0.020 inches (0.0508 cm), 0.018 inches (0.0457), or 0.016 inches (0.0406 cm), or may be 0.26 inches (0.660 cm), 0.27 inches (0.689), 0.28 inches (0.711 cm), or 0.29 inches (0.737 cm). In another embodiment, the diameter of each aperture 312 of the plurality of apertures 312 may be 0.093 inches (0.236 cm).

As described above, the apertures 317 are formed in the center sections 319, which are regions that are defined by four of the apertures 312. The size of the apertures 317 may be based upon the size of the center sections 319 and/or the size of the apertures 312. For example, the diameter of the apertures 317 may be a fraction of the diameter of the apertures 312, such as ⅔, ½, or ⅓ the diameter of the apertures 312. Accordingly, with reference to FIG. 22, the size of the apertures 312 and 317 may be based on the following formula:

$$DA2 = F \cdot DA1$$

Where DA2 is the diameter of the apertures 317, DA1 is the diameter of the apertures 312 and F is a factor that defines the relationship between the diameters DA2 and DA1. For example, F can have any value from 0.001 to approximately 1. However, F=1 would result in the apertures 312 and 317 having the same diameter, which is similar to the embodiment of FIGS. 1-12. In another example, with reference to FIG. 22, the size of the apertures 317 may be determined so that the perimeter-to-perimeter distance PP1 between an aperture 312 and an adjacent aperture 317 is the same as the perimeter-to-perimeter distance PP1 between two adjacent apertures 312. Thus, the size of the apertures 312 and 317 may be determined in any manner or based on any mathematical relationship so that mass is removed from the crown 309 without negatively affecting the performance, the strength and the structural resilience of the club head 300 and/or optimizing or near optimizing the performance of the club head 300.

Although some of the above examples may describe all of the plurality of apertures 312 having an identical diameter or a substantially similar diameter, and/or the plurality of apertures 317 having an identical diameter or substantially similar diameter, the apparatus, articles of manufacture, and methods are not limited in this regard, For example, two or more apertures of the plurality of apertures 312 may have different diameters (e.g., the diameters of the plurality of apertures 312 may vary from one aperture to another). In another example, two or more apertures of the plurality of apertures 317 may have different diameters (e.g., the diameters of the apertures 317 may vary from one aperture to another).

In one embodiment, each aperture 312 may have a diameter no greater than 0.30 inches (0.762 cm). In another embodiment, each aperture 312 may have a diameter no greater than 0.25 inches (0.635 cm). In other embodiments, the plurality of apertures 312 may have diameters no greater than 0.20 inches (0.508 cm), while other embodiments, each of the plurality of apertures 312 may have diameters no greater than 0.175 inches (0.444 cm), 0.150 inches (0.381 cm), 0.125 inches (0.312 cm), 0.100 inches (0.254), 0.093 inches (0.236 cm), 0.075 (0.191 cm), or 0.050 (0.127 cm), respectively. Because the apertures 312 defined the size of the center section 319, the size of the apertures 317 depends on the size of the apertures 312 as described in detail above.

The number of apertures 312 defined along the second region 320 of the crown 309 depends on the diameter of the plurality of apertures 312. For example, a golf club head 300 having an aperture diameter of 0.25 inches (0.635 cm) may have about 60 apertures, while a golf club head 300 having an aperture diameter of 0.093 inches (0.236 cm) may have about 576 apertures. In another example, a golf club head 300 having a combination of aperture diameters of 0.093 inches (0.236 cm) and 0.040 inches (0.102 cm) may have about 1500 apertures; however, the apparatus, articles of manufacture, and methods described herein are not limited in this regard. In particular, the number and/or size of the plurality of apertures 312 may vary based on the volume of the golf club head 300 (e.g., a golf club head less than or equal to 470 cc). Referring to FIG. 22, each aperture 317 is surrounded by four apertures 312, or each aperture 312 is surrounded by four apertures 317. Accordingly, the number of apertures 312 and 317 may be slightly less or more than the number of apertures 312.

The plurality of apertures 312 and 317 may also define different configurations and sizes. For example, the plurality of apertures 312 may have a round-shaped configuration, an oval-shaped configuration, a diamond-shaped configuration, a square-shaped configuration, a rectangular-shaped configuration, a hexagon-shaped configuration, a pentagon-shaped configuration, a linear-shaped configuration, and/or a non-linear-shaped configuration. Accordingly, the shape of the apertures 317 may be similar to the shape of the apertures 312. However, the shape of the apertures 317 may be different than the shape of the apertures 312. In addition, the plurality of apertures 312 and 317 may have different diameters or configurations within a particular pattern. Finally, the pattern of the apertures 312 and 317 within the second region 320 may define a repeating pattern, non-repeating pattern, symmetrical pattern and/or non-symmetrical pattern; however, the apparatus, articles of manufacture, and methods described herein are not limited in this regard. Further, while the above examples may describe the plurality of apertures 312 and 317 being located on the crown 309 of the golf club head 300; the plurality of apertures 312 and/or 317 may be located on other portion(s) of a golf club head (e.g., the sole only, the crown and the sole, etc).

In one embodiment, the golf club head 300 may be made from steel, steel alloy, titanium, titanium alloy (e.g., titanium 6-4 or titanium 8-1-1). In other embodiments, the golf club head 300 may be made from one or more materials including titanium, titanium alloys, magnesium, magnesium alloys, titanium aluminides, fiber-based composites, and metal matrix composites or mixtures thereof. In some embodiments, the fiber-based composite may be carbon fiber, fiberglass, or KEVLAR® or combinations thereof. In some embodiments, the percentage of titanium may be 10%, 20%, 30%, 40%, 50%, 60%, 70%, 80%, 90%, or 99% for titanium alloys and 100% for a golf club head 300 made entirely of 100% titanium. In other embodiments, the percentage of fiberglass may be 10%, 20%, 30%, 40%, 50%, 60%, 70%, 80%, 90%, or 100% . In yet other embodiments, the percentage of KEVLAR® may be 10%, 20%, 30%, 40%, 50%, 60%, 70%, 80%, 90%, or 100%. In some embodiments, the KEVLAR® may be any type of para-aramid synthetic fiber. In some embodiments the percentage of carbon fiber may be 10%, 20%, 30%, 40%, 50%, 60%, 70%, 80%, 90%, or 100%. In some embodiments, a golf club head according to the disclosure may be 50% titanium and 50% of one or more of the fiber-based composite(s), although in other embodiments a golf club head according to the disclosure may constitute any of the percentages for titanium noted above in combination with one or more respective percentages of the fiber-based composite(s).

Figure 23:
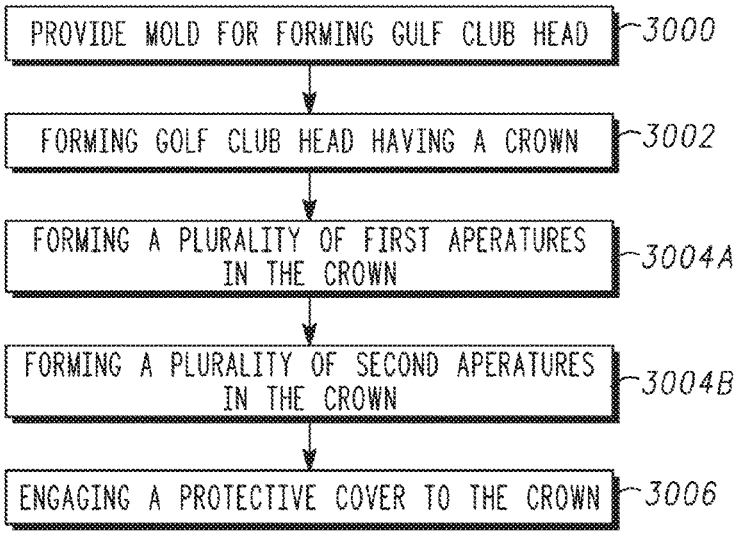
FIG. 23 is a flow chart illustrating a method of manufacturing the golf club head of FIG. 18.

Referring to FIG. 23, a flow chart illustrates one method for manufacturing a golf club head 300 with a plurality of apertures 312 and 317. At block 3000, a mold (not shown) is provided for forming the golf club head 300. At block 3002, the golf club head 300 is formed using the mold having the face 302, sole 305, heel 306, toe 310, back 311, crown 309, and hosel 308 defining the aperture 313 configured to engage the shaft. In one embodiment, the crown 309 formed by the mold is defined between the back 311 and front edge 304 of the golf club head 300. In addition, the recess 328 may be defined along the crown 309 using the mold. At blocks 3004A and 3004B, the plurality of apertures 312 and 317, respectively, are formed along the crown 309. The plurality of apertures 312 may be formed using a stamping process that forms the apertures 312 entirely through the material of the crown 309. In the alternative, a plurality of recesses (not shown) may be formed into but not entirely through the material of the crown 109 rather than the plurality of apertures 312; however, the apparatus, articles of manufacture, and methods described herein are not limited in this regard. The plurality of apertures 312 and 317 may be formed simultaneously by the same stamping process. In other words, the stamping mold includes projections corresponding to the apertures 312 and 317 so that both apertures 312 and 317 can be made in one step. Therefore, the blocks 3004A and 3004B may represent a single process. However, the apertures 312 and 317 may be formed separately. For example, at block 3004A, the apertures 312 may be formed with one stamping process using a mold, while at block 3004B, the apertures 317 are formed with another stamping process using a different mold.

At block 3006, the protective cover 330 may be configured to engage and cover the plurality of apertures 312 and 317 within the perimeter 324 defined along the portion of the crown 309. As discussed above, the protective cover 330 may be a film or tape made from a polycarbonate or plastic material having an adhesive on one side that permits the protective cover 330 to adhere to and cover either a portion or the entire crown 309, while in another embodiment the protective cover 330 may be rigid cover that is structurally engaged along the perimeter 324 defined by the recess 328 to cover the plurality of apertures 312 and 317. In either of these arrangements, the protective cover 330 permits the area of the second region 320 of the crown 309, for example the recess 328, to be at the same level as the first region 318 of the crown 309; however, the apparatus, articles of manufacture, and methods described herein are not limited in this regard.

Although a particular order of actions is illustrated in FIG. 23, these actions may be performed in other temporal sequences. For example, two or more actions depicted in FIG. 23 may be performed sequentially, concurrently, or simultaneously. Alternatively, two or more actions depicted may be performed in reversed order. Further, one or more actions depicted in FIG. 23 may not be performed at all. The apparatus, methods, and articles of manufacture described herein are not limited in this regard.

Referring to FIG. 24-28, another embodiment of a golf club head is illustrated and generally indicated as 400. In general, the golf club head 400 may include a face 402, a sole 405, a heel 406, and a toe 410. The golf club 400 may also include a plurality of grooves 415 on the face 402. The golf club head 400 may be a single piece or include multiple portions manufactured together. In one example, the golf club head 400 may be a hollow body formed by a casting process or other suitable type of manufacturing process. In addition, the face 402 may be an integral part of the golf club head 400. Alternatively, the face 402 may be a separate piece from or an insert for a body of the golf club head 400.

The golf club head 400 includes a hosel 408 that defines an aperture 413 configured to engage a shaft (not shown). In particular, the shaft may engage the golf club head 400 on one end and engage a grip (not shown) on an opposite end. For example, the golf club head 400 may be a wood-type golf club, such as a driver-type golf club head, a fairway wood-type golf club head (e.g., 2-wood golf club, 3-wood golf club, 4-wood golf club, 5-wood golf club, 6-wood golf club, 7-wood golf club, 8-wood golf club, or a 9-wood golf club), a hybrid-type golf club head or any other suitable type of golf club head with a hollow body or a body with one or more cavities, apertures, recesses or channels. Although the above examples may depict and/or describe a wood-type golf club head (e.g., driver-type golf club head, a fairway-type golf club head, a hybrid-type golf club head), the apparatus, articles of manufacture, and methods described herein may be applicable to other suitable types of golf club heads.

In addition, the face 402 may be formed adjacent the hosel 408 and provides a surface for striking a golf ball (not shown). The face 402 may be made from one or more metals or metal alloys such as a steel material, a titanium material, a titanium alloy material, a titanium-based material, a combination thereof, one or more composite materials, one or more plastic materials, or other suitable type of materials; however, the face 402 may be made from the same material(s) that constitute the golf club head 400 as described in greater detail below. In particular, the face 402 may include a plurality of grooves 415. The golf club head 400 further includes a back 411 formed opposite the face 402 with the sole 405 being defined between the back 411 and the face 402. As further shown, a crown 409 is formed opposite the sole 405, while the face 402 is defined by the heel 406 formed adjacent the hosel 408 and the toe 410 defined at the far end of the face 402. The face 402 further includes a top edge 404 defined between the crown 409 and the face 402 as well as a leading edge 403 defined between the sole 405 and the face 402. Although the golf club head 400 may conform to rules and/or standards of golf defined by various golf standard organizations, governing bodies, and/or rule establishing entities, the apparatus, articles of manufacture, and methods described herein are not limited in this regard.

Referring to FIG. 27, in one embodiment the crown 409 may include a first region 418 and a second region 420 with a bell-shaped curve 422 that may define the boundary between the first and second regions 418 and 440. Details of the bell-shaped curve are provided in U.S. Pat. No. 7,892,111. The first region 418 may sustain and endure relatively more stress than the second region 420 in response to an impact on the face 402 of the golf club head 400 by an object such as a golf ball (not shown). In one example, the bell-shaped curve 422 may include a first point 425, a second point 426 and a third point 427. The first point 425 may be located at or proximate the toe 410 of the golf club head 400, while the second point 426 may be located at or proximate the heel 406 of the golf club head 400. The third point 427 may be located at or proximate a midpoint defined between the first and second points 425 and 426 with the third point 427 being defined closer to the back 411 of the golf club head 400 than first and second points 425 and 426.

As shown in FIG. 27, the bell-shaped curve 422 that defines the boundary between the first and second regions 418 and 440 of the crown 409 may be determined by the relationship between a loft angle 414 of the face 402 and a first plane 416 separated by a predetermined distance D1. In one embodiment, the predetermined distance D1 may be defined as the distance between the top edge 404 of the face 402 and the first plane 416 at the location where first plane 416 intersects the crown 409. For example, the predetermined distance D1 may be greater than one inch. Alternatively, the predetermined distance D1 may be defined as the distance between the leading edge 403 of the face 402 and the location of the first plane 416 where the first plane 416 intersects the sole 405. In addition, the position of the first plane 416 may be established by the orientation or angle of the loft angle 414 of the golf club head 400. In one embodiment, the loft angle 414 may be established by the angle of the face 102 for a particular golf club head 400. For example, the loft angle 414 for a driver-type golf club head may range between 6° to 16°, while the loft angle 414 for a fairway-type golf club head may range between 12° to 30°. The loft angle 414 for a hybrid-type golf club head may range between 16° to 34°. As such, the location of the bell-shaped curve 422 along the crown 409, may be determined by the intersection of the first plane 416 with the crown 409 to establish the location of either the first and second points 425 and 426 (FIG. 27), or the third point 427 of the bell-shaped curve 142.

Figure 24:
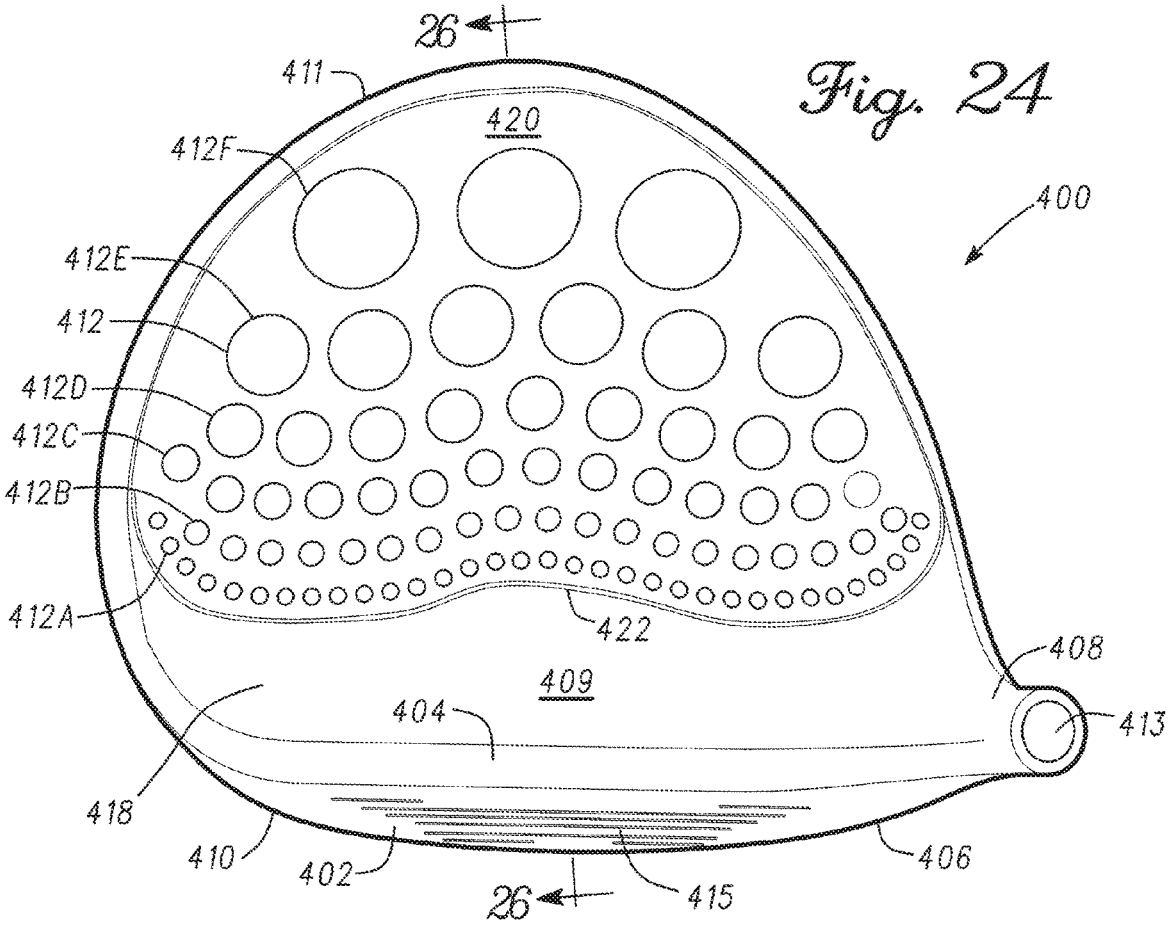
FIG. 24 is a top view of a golf club head according to another embodiment illustrating the arrangement of the plurality of apertures along the crown of the golf club head.
Figure 25:
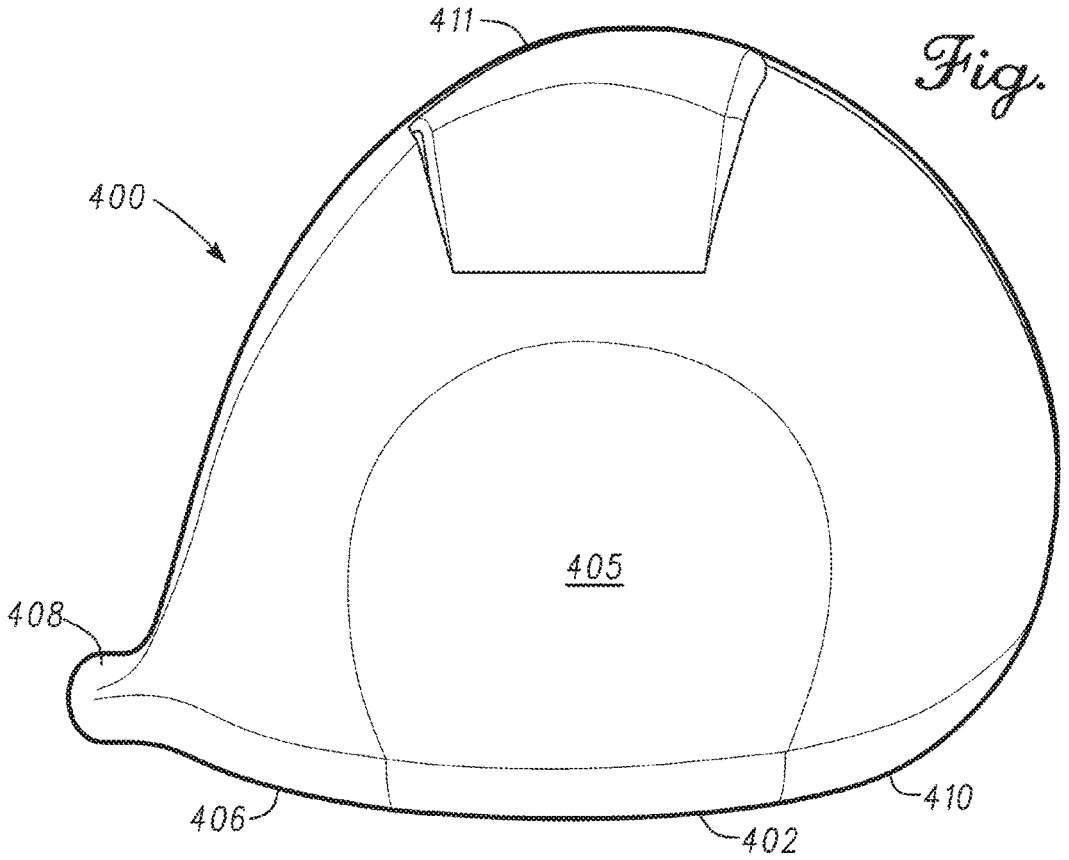
FIG. 25 is a bottom view of the golf club head of FIG. 24.
Figure 26:
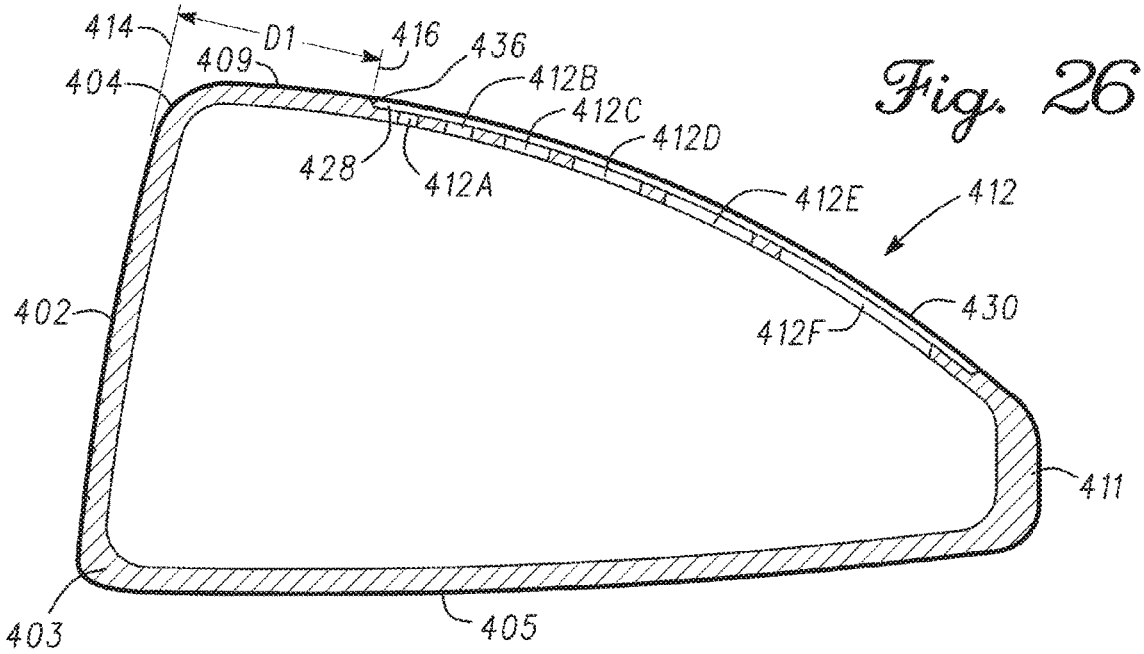
FIG. 26 is a simplified illustration of the golf club head of FIG. 24 showing a first plane and the parallel association of the first plane with a loft plane defined by a face of the golf club head for illustrating the division between a first region and a second region of the golf club head.

Referring to FIG. 24, one embodiment of the golf club head 400 may further include a plurality apertures 412A-F formed within a recess 428 defined by a perimeter 424 located in the second region 420 of the crown 409. The plurality of apertures 412A-F represent one example of apertures on the crown 409. Accordingly, reference number 412 may be used herein to generally refer to the apertures 412A-F. In one example, the bell-shaped curve 422 may define a portion of the perimeter 424 that communicates with the first region 418. The recess 428 may also form a recess lip 436 defined along the perimeter 424 such that the recess 428 is positioned relatively lower on the crown 409 than the first region 418.

In one aspect, the plurality of apertures 412A-F removes mass from one portion of the golf club head 400 and moves that mass to another more optimal location of the golf club head 400, while still providing sufficient strength and structural resilience to the golf club head 400. In addition, the plurality of apertures 412A-F provides a generally more even distribution of forces through the crown 409 after impact of the face 402 with a golf ball (not shown) as compared to a crown 409 without having any apertures. This structural arrangement of a plurality of apertures 412A-F prevents impact forces on the face 402 from being focused at particular portions of the golf club head 400 during travel of these forces through the second region 420 of the crown 409, and in particular to those portions of the crown 409 defined between the plurality of apertures 412A-F. This generally more even distribution of force through the crown 409 after impact by the plurality of apertures 412A-F also prevents structural failure of the golf club head 400 over time that can be caused by stress risers or stress collectors focusing impact forces at particular areas of the crown 409 caused by the uneven distribution of these forces through the second region 420 after impact as discussed above.

The apertures 412A-F progressively increase in size from near the bell-shaped curve 422 to the back 411 of the golf club head 400. As shown in FIG. 24, the apertures 412A are the closest apertures to the bell-shaped curve 422 and are the smallest of the apertures 412A-F. The apertures 412B are slightly larger. Similarly, the apertures 412C-E increase in diameter until apertures 412F near the back 411 of the golf club head 400. As discussed in detail herein, the impact forces near the face 402 are transferred by the crown 409 from the face 402 toward the back 411 of the golf club head 400. Accordingly, the impact forces dissipate through the crown, and therefore, the impact forces are higher near the face 402 and progressively decrease in a direction toward the back 411 of the golf club head 400. The progressive variation in the size of the apertures 412A-F may be configured to correspond with the progressive decrease in the impact forces traversing through the crown 409 from the face 402 to the back 411 of the golf club head 400. Therefore, a near optimum amount of mass may be removed from the crown 409 in a progressive manner from the bell-shaped curve 422 to the back 411 without compromising the strength and structural resilience of the golf club head 400.

In one embodiment, a protective cover 430 may be engaged to the crown 409 to cover the plurality of apertures 412A-F. The protective cover 430 may be constructed from any type of metallic, artificial or natural materials. For example, the protective cover 430 may be a film or tape made from a polycarbonate or polymeric material having an adhesive on one side that permits the protective cover 430 to adhere to and cover either a portion or the entire crown 409. In some embodiments, the protective cover 430 may be made from a polycarbonate material that exhibits high impact-resistance, while also having low scratch-resistance. In other embodiments, the protective cover 430 may be made from any type of polymeric material, such as polyethylene, neoprene, nylon, polystyrene, polypropylene or combinations thereof. In another embodiment the protective cover 430 may be a rigid cover made from the same material(s) discussed above that allow for structural engagement of the protective cover 430 along the perimeter 424 of the recess 428 to cover the plurality of apertures 412. In either of these arrangements, the protective cover 430 permits the area of the second region 420 of the crown 409, for example the area of the recess 428, to be at the same level as the first region 418 of the crown 409; however, the protective cover 430 does not have to provide any structural reinforcement to the crown 409 that is necessary for protective covers used with prior art golf club heads having larger apertures. The apparatus, articles of manufacture, and methods described herein are not limited in this regard.

While the above embodiments may describe a golf club head 400 including a recess (e.g., recess 428), the apparatus, articles of manufacture, and methods described herein may not include a recess. For example, the plurality of apertures 412A-F may be defined along the second region 420 of the crown 409 such that the second region 420 is flush with the first region 418. As such, some embodiments of the golf club head 400 do not require either a recess 428 to define an area for forming the plurality of apertures 412A-F and/or a protective cover 430 to encase or otherwise cover the plurality of apertures 412A-F.

In other embodiments, the plurality of apertures 412A-F may have a range of diameters. The diameter of each aperture 412A-F may be between 0.005 inches to 0.40 inches (e.g., 0.0127 cm to 1.016 cm). The lower range values may be 0.005 inches (0.0127 cm), 0.006 inches (0.0152 cm), 0.007 inches (0.0178 cm), 0.008 inches (0.0403 cm), 0.009 inches (0.0429 cm), 0.01 inches (0.0254 cm), 0.02 inches (0.0508 cm), 0.03 inches (0.0762 cm), or 0.04 inches (0.1016 cm). The upper range of the diameter of the apertures 412A-F may be 0.32 inches (0.813 cm), 0.33 inches (0.838 cm), 0.34 inches (0.864 cm), 0.35 inches (0.889 cm), 0.36 inches (0.914 cm), 0.37 inches (0.940 cm), 0.39 inches (0.991 cm), or 0.40 inches (0.1.016 cm).

In another example, the range of the diameter of each aperture 412A-F may be between 0.05 inches (0.127 cm) to 0.31 inches (e.g., 0.05 inches (0.127 cm), 0.06 inches (0.152 cm), 0.07 inches (0.179 cm), 0.08 inches (0.403 cm), 0.09 inches (0.429 cm), 0.10 inches (0.254 cm), 0.11 inches (0.279 cm), 0.12 inches (0.305 cm), 0.13 inches (0.330 cm), 0.14 inches (0.356 cm), 0.15 inches (0.381 cm), 0.16 inches (0.406 cm), 0.17 inches (0.432 cm), 0.18 inches (0.457 cm), 0.19 inches (0.483 cm), 0.40 inches (0.508 cm), 0.41 inches (0.533 cm), 0.42 inches (0.559 cm), 0.43 inches (0.584 cm) 0.24 inches (0.610 cm), 0.25 inches (0.635 cm), 0.26 inches (0.660 cm), 0.27 inches (0.686 cm), 0.28 inches (0.711 cm), 0.29 inches (0.737 cm), 0.30 inches (0.762 cm), or 0.31 inches (0.787 cm)).

In yet another example, the diameter of each aperture 412A-F may be 0.022 inches (0.0559 cm), 0.020 inches (0.0508 cm), 0.018 inches (0.0457), or 0.016 inches (0.0406 cm), or may be 0.26 inches (0.660 cm), 0.27 inches (0.689), 0.28 inches (0.711 cm), or 0.29 inches (0.737 cm). In another embodiment, the diameter of each aperture 412A-F may be 0.093 inches (0.236 cm). The number of apertures 412A-F defined along the second region 420 of the crown 409 depends on the diameters of the apertures 412A-F. The number and/or size of the plurality of apertures 412A-F may vary based on the volume of the golf club head 400 (e.g., a golf club head less than or equal to 470 cc).

In the above, exemplary sizes for the apertures 412A-F are provided. Because the apertures 412A-F progressively increase in size, the smallest aperture 412A may fall within the smaller of the above-described aperture sizes and the largest aperture 412F may fall within the larger of the above-described aperture sizes, with the sizes of the apertures 412B-E falling in between the sizes of the apertures 412A and 412F.

The plurality of apertures 412A-F may also define different configurations and sizes. For example, the plurality of apertures 412A-F may have a round-shaped configuration, an oval-shaped configuration, a diamond-shaped configuration, a square-shaped configuration, a rectangular-shaped configuration, a hexagon-shaped configuration, a pentagon-shaped configuration, a linear-shaped configuration, and/or a non-linear-shaped configuration. In addition, each row of apertures 412A, 412B, 412C, 412D, 412E and 412F may have a different shape than the apertures of an adjacent row. Furthermore, the apertures in each row of apertures 412A-F may have different shapes and/or sizes than adjacent apertures in the same row. The pattern of the apertures 412A-F within the second region 120 may define a repeating pattern, non-repeating pattern, symmetrical pattern and/or non-symmetrical pattern; however, the apparatus, articles of manufacture, and methods described herein are not limited in this regard. Further, while the above examples may describe the plurality of apertures 412A-F being located on the crown 409 of the golf club head 400, the plurality of apertures 412 may be located on other portion(s) of a golf club head (e.g., the sole only, the crown and the sole, etc). The exemplary apertures 412A-F define six rows of progressively enlarging apertures. However, more or less rows, columns, or diagonally oriented apertures can be provided on the crown 409 that progressive increase and/or change in configuration.

In one embodiment, the golf club head 400 may be made from steel, steel alloy, titanium, titanium alloy (e.g., titanium 6-4 or titanium 8-1-1). In other embodiments, the golf club head 400 may be made from one or more materials including titanium, titanium alloys, magnesium, magnesium alloys, titanium aluminides, fiber-based composites, and metal matrix composites or mixtures thereof. In some embodiments, the fiber-based composite may be carbon fiber, fiberglass, or KEVLAR® or combinations thereof. In some embodiments, the percentage of titanium may be 10%, 20%, 30%, 40%, 50%, 60%, 70%, 80%, 90%, or 99% for titanium alloys and 100% for a golf club head 400 made entirely of 100% titanium. In other embodiments, the percentage of fiberglass may be 10%, 20%, 30%, 40%, 50%, 60%, 70%, 80%, 90%, or 100% . In yet other embodiments, the percentage of KEVLAR® may be 10%, 20%, 30%, 40%, 50%, 60%, 70%, 80%, 90%, or 100%. In some embodiments, the KEVLAR® may be any type of para-aramid synthetic fiber. In some embodiments the percentage of carbon fiber may be 10%, 20%, 30%, 40%, 50%, 60%, 70%, 80%, 90%, or 100%. In some embodiments, a golf club head according to the disclosure may be 50% titanium and 50% of one or more of the fiber-based composite(s), although in other embodiments a golf club head according to the disclosure may constitute any of the percentages for titanium noted above in combination with one or more respective percentages of the fiber-based composite(s).

Referring to FIG. 28, a flow chart illustrates one method for manufacturing a golf club head 400 with a plurality of apertures 412A-F. At block 4000, a mold (not shown) is provided for forming the golf club head 400. At block 4002, the golf club head 400 is formed using the mold having the face 402, sole 405, heel 406, toe 410, back 411, crown 409, and hosel 408 defining the aperture 413 configured to engage the shaft. In one embodiment, the crown 409 formed by the mold is defined between the back 411 and front edge 404 of the golf club head 400. In addition, the recess 428 may be defined along the crown 409 using the mold. At block 4004A, the apertures 412A are formed along the crown 409. At block 4004B, the apertures 412B are formed along the crown 409. The process for forming the apertures 412C-E similarly continues until at block 4004F, the apertures 412F are formed along the crown 409. According to the example described above, the plurality of apertures 412A-F may be formed using a stamping process that forms the apertures 412 entirely through the material of the crown 409. In the alternative, a plurality of recesses (not shown) may be formed into but not entirely through the material of the crown 409 rather than the plurality of apertures 412A-F; however, the apparatus, articles of manufacture, and methods described herein are not limited in this regard. The plurality of apertures 412A-F may be formed simultaneously on the crown 409. For example, the stamping mold may include projections corresponding to all of the apertures 412A-F so that the apertures 412A-F can be formed with a single stamping process. However, any of the rows of apertures 412A, 412B, 412C, 412D, 412E or 412F may be formed on the crown 409 by a separate stamping mold and/or process. For example, the apertures 412A may be formed by a first stamping mold in a first stamping process, the apertures 412B may be formed by a second stamping mold in a second stamping process, the apertures 412C may be formed by a third stamping mold in a third stamping process, the apertures 412D may be formed by a fourth stamping mold in a fourth stamping process, the apertures 412E may be formed by a fifth stamping mold in a fifth stamping process, and the apertures 412F may be formed by a sixth stamping mold in a sixth stamping process. Thus, the apertures 412A-F may be formed in a single process or multiple processes.

At block 4006, the protective cover 430 may be configured to engage and cover the plurality of apertures 412 within the perimeter 424 defined along the portion of the crown 409. As discussed above, the protective cover 430 may be a film or tape made from a polycarbonate or plastic material having an adhesive on one side that permits the protective cover 430 to adhere to and cover either a portion or the entire crown 409, while in another embodiment the protective cover 430 may be rigid cover that is structurally engaged along the perimeter 424 defined by the recess 428 to cover the plurality of apertures 412. In either of these arrangements, the protective cover 430 permits the area of the second region 420 of the crown 409, for example the recess 428, to be at the same level as the first region 418 of the crown 409; however, the apparatus, articles of manufacture, and methods described herein are not limited in this regard.

Although a particular order of actions is illustrated in FIG. 28, these actions may be performed in other temporal sequences. For example, two or more actions depicted in FIG. 28 may be performed sequentially, concurrently, or simultaneously. Alternatively, two or more actions depicted may be performed in reversed order. Further, one or more actions depicted in FIG. 28 may not be performed at all. The apparatus, methods, and articles of manufacture described herein are not limited in this regard.

Figure 29:
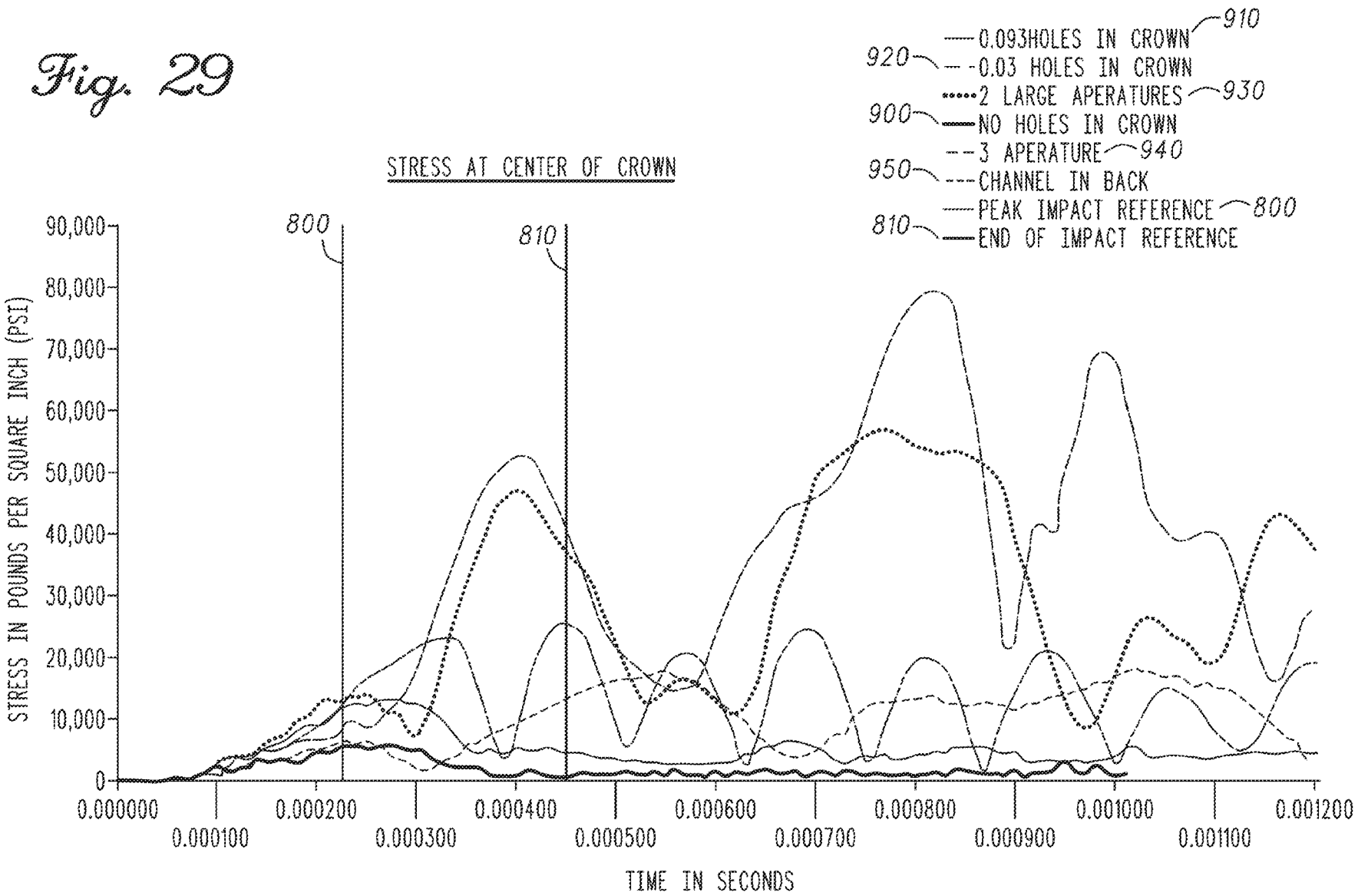
FIG. 29 is a graph illustrating stress profiles of golf club heads according to several embodiments.
Figure 30:
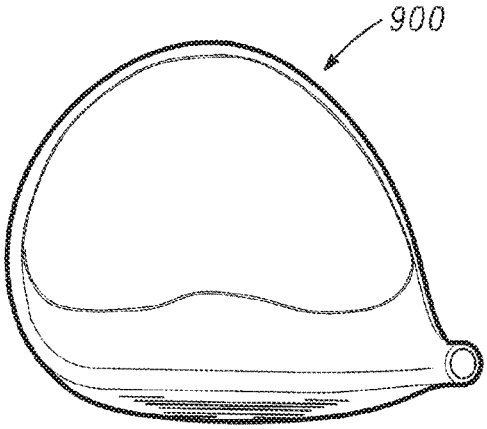
FIGS. 30-35 are several embodiments of golf club heads used for the stress profiles illustrated in FIG. 29.

Referring to FIG. 29, a graph is shown illustrating the results of tests that were conducted on six different golf club heads to determine the stress characteristics generated by each respective golf club head after impact of a golf ball against the face of each golf club head. The tests were performed by measuring the amount of stress generated at the center of the crown over time for each golf club head. All of the golf club heads used in the tests were made from the same titanium alloy with the only difference being the size and arrangement of apertures in the crown with the exception of the reference golf club head having a solid crown. The graph includes a time line to illustrate the level of stress values generated at the center of the crown over time during and after impact of the golf ball. In addition, the time line includes a first vertical reference line 800 representing the time of peak impact as the golf ball is in contact with the face and a second reference line 810 representing the end of the golf ball's contact with the face of the golf club head. Accordingly, the time period between the two reference lines 800 and 810 represent the time the golf ball is in actual contact with the face of the golf ball head during impact.

Figure 31:
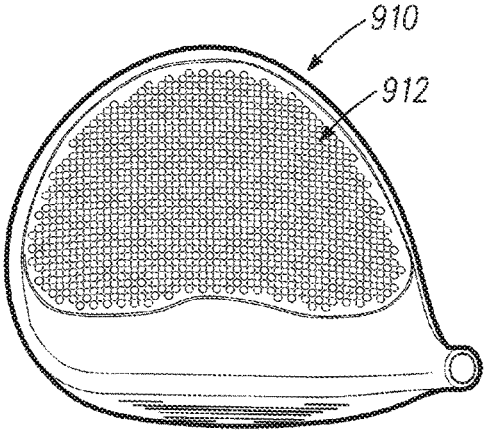
Figure 32:
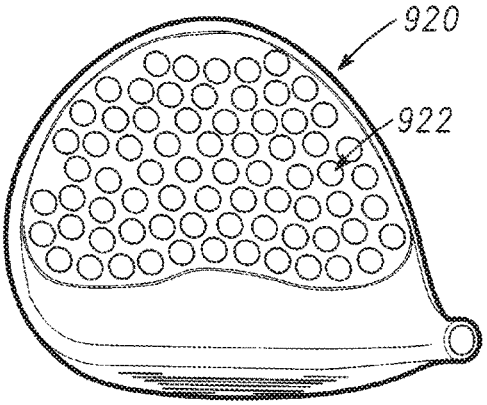
Figure 33:
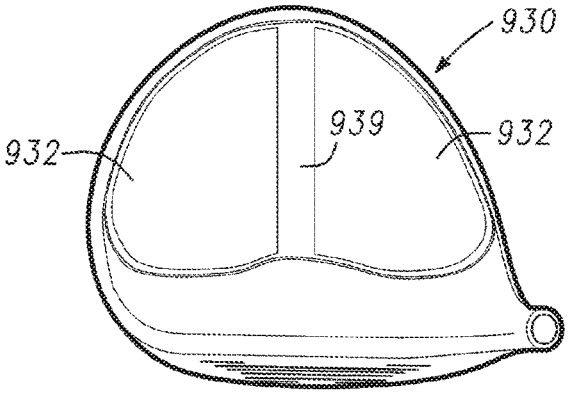
Figure 34:
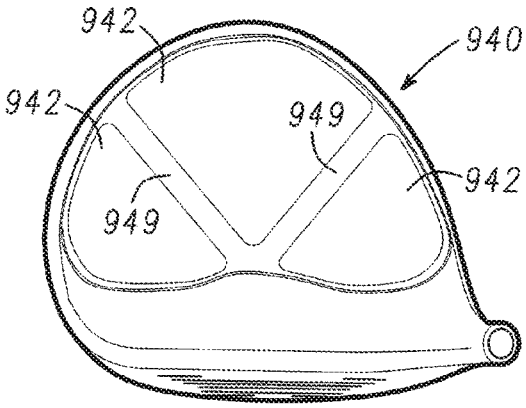
Figure 35:
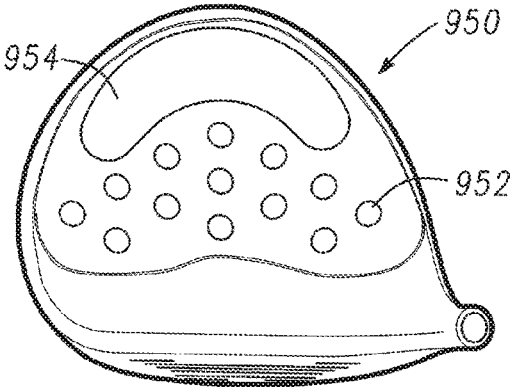

FIGS. 30-35 show the club heads 900, 910, 920, 930, 940 and 950, respectively, which are used for the tests as described herein. The club head 900 is a reference club head, which does not have any apertures. The club head 910 is similar to the club head 100 of the embodiment of FIGS. 1-12 and includes a plurality of apertures 912. In the embodiment of FIG. 31, each of the apertures 912 has a diameter of 0.093 inch (0.2 cm). The club head 920 is also similar to the club head 100 of the embodiment of FIGS. 1-12 and includes a plurality of apertures 922. However, each of the apertures 922 has a diameter of 0.3 inch (0.8 cm). Thus, the apertures 922 are larger than the apertures 912. The club head 930 include two large apertures 932 with a reinforcing member 939 defining the apertures 932 on each side of the reinforcing member 939. The club head 940 includes three large apertures 942 with two reinforcing members 949 defining the apertures 942 on each side thereof. The club head 950 includes a plurality of apertures 952 and a large kidney-shaped aperture 954 near the back of the club head 950.

As shown in the graph of FIG. 29, the above-described club heads were tested by measuring the stress on generally the center of each club's respective crown upon striking a golf ball with the face of each golf club. The club head 900 was used as a reference club head to provide an upper end metric for gauging the performance of the other golf club heads during and after the impact of the golf ball against the face. As the golf club head 900 generates a much smaller stress value with minimal or no oscillations over time at the center of the crown during and after impact of the golf ball, such a golf club head was considered an excellent reference or control golf club head for comparing the stress profiles of golf club heads having apertures of various sizes formed in the crown.

As discussed above, the club heads of FIGS. 30-35 are similar in size and shape and are constructed from the same materials. Accordingly, a stress vs. time plot (hereinafter referred to as the stress profile) for each of the golf club heads of FIGS. 30-35 shows the effect of aperture size and configuration on the stress profile of each club head when striking a golf ball. The stress profile of the reference club head 900 may represent an optimum stress profile relative to the stress profiles of the other club heads of FIGS. 31-35. Thus, the stress profile of each of the club heads of FIGS. 31-35 can be compared to the stress profile of the reference club head 900 to determine the optimum club head aperture size and configuration among the club heads of FIGS. 31-35. The fewer the number of apertures and/or the smaller the size of apertures on a club head, the closer the stress profile of the club head may resemble the stress profile of the reference club head 900. However, having fewer apertures and/or smaller apertures may not provide sufficient weight reduction in the club head or sufficient shift in the center of gravity of the club head to improve the performance of the club head as compared to the club head 900. Therefore, an optimum aperture size may be defined as an aperture size that provides a stress profile that is as close as possible to the stress profile of the club head 900, while also providing the greatest weight reduction and shift in the center of gravity of the club head to optimize the performance of the club during use by an individual. Accordingly, an optimum range for an aperture size may be defined by a range of aperture sizes proximate to the optimum aperture size, where an aperture size falling within the range provides a near optimum stress profile, weight reduction and center of gravity shift.

As shown in the graph, the performance characteristics of the reference golf club head 900 during impact of the golf ball against the face shows a peak stress value of only about 5,000 psi which quickly tapers off to a stress value of between 500-1000 psi with minimal or no oscillations as the golf ball continued to impact the face. Golf club head 910 seems to exhibit a similar stress profile as the golf club head 900. Golf club head 910 reached a peak stress value of about 14,000 psi which also quickly tapered off to a value range of between 3,000-6,000 psi with minimal or no oscillations in the stress values after impact.

In contrast, golf club head 920 with the apertures having a diameter of 0.30 inches reached a peak stress value of about 23,000 psi with continuing oscillation of the stress values ranging between 4,000 psi to a peak value of about 24,000 psi well after the golf ball left the face of the golf club head 920 after impact. Golf club heads 930 and 940 showed even higher peak stress values and wider range of continual oscillations. Golf club head 950 having the plurality of apertures and the kidney-shaped aperture arrangement showed lower peak stress values than the golf club heads 930 and 940, but higher stress values than the club head 910 with large continual oscillations in the tested time frame. In particular, golf club head 930 reached a high stress value of about 45,000 psi during impact with the golf ball and a peak stress value of about 55,000 psi after impact with continual oscillations of those stress values ranging as low as about 9,000 psi and as high as about 55,000 psi in a single oscillation. Golf club head 940 reached a high stress value of about 53,000 psi during impact with the golf ball and a peak stress value of about 80,000 psi after impact with the golf ball with sharp and relatively high peak stresses. Such high peak stress values relative to the elastic limit of the titanium alloy used to manufacture the golf club head may lead to structural failure of the golf club head. For example, titanium alloy has an elastic limit of between 115,000 psi to 125,000 psi and that it is desirable that the peak stress value be below 20% of that elastic limit, or about 23,000-25,000 psi. Based on the test results, golf club head 920 has a peak stress value that is approximately 20% of the elastic limit and golf club heads 930 and 940 reach a peak stress value that is approximately 32% and 44%, respectively, of the elastic limit. Golf club head 950 has a peak stress value that is slightly above the elastic limit. In comparison, the golf club head 910 and the reference golf club head 900 reach a peak stress value that is approximately 11% and 4%, respectively, which is substantially lower than the golf club heads 920, 930, 940 and 950. As such, the golf club head 910 has a stress profile that is substantially lower than the other golf club heads 920, 930, 940 and 950 with apertures formed in the crown.

The results of these tests on the above-described six golf club heads with respect to the reference golf club head 900 show that the golf club head 910 with the apertures having a diameter of 0.093 inches has a substantially similar stress profile as the reference golf club head 900. In particular, both the reference golf club head 900 and the golf club head 910 have stress values that form a substantially bell-shaped distribution during impact in that the stress values gradually rise and peak during impact and then gradually decrease with little or no oscillations after impact. This non-oscillatory stress profile may be preferred because it applies less stress to the golf club head that can eventually cause structural failure of the golf club head and also provides for a proportional distribution of forces through the crown after impact with the golf ball. As noted above, this proportional distribution of forces may be preferred since it does not cause stress risers or stress collectors to be generated.

In contrast, as noted above, the golf club heads 920, 930, 940 and 950 having apertures larger than golf club head 910 showed significantly higher peak stress values at the center of the crown and an oscillatory stress profile that is undesirable since such peak stress values in combination with continued oscillations of stress values have been found to cause structural failure of the golf club head over time after repeated impacts by the golf ball. In one test, the number of impacts against the face of the subject golf club head may be between 1,000-2,000 impacts, 2,000-4,000 impacts, or 4,000 impacts or greater. Virtual impact analysis showed that structural failure occurred at the face and not along the crown of the golf club head 910, while structural failure of the other golf club heads 920, 930, 940 and 950 occurred only at the crown, and in particular at those portions of the crown between the apertures due to high stress risers as compared to the golf club head 910.

Figure 36:
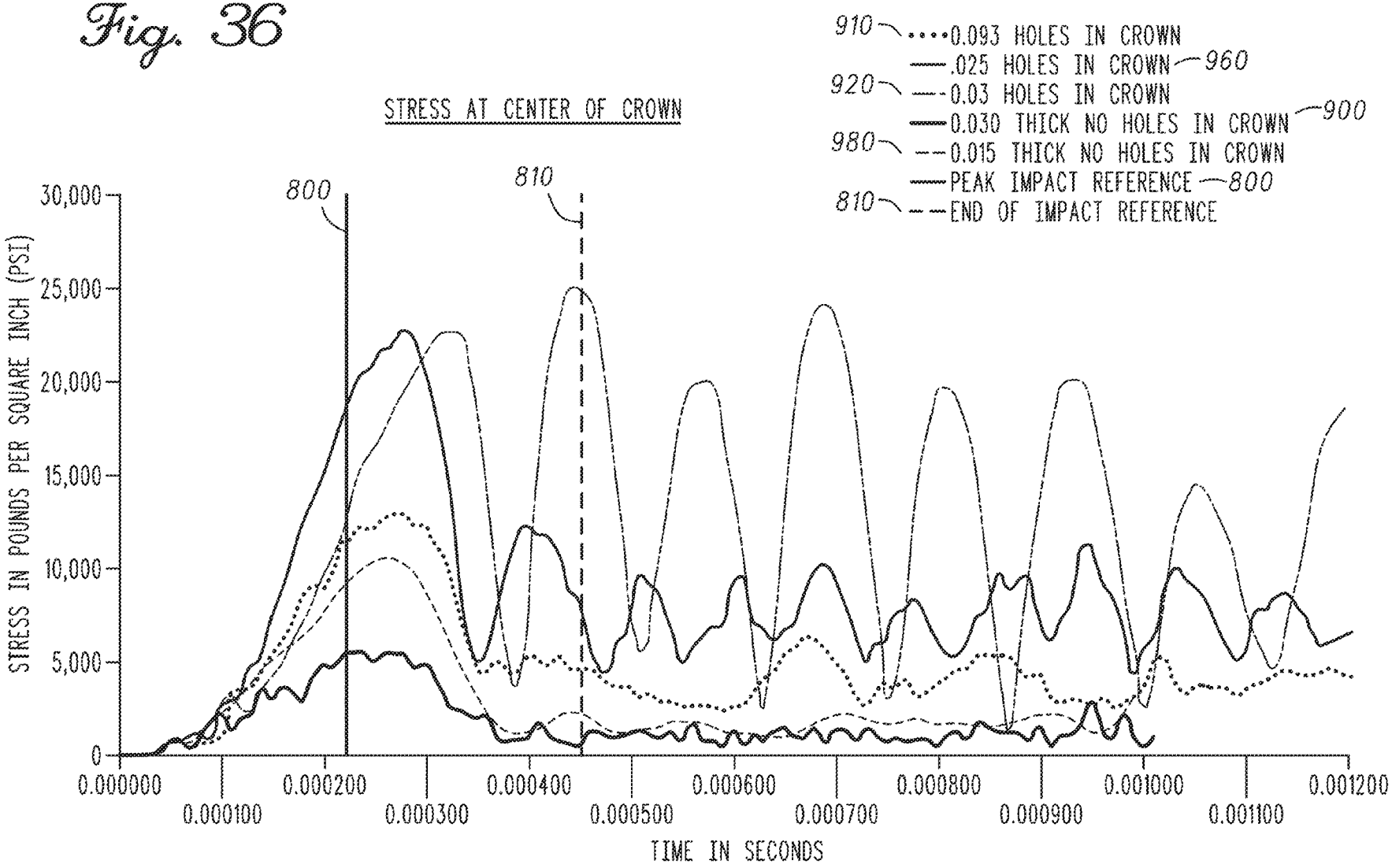
FIG. 36 is another graph illustrating stress profiles of golf club heads according to several embodiments.

In another graph illustrated in FIG. 36, the stress profile of another embodiment of the golf club head, designated 960, having a plurality of apertures with diameters of 0.25 inches (e.g., 0.64 cm) that fall within the range to provide optimal performance is shown. The stress profile of golf club head 960 was compared with the stress profiles of the reference golf club head 900, the golf club head 910 with apertures having diameters of 0.093 inches (e.g., 0.24 cm), and the golf club head 920 with apertures having diameters of 0.30 inches (e.g., 0.76 cm). As shown in the graph of FIG. 36, golf club head 960 having apertures of 0.25 inches (e.g., 0.64 cm) reaches a peak stress value of about 22,000 psi during impact similar to golf club head 920 having apertures of 0.30 inches; however, the stress values of the golf club head 920 continue to oscillate after impact to substantially the same peak stress values (e.g., between 20,000 psi -22,000 psi) while the stress values of the golf club head 960 gradually decrease during impact and oscillate at much lower stress values ranging between 10,000 psi-12,000 psi to about 4,000 psi. The range of stress values for the golf club head 920 of between 4,000 psi to 22,000 psi (18,000 psi) is a much greater range of oscillation for bending the golf club head 920 than the range of 5,000 psi-10,000 psi (5,000 psi) of golf club head 960, which would generate less bending. As such, the golf club head 960 may establish the upper limit for the size of the apertures according to the embodiment of FIGS. 1-12. In other words, golf club heads according to the embodiment of FIGS. 1-12 having apertures with diameters 0.25 inches (e.g., 0.64 cm) or less may fall within the range to provide optimal performance, while golf club heads having apertures with diameters greater than 0.25 inches may fall outside the range to provide optimal performance, depending on the material construction and other physical characteristics of the golf club head.

Referring to FIG. 36, tests were conducted on a modified reference club 980 to illustrate that the stress profile of a solid club golf club head with a crown depth that is half as thick as the reference golf club head 900 (e.g., 0.015 inches or 0.04 cm) is substantially similar to the stress profile of the golf club head 910 with a plurality of apertures 112 each having a diameter of 0.093 inches (e.g., 0.24 cm) that falls within the range of optimal performance. As shown, golf club head 910 having a plurality of apertures 912 each with a diameter of 0.093 inches has a similar stress profile as the modified reference golf club head 980 with half as much thickness as the reference golf club head 900, thereby proving that the golf club head 910 having a plurality of apertures 912 has similar a similar stress profile performance as a golf club head made from a solid construction.

The above tests were conducted on club heads having similar sizes, geometries, materials of construction, crown thicknesses (except for club head 980), and other physical characteristics. Among the group of golf club heads 30-35, the golf club head 31 having apertures of 0.093 inches appeared to yield near optimum results. However, for club heads having a different sizes, geometries, materials of construction, crown thickness and/or other physical characteristics than the golf club heads 30-35, an aperture size other than 0.093 inches may yield near optimum results. For example, for a club head that is larger than the club heads 31, an aperture size that is larger than 0.093 inches may yield near optimum results. Thus, although the experimental results discussed above find an aperture size of 0.093 inches to yield the best result among the group of tested club heads 31-35, the experimental results do not limit an aperture size to a particular size for achieving near optimum or optimum results. Furthermore, the experimental results illustrate the effects of aperture configurations on the vibration and stress characteristics of golf club heads without limiting the aperture configurations to a particular configuration for achieving a preferred result.

Figure 37:
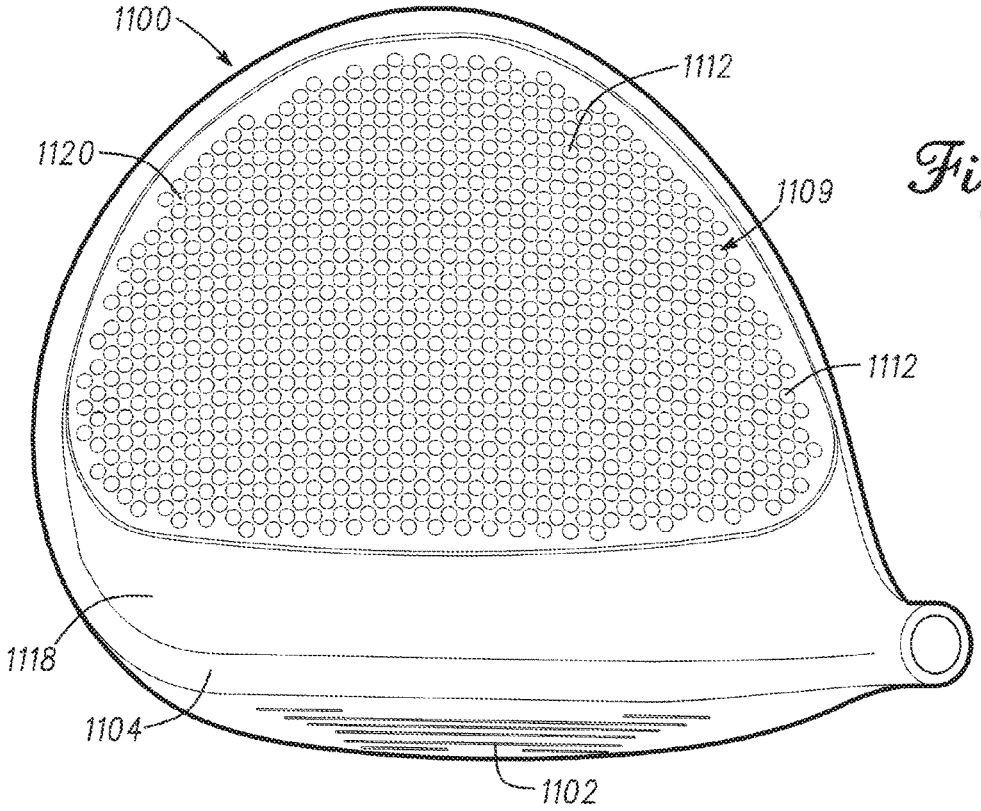
FIG. 37 shows a golf club head according to one embodiment.

As described above, instead of forming a plurality of apertures through the crown, a plurality of recesses may be formed in the crown but not entirely through the crown. FIG. 37 shows a golf club head 1100 according to one example. A plurality of recesses 1112 may be formed in the crown 1109 that do not extend entirely through the crown 1109. The crown 1109 may include a first region 1118 and a second region 1120. The boundary between the first region 1118 and the second region 1120 may be defined with a bell-shaped curve as described herein. Alternatively, as shown in FIG. 37, the boundary between the first region 1118 and the second region 1120 may be defined with a line or a curve that generally follows the profile of the face 1102 of the golf club 1100 so as to generally maintain the same distance between the top edge 1104 and the recesses 1112. The boundary between the first region 1118 and the second region 1120 of the crown 1109 may depend on loft angle of the face 1102. However, the boundary between the regions 1118 and 1120 may be in any shape, size and/or configuration and the apparatus, methods, and articles of manufacture described herein are not limited in this regard.

The recesses 1112 may be formed in the second region 1120. In the embodiments of FIGS. 1-9, the apertures 112 are located within a recess 128. Accordingly, the recesses 1112 may also be formed in a larger recess (not shown) in the second region 1120. In the example of FIG. 37, the recesses 1112 are located on the surface of the crown 1109 without being formed in a larger recess in the second region 1120.

The recesses 1112 may be formed with any of the disclosed methods for forming apertures and/or recesses. According to one example, the recesses may be formed by chemical etching or chemical milling. In a chemical etching process according to one example, the golf club head may be covered with a layer of material that does not react with a chemical etchant, which is a corrosive material. However, areas of the golf club where the recesses are to be formed are exposed. When the golf club is exposed to the chemical etchant, the exposed areas are partly dissolved by the etchant to form the recesses while the non-exposed areas remain intact. The depth of the recesses may be controlled by the properties of the chemical etchant and/or the length of time the areas to be recessed are exposed to the chemical etchant.

Figure 38:
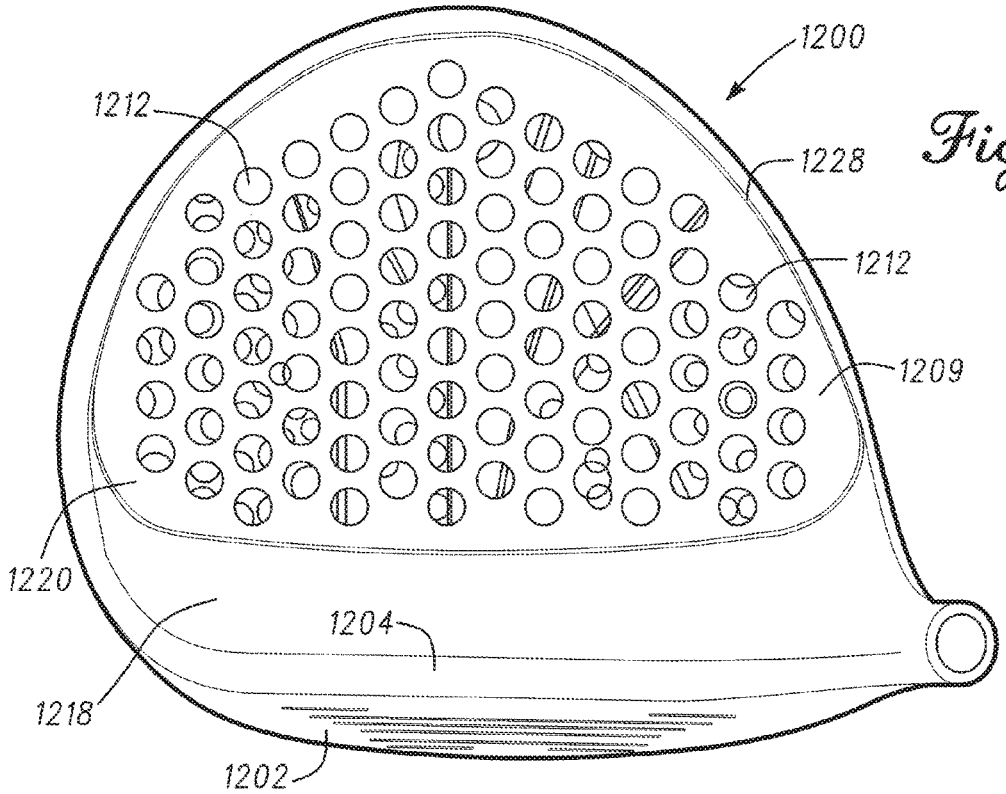
FIGS. 38-40 show a golf club head according to one embodiment.
Figure 39:
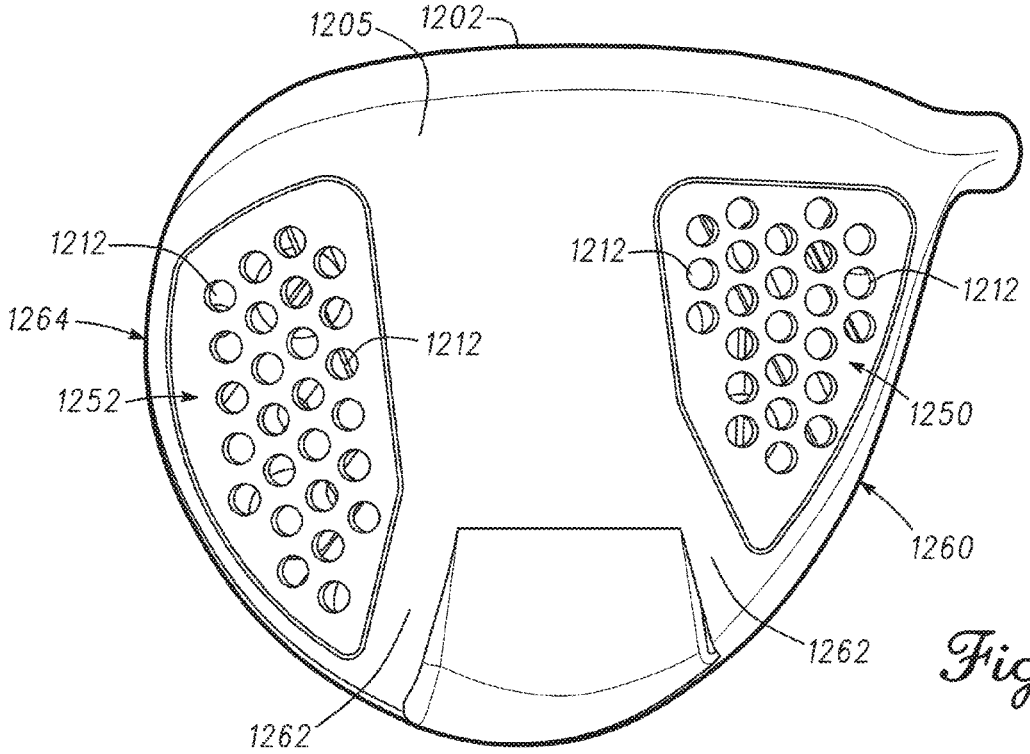
Figure 40:
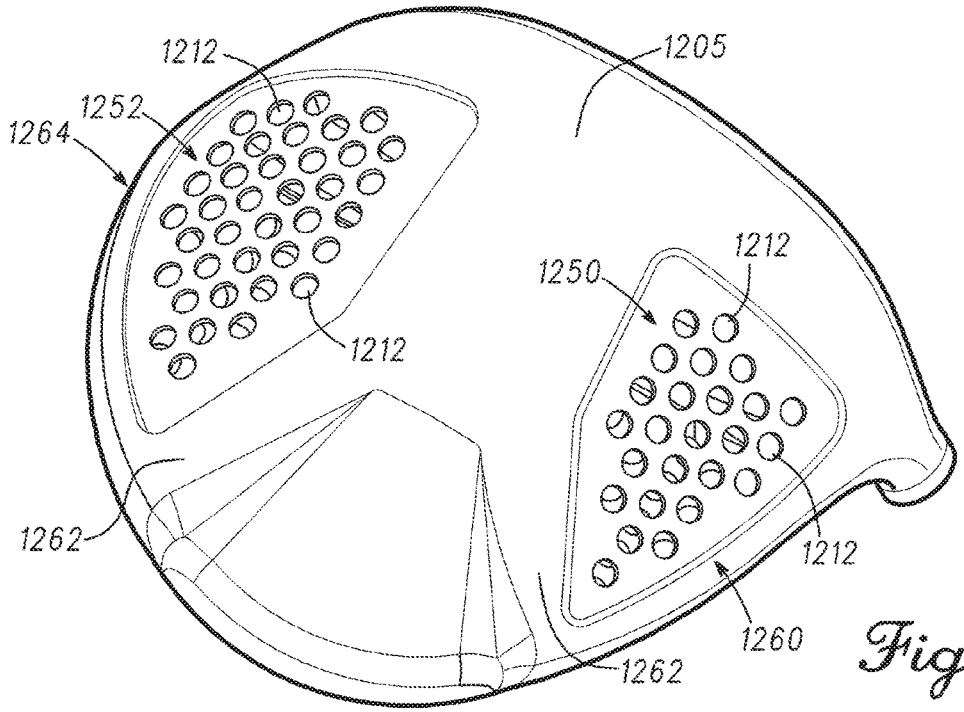

As described above, apertures may be formed at any location on a golf club head, such as the crown, the sole and/or areas between the crown and the sole. Referring to FIGS. 38-40, a golf club head 1200 according to one example is shown. The crown 1209 includes a plurality of apertures 1212. The crown 1209 may include a first region 1218 and a second region 1220. The boundary between the first region 1218 and the second region 1220 may be defined with a bell-shaped curve as disclosed herein, or as shown in FIG. 38, the boundary between the first region 1218 and the second region 1220 may be defined with a line or a curve that generally follows the profile of the face 1202 of the golf club 1200 so as to generally maintain the same distance between the top edge 1204 and the apertures 1212. Alternatively, the boundary between the first region 1218 and the second region 1220 of the crown 1209 may depend on loft angle of the face 1202. However, the boundary between the regions 1218 and 1220 may be in any shape, size and/or configuration and the apparatus, methods, and articles of manufacture described herein are not limited in this regard. Furthermore, any of the disclosed apertures may be recesses as described in the embodiment of FIG. 37. The apertures 1212 may be located within a recess 1228 in the second region 1220. In other words, the second region 1220 may be at least partly defined by recess 1228, in which the apertures 1212 are located.

Any region of a golf club head may include apertures 1212 including the sole, the crown, the face and/or the back of the golf club head and regions between the sole, the crown, the face and/or the back of the golf club head. For example, a golf club head may include apertures on the crown, the sole, the skirt (area in the back and/or sides of the golf club head between the sole and the crown), the heel portion, and/or the toe portion. The apertures on the golf club head may have different configurations at different locations or have similar configurations at one or more locations.

Referring to FIGS. 39 and 40, the golf club head 1200 may include two regions 1250 and 1252 having apertures 1212. The region 1250 defines a portion of the sole 1205 and may extend from the heel portion 1260 toward a skirt portion 1262 and the toe portion 1264. The region 1252 may define a portion of the sole 1205 and may extend from the toe portion 1264 toward the skirt portion 1262 and the heel portion 1260. The regions 1250 and/or 1252 may be in any shape and/or size and cover any part of the sole 1205, the heel portion 1260, the toe portion 1264 and/or the skirt portion 1262. The regions 1250 and 1252 may be formed as recesses so as to receive a cover (not shown) as described herein and may be referred to herein as recesses 1250 and 1252, respectively. The shapes of the apertures, the sizes of the apertures, the distances between the apertures, and/or the method of manufacturing the apertures may be similar in many respects to the shapes of apertures, the sizes of apertures, the distances between apertures, and/or methods of manufacturing apertures according to the disclosure and as described in detail herein.

Figure 41:
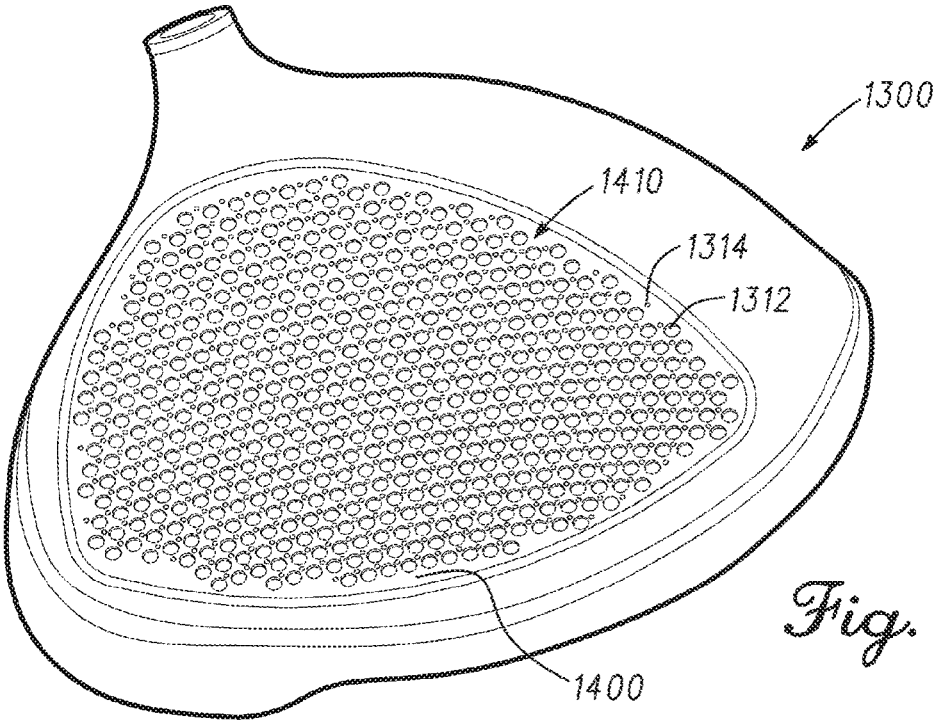
FIGS. 41-43 show a golf club head according to one embodiment.
Figure 42:
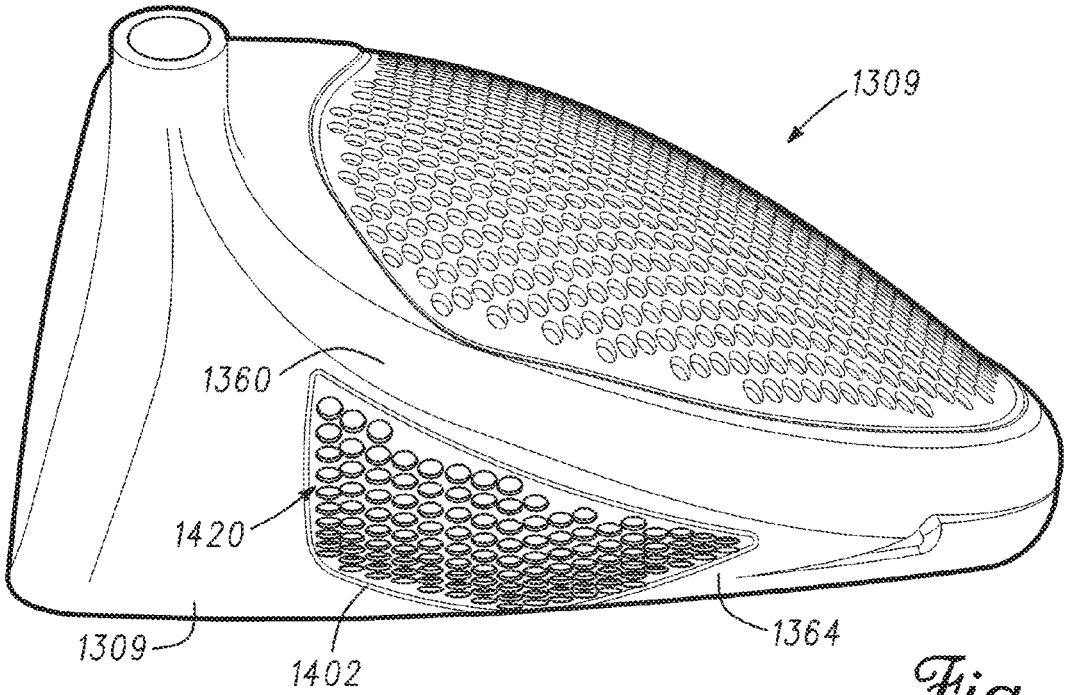
Figure 43:
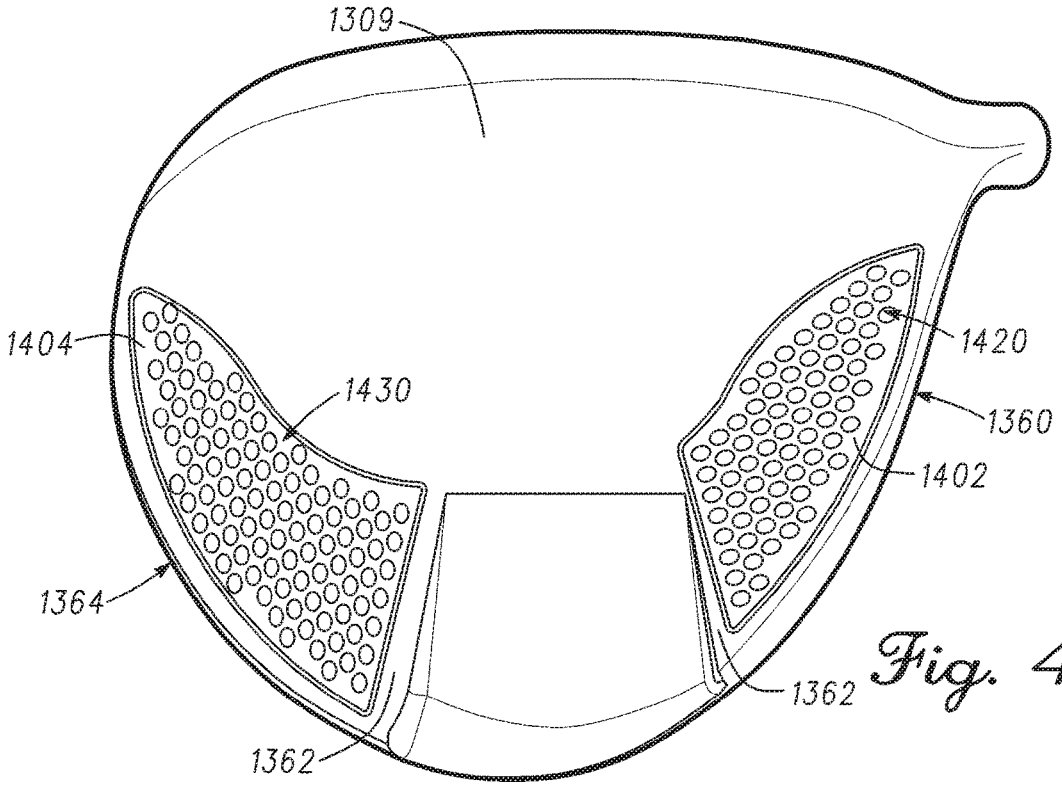

FIG. 41-43 show a golf club head 1300 having apertures 1312 and 1314 according to another example. The apertures 1314 may be smaller than the apertures 1312. The apertures 1312 and 1314 may be formed directly on the golf club head. Alternatively as shown in FIGS. 41-43, the apertures 1312 and 1314 are formed on inserts 1400, 1402 and 1404, which are then. attached to correspondingly sized openings (not shown) that define the regions 1410, 1420 and 1430, respectively. The region 1410 may be on the crown 1309. The region 1420 may define a portion of the sole 1309 and extend from the heel portion 1360 toward the skirt portion 1362 and a toe portion 1364. The region 1430 may define a portion of the sole 1309 and extend from the toe portion 1364 toward the skirt portion 1362 and the heel portion 1360. The inserts 1400, 1402 and 1404 may be manufactured by any method such as any of the methods described herein. The inserts 1400, 1402 and 1404 may then be attached to the corresponding openings in the golf club head 1300 that define the regions 1410, 1420 and 1430, respectively, with adhesive, by welding, fasteners and/or other suitable methods. Thus, the apertures 1312 and 1314 may be formed on inserts 1400, 1402 and 1404, which are then attached to a golf club head.

As described above, a cover such as the exemplary cover 130 may be used to cover apertures on a crown of the golf club head. The cover may be a film or tape made from a polycarbonate or polymeric material having an adhesive on one side that permits the cover to adhere to and cover either a certain number of the apertures or all of the apertures. The cover may be interchangeable with other covers so that an individual can select one or more covers based on color, visual patterns, logos, alphanumeric characters or other visual information. For example, a cover may be removable by an individual so that another cover can be applied over the apertures. Thus, an individual can select any cover for the golf club head to cover part or all of the apertures, and exchange the cover with another cover.

All of the exemplary disclosed apertures and/or recesses (shown in FIG. 37) may be used individually or in combination on a single golf club. For example, a golf club may have apertures on the crown and recesses on the sole. Thus, the apparatus, methods, and articles of manufacture described herein are not limited to a single example and may be used in combination.

Figure 44:
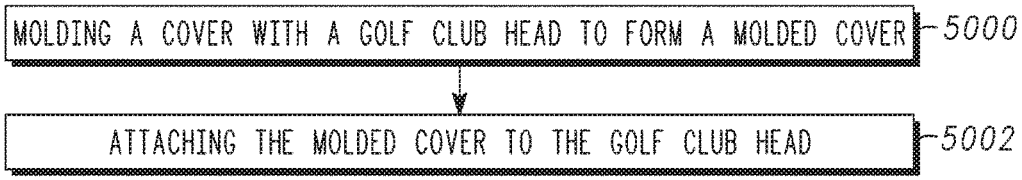
FIG. 44 shows a flow chart illustrating a method of manufacturing a cover for a golf club head according to one embodiment.

As described in detail above, any of the golf club heads described herein may include a cover formed from any material to cover the apertures on the golf club head. According to one example, a cover may be constructed from a composite material or fiber based composite material such as carbon fiber, fiberglass, aramid fibers such as Kevlar®, or a combination thereof. FIG. 44 shows a flowchart for an exemplary method of manufacturing a cover constructed from one or more composite materials by using the golf club head as a mold for forming the cover. The method includes molding a cover with a golf club head to form a molded cover (block 5000), and attaching the molded cover to the golf club head (block 5002).

Figure 45:
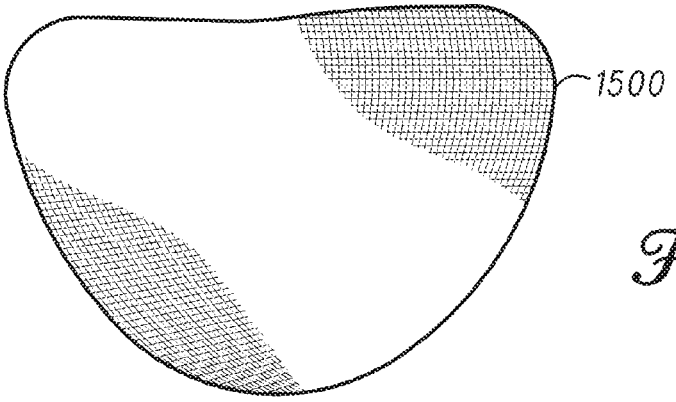
FIG. 45 shows an exemplary composite fabric cover for manufacturing a cover for a golf club head according to one embodiment.
Figure 46:
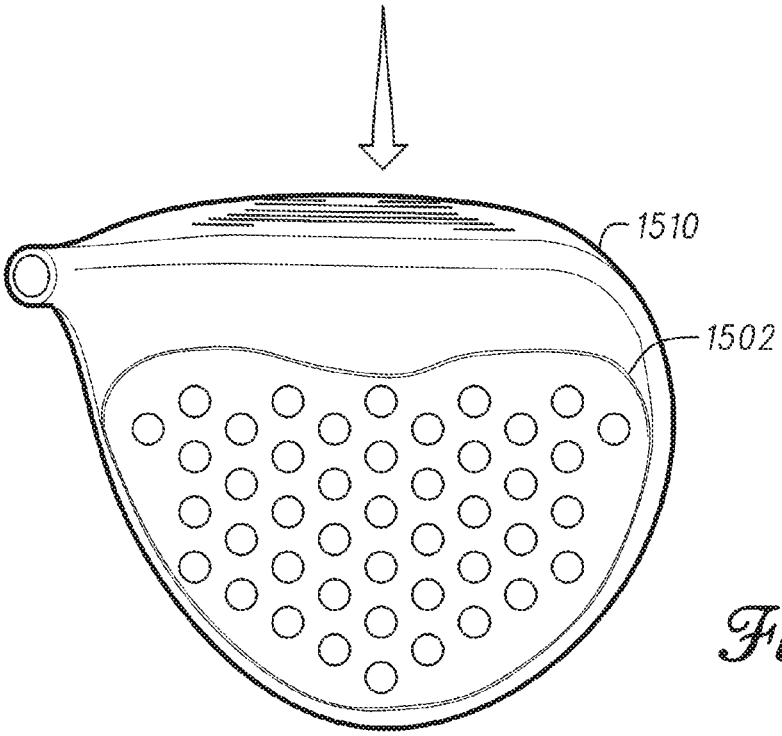
FIG. 46 shows an exemplary golf club head used as a mold for manufacturing a cover for a golf club according to one embodiment.

Fiber based composite materials such as carbon fiber, fiberglass and/or aramid fibers such as Kevlar® may be available in sheets and/or rolls of fabric. Referring to the example of FIG. 45, prior to molding a cover with the golf club head, a composite fabric cover 1500 that is configured to fit in a corresponding recess 1502 on a golf club head 1510 and cover the recess 1502 may be cut from a larger piece of composite fabric (not shown) or a roll of composite fabric (not shown). In the example of FIG. 45, a composite fabric cover 1500 is shown that is configured to correspond to the recess 1502 on the crown of the golf club 1510. For a golf club having recesses on the sole, composite fabric covers may be cut from a larger piece of composite fabric so that the covers are configured to cover the corresponding recesses on the sole. For example, for the golf club head 1200 of FIGS. 38-40, three composite fabric pieces may be cut from a larger composite fabric sheet or a composite fabric roll to correspond to the recesses 1228, 1250 and 1252.

For the golf club head 1510 to function as a mold, the golf club head 1510 may be covered or coated with a low friction material (not shown) to allow the cover to be removed from the golf club head after the molding process. For example, Teflon® tape may be wrapped around the golf club head 1510 prior to placing the composite fabric cover 1500 in the recess 1502 for the molding process. After the composite fabric cover 1500 is placed in the corresponding recess 1502 on the golf club head 1510, a curing agent such as resin (not shown) may be applied to the composite fabric cover 1500. The resin may be any type of resin used for curing composite materials such as epoxy. The resin may be applied to the composite fabric cover 1500 by being manually poured onto the composite fabric cover 1500 or applied to portions of the composite fabric cover 1500 by a machine that dispenses the resin. The resin may infiltrate the composite fabric cover 1500 by an individual spreading the resin on the composite fabric cover 1500 and applying the resin throughout the composite fabric cover 1500 with an appropriate tool. Alternatively, the resin may infiltrate the composite fabric cover 1500 by using pressure or vacuum. For example, after the composite fabric cover 1500 is placed on the golf club head 1510 and resin is applied to the composite fabric cover 1500, the entire assembly may be wrapped in a vacuum bag that is attached to a vacuum generating source such as a pump. When vacuum is created inside the bag, the resin is pulled and/or pushed between the fibers of the composite fabric cover 1500 to substantially uniformly infiltrate the composite fabric cover 1500. An alternative method of applying resin to the fabric may be using fabric that is pre-impregnated with resin (e.g. prepreg composite fabric).

Figure 47:
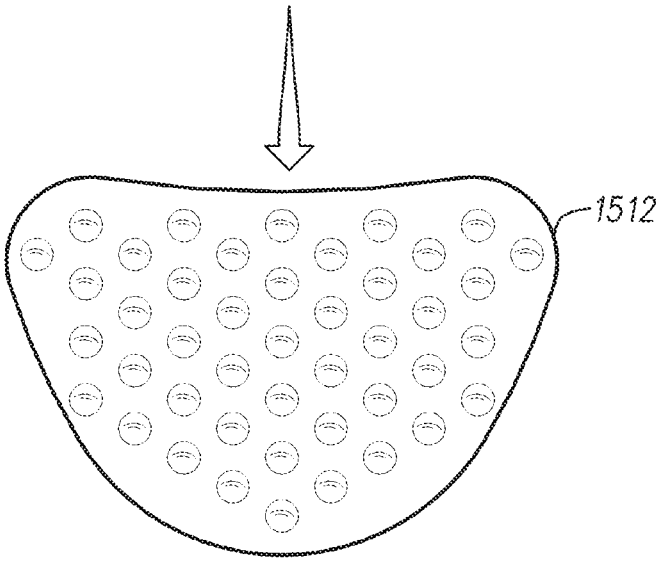
FIG. 47 shows a composite cover manufactured from the composite fabric cover of FIG. 45 molded with the golf club head of FIG. 46.

A resin impregnated composite fabric cover may be cured at ambient temperature and pressure. However, a resin impregnated composite fabric cover may also be cured with heat and/or pressure. For example, after a vacuum process is used to apply resin to the composite fabric cover 1500, the entire assembly including the vacuum bag may be placed in an autoclave or oven for a certain period of time. The autoclave or oven may apply a certain amount of pressure at a certain temperature for a certain period of time to cure the resin impregnated composite fabric cover 1500. Referring to FIG. 47, after the impregnated composite fabric cover 1500 is cured, the molded cover 1512 which may be rigid or substantially rigid can be removed from the golf club head 1510.

The molded cover 1512 can be attached in the corresponding recess 1502 on the golf club head 1510 by an adhesive, with one or more fasteners, or any type of attachment mechanism and/or method that may be permanent or temporary, i.e., to allow detachment of the molded cover 1512 and replacement thereof with a different cover. Prior to attaching the molded cover 1512 to the golf club head 1510 with an adhesive, the surfaces of the golf club head 1510 that receive the molded cover 1512 may be conditioned or prepared to provide a stronger bond between the molded cover 1512 and the golf club head 1510. Preparing the surfaces of the golf club head 1510 may include sanding, media blasting, chemical conversion coating, acid etching, and/or applying a primer. Before or after attaching the molded cover 1512, the molded cover 1512 may be entirely or partially painted in one or more colors, with symbols, with alphanumeric characters and/or with other visual information. Alternatively or in addition, visual information may be provided on the molded cover 1512 by one or more stickers, labels or the like. As shown in FIG. 47, by using the golf club head 1510 as a mold for manufacturing a molded cover 1512, apertures in the recess 1502 may cause correspondingly sized and positioned dimples to be formed in the molded cover 1512 during the molding process. Accordingly, although directly viewing the apertures may be blocked by the molded cover 1512, the sizes and locations of the apertures may be visible to an individual viewing the golf club head 1510 by the dimples formed on the molded cover 1512.

Figure 48:
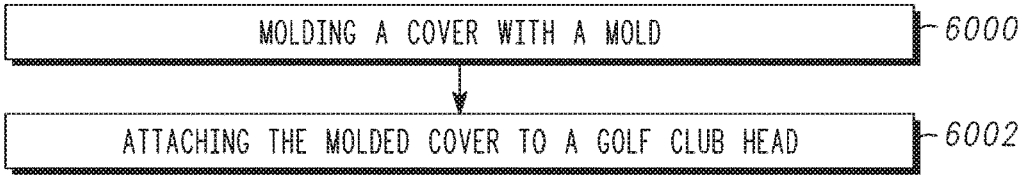
FIG. 48 shows a flow chart illustrating a method of manufacturing a cover for a golf club head according to one embodiment.

FIG. 48 shows a flowchart for a method of manufacturing a cover constructed from one or more composite materials according to another embodiment. The method includes molding a cover with a mold (block 6000) that is configured to shape the cover for a corresponding recess on a golf club head to form a molded cover, and attaching the molded cover to a golf club head (block 6002).

Figure 49:
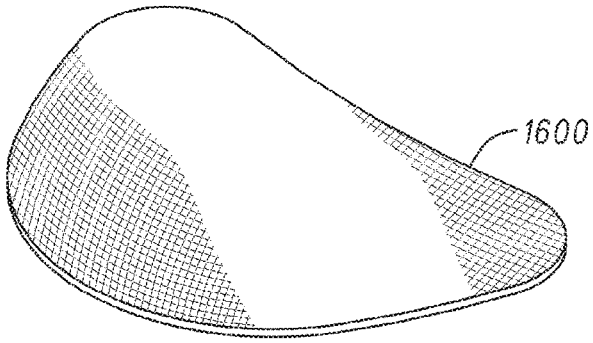
FIG. 49 shows an exemplary composite fabric cover for manufacturing a cover for a golf club head according to one embodiment.
Figure 50:
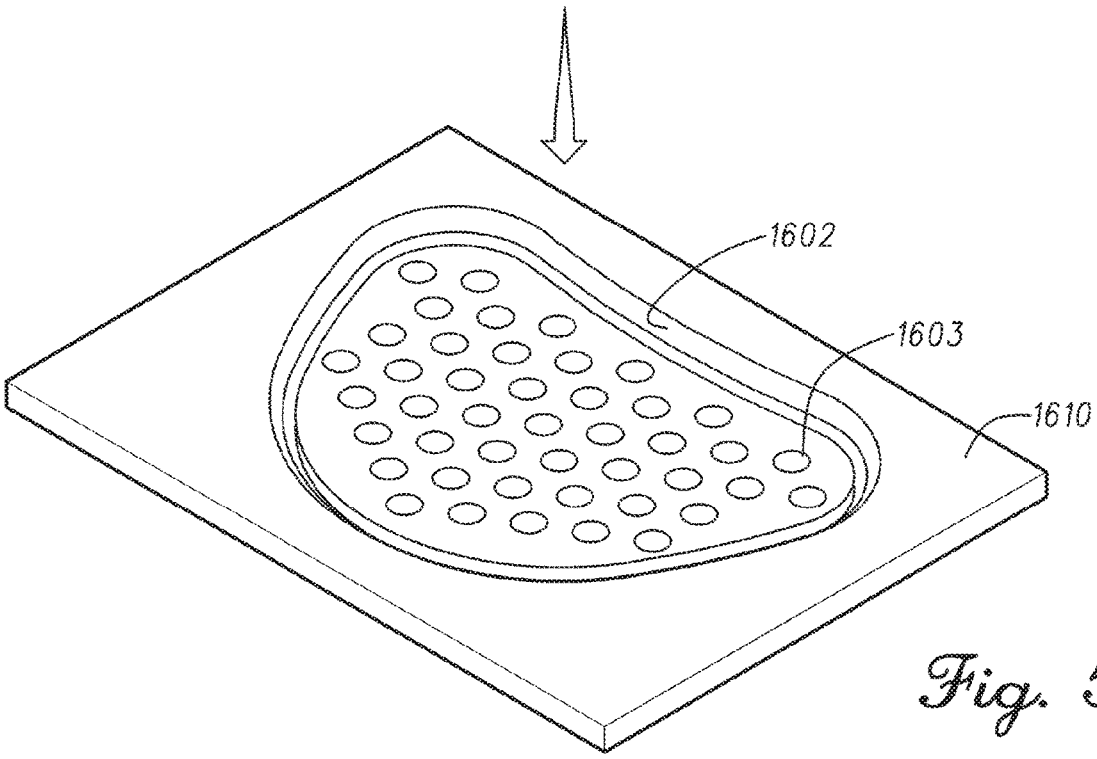
FIG. 50 shows an exemplary mold used as a mold for manufacturing a cover for a golf club according to one embodiment.
Figure 51:
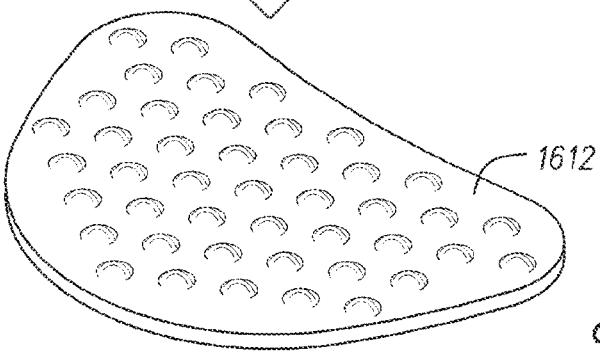
FIG. 51 shows a composite cover manufactured from the composite fabric cover of FIG. 49 molded with the mold of FIG. 46.

Referring to FIGS. 49-51, a mold 1610 may be shaped similar to a golf club head for which a molded cover 1612 is to be manufactured. The mold 1610 may be a single-piece mold or include a plurality of separate mold pieces (not shown). Furthermore, each recess on a golf club head such as any crown recesses or sole recesses may have different molds by which a corresponding molded cover may be manufactured. For example, referring to FIGS. 38-40, molded covers for recesses 1228, 1250 and 1252 may be manufactured by separate molds. Molding a cover with a mold is similar in many respects to molding a cover with a golf club head as described in detail above, except that a single or multi-piece mold is used for manufacturing the cover instead of a golf club head. Accordingly, details of molding the cover with a mold are not provided herein for brevity. Thus, a composite fabric cover 1600 is placed on the mold 1610 so that the composite fabric cover 1600 can be molded to the shape of the recess 1602. The composite fabric cover 1600 is then processed as described in detail herein to form the molded cover 1612. The recess 1602 of the mold 1610 may include a smooth, textured or any type of surface treatment. Alternatively, as shown in FIG. 50, the recess 1602 may include a plurality of apertures or dimples 1603 that emulate apertures in a recess of a golf club head for which the molded cover 1612 is being formed. Accordingly, the molded cover 1612 may also include a plurality of dimples similar to the molded cover 1512 shown in FIG. 47. Alternatively yet, the recess 1602 may include a plurality of rounded projections or pimples (not shown). Accordingly, the molded cover 1612 may include pimples that visually emulate the recesses on the crown of the golf club head to which the cover 1612 is attached.

After the composite fabric cover 1600 is cured as described in detail herein, the molded cover 1612 can be removed from the mold 1610. The molded cover 1612 can then be attached on a corresponding recess on a golf club head (not shown) with an adhesive, with one or more fasteners, or any type of attachment mechanism and/or method that may be permanent or temporary, i.e., to allow detachment of the molded cover 1612 and replacement thereof with a different cover. Prior to attaching the molded cover 1612 to the golf club head with an adhesive, the surfaces of the golf club head that receive the molded cover 1612 may be conditioned or prepared to provide a stronger bond between the molded cover 1612 and the golf club head. Preparing the surfaces of the golf club head may include sanding, media blasting, chemical conversion coating, acid etching, and/or applying a primer. After attaching the molded cover 1612, the molded cover 1612 may be entirely or partially painted in one or more colors, with symbols, with alphanumeric characters and/or with other visual information. Alternatively or in addition, visual information may be provided on the molded cover 1612 by one or more stickers, labels or the like.

Referring back to FIG. 8, a cover 130 is shown covering the recess 128 on the crown 109 of the golf club head 100. The cover 130 may be a molded cover manufactured from a composite material as described herein. The thickness of the composite fabric, the number of composite fabric layers used, the type of resin used to cure the composite fabric of the cover, the method of applying the resin and/or the method by which an impregnated composite fabric is cured to manufacture a cover may be determined so that the resulting cover is configured to be flush with the surface of the crown when the cover is attached on or inside the recess. Alternatively, the depth of a recess may be determined so that the cover is flush with the surface of the crown and/or the surface of the sole when the cover is attached on or inside a corresponding recess. In the example of FIG. 8, the cover 130 is shown to be flush with the surface of the crown 109. However, the cover 130 may project above the surface of the crown 109 or be slightly recessed relative to the surface of the crown 109.

Referring to FIGS. 39 and 40, molded covers (not shown) that are manufactured to cover the recesses 1250 and 1252 on the sole 1205 of the golf club head 1200 may be slightly recessed relative to the surface of the sole 1205, flush with the surface of the sole 1205, or slightly projecting above the surface of the sole 1205. The sole 1205 may contact or impact the ground when the golf club head 1200 is used by an individual. Accordingly, molded covers that are manufactured to cover the recesses 1250 and 1252 may be slightly recessed relative to the surface of the sole 1205 to prevent delamination or separation of the molded covers from the recesses 1250 and 1252.

According to another example, a cover may be molded onto a golf club head in a single step process. The composite material from which to cover is formed order resin that is used to cure the cover may include an adhesive such that when the cover is cured on a golf club head as shown in block 5000 of FIG. 44, the cover remains attached to the golf club head. In other words, removal of the molded cover from the golf club head and attachment of the molded cover to the golf club head with an adhesive may not be required.

Figure 52:
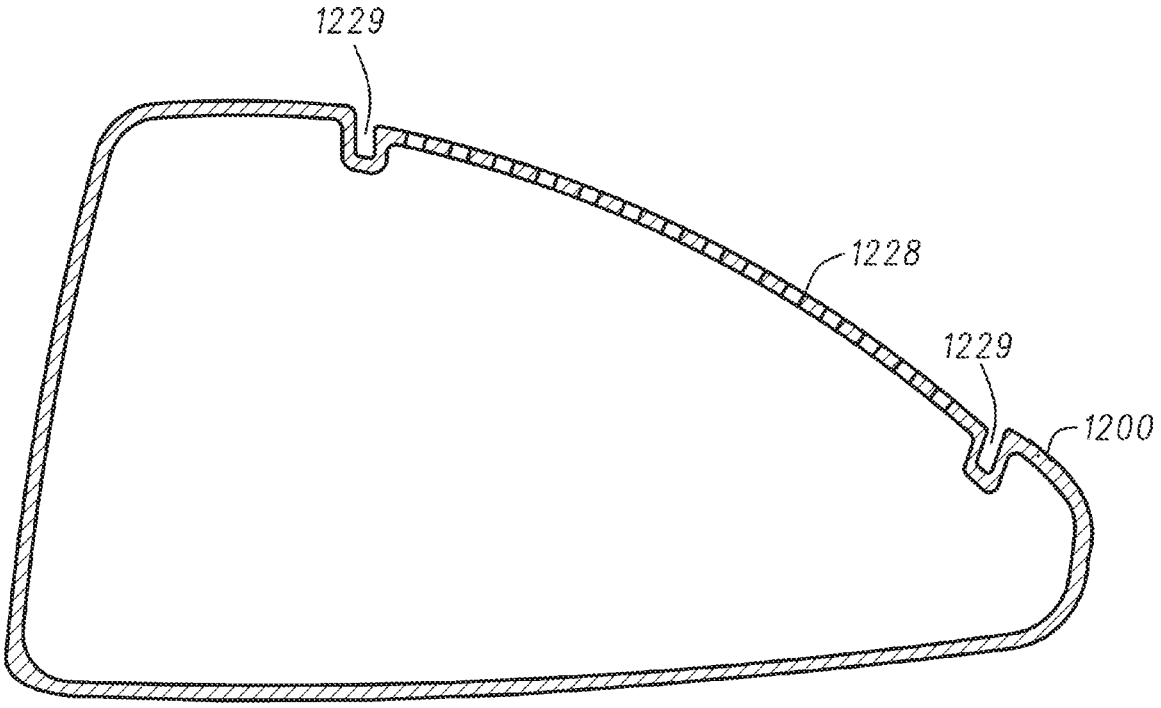
FIG. 52 is a side cross-sectional view of a golf club head according to one embodiment.

After a molded cover is manufactured by any of the methods described herein, the cover may be attached to a golf club head with an adhesive. Referring to FIG. 52, a cross-section of the golf club head 1200 is shown. The recess 1228 may include a channel 1229 on the periphery of the recess 1228. The channel 1229 may extend the entire periphery of the recess 1228, i.e., a continuous channel 1229. Alternatively, the recess 1228 may include a plurality of separate channels 1229 located on the periphery of the recess 1228. The channel 1229 has a greater depth than the recess 1228. The channel 1229 may function as a transition region between the molded cover and the surface of the crown so that the transition between the molded cover and the remaining surfaces of the crown is aesthetically pleasing. Furthermore, the channel 1229 may be filled with another material to provide a flush transition between the molded cover and the remaining surfaces of the crown. Adhesive that is applied to the recess 1228 for the attachment of a cover may flow into the channels 1229 and provide bonding between the entire periphery of the cover or portions of the periphery of the cover and the recess 1228.

A cover manufactured from a composite material such as carbon fiber, fiberglass, or aramid fibers such as Kevlar® may be rigid and provide additional rigidity and structural support to a golf club head, and in particular, may provide additional rigidity and structural support to the recesses and the portions of the recesses between the apertures. The type of composite materials, the orientation of the composite fibers forming the cover, the number of layers of composite fabric used for the cover, the type of resin used to cure the composite cover, the method by which the cover is cured, the method by which the cover is attached to a golf club head may, and/or costs associated with manufacturing the composite cover as described herein may be determined such that a preferred amount of structural support is provided to the golf club head by the cover. For example, a cover manufactured from carbon fiber may provide more rigidity to a golf club head than a cover manufactured from fiberglass when both covers have the same thickness. However, a carbon fiber cover may be more costly to manufacture.

In the embodiments described herein, the crown is hollow. Accordingly, when a ball is struck with the face of the golf club head, the vibrations of the crown produce sounds inside the crown, which are then emitted from the apertures on the crown similar to a guitar or violin or percussion instruments such as drums. The sizes, orientations, distribution patterns, shapes and other properties of the apertures and/or the crown may affect the sound that is produced by the golf club head when striking a ball. Accordingly, if a certain type of sound is preferred, the apertures and/or the crown can be configured to nearly produce or produce the certain type of sound. For example, a distinct sound may be produced by a certain aperture configuration associated with a certain brand of golf club so as to foster brand recognition among golfers.

In the embodiments described herein, the golf club head 100, 200, 300, 400 having apertures comprises a hollow region defined at least in part by one or more of the face, the back, the crown, the sole, the heel, and the toe. The hollow portion of the club head can be at least partially filled in with a filler material such that at least a portion of the hollow region comprises the filler material. The filler material may be any lightweight material capable of expanding within or filling at least a portion of the hollow region of the club head 100 and/or the apertures. For example, the filler material may be spray foam or expandable microspheres (expandable microspheres having a polymer shell encapsulating a gas that are capable of expanding on exposure to heat).

Specifically, the filler material may be a homopolymer or copolymer encapsulating a blowing agent. The copolymer may be a polyurethane, ethylene vinyl alcophol, ethylene vinylacetate, polyimide, silicone, polyvinyl alcohol, polyvinyl chloride, polystyrene, polyolefins, polyisocyanurate, styrene-acylonitrile, acrylonitrile butadiene styrene, acrylonitrile styrene acrylate, acrylonitrile butadiene and polycaprolactate linked polymer. Agents such as acrylonitrile, methacrylonitrile, may be combined with raw starter agents to generate homopolymers, elastomers and copolymer used in the filler material. The blowing agent may be any agent or volatile liquid/gas that expands within the copolymer when cured to make the foam. The blowing agent may be a hydrochloroflurocarbon (HCFC), a hydrofluorocarbon (HFC), carbon dioxide, n-pentane, cyclo-pentane, N-pentane, iso-pentane, N-butane, iso-butane, isopentane, isohexane, isoheptane, isooctane, and sodium bicarbonate.

An exemplary expandable microsphere material may include a polymer shell made of approximately 80-90% copolymer, <0.1% acrylonitrile, and <0.1% methacrylonitrile, the polymer shell encapsulating a <20% isopentane gas. Another exemplary microsphere material may include a polymer shell made of approximately 85-95% copolymer, <2% acrylonitrile, and <2% methacrylonitrile, the polymer shell encapsulating a <20% isopentane gas. Other expandable microsphere materials may include polymer shells and gases having different materials and compositions than the materials and compositions described herein. Specific materials and compositions of polymer shells and gases of expandable microspheres may be used to achieve different material densities. Further, the expandable microsphere material may include pigments to vary the color of the filler material.

The filler material may fill at least a portion the hollow region of the club head 100, 200, 300, 400 having uniform apertures 112, apertures 212 separated by ribs, apertures 312, 317, 412 of varying size, or any of the embodiments of apertures described herein (hereafter 112-412). The filler material may fill at least a portion of the hollow region of the club head 100, 200, 300, 400 having recesses 1112, 1212, 1312, 1314 (hereafter 1112-1314). In addition, the filler material may fill at least a portion of the hollow region of the club head 100, 200, 300, 400 and the apertures 112-412 or recesses 1112-1314, the filler material may fill at least a portion of the hollow region of the club head 100, 200, 300, 400 not including the apertures 112-412 or recesses 1112-1314, or the filler material may fill at least a portion of the apertures 112-412 or recesses 1112-1314, not including the club head 100, 200, 300, 400. Further, the filler material may fill at least a portion of the hollow region of the club head 100, 200, 300, 400 and/or apertures 112-412/recesses 1112-1314 on the crown 109, the sole 105, or both the crown 109 and the sole 105. Further still, the filler material may fill at least a portion the hollow region of the club head 100, 200, 300, 400 and/or apertures positioned within a recess 128, or the filler material may fill at least a portion of the hollow region of the club head 100, 200, 300, 400 and/or apertures positioned on the crown 109 (i.e. not positioned within a recess 128).

The filler material may fill the entire hollow region of the club head 100, 200, 300, 400, or the filler material may fill specific portions of the hollow region of the club head 100, 200, 300, 400. For example, the filler material may fill a portion of the hollow region of the club head 100, 200, 300, 400 adjacent to the face 102 within the club head 100, 200, 300, 400, adjacent the back 111 within the club head 100, 200, 300, 400, adjacent to the crown 109 within the club head 100, 200, 300, 400, adjacent to the sole 105 within the club head 100, 200, 300, 400, adjacent to the heel 106 within the club head 100, 200, 300,400, adjacent to the toe 110 within the club head 100, 200, 300, 400, or any combination of the described positions.

The ability to fill the club head 100, 200, 300, 400 having apertures 112-412 or recesses 1112-1314 with the filler material may be used to alter the weight and/or performance characteristics of the club head 100, 200, 300, 400. Specifically, different amounts of filler material may be added to the club head 100, 200, 300, 400 to achieve a desired weight of the club head 100, 200, 300, 400. For example, the weight of the filler material may range from 2 grams to 10 grams. Specifically, the weight of the filler material may be approximately 2, 2.5, 3, 3.5, 4, 4.5, 5, 5.5, 6, 6.5, 7, 7.5, 8, 8.5, 9, 9.5, or 10 grams. The entire hollow portion of the club head 100, 200, 300, 400 may be filled with the filler material, as described above, to add weight to the club head 100, 200, 300, 400 while minimally affecting the center of gravity of the club head 100, 200, 300, 400. Further, portions of the hollow region of the club head 100, 200, 300, 400 may be filled with the filler material, as described above, to change the weight and performance characteristics of the club head by shifting the center of gravity of the club head 100, 200, 300, 400. In many embodiments, the filler material improves acoustic performance of the club head by reducing noise and/or vibrations on impact with a golf ball. For example, the club head having at least a portion of the hollow region comprising a filler material can have reduced noise and vibration compared to a similar club head having a hollow region without a filler material.

Figure 53:
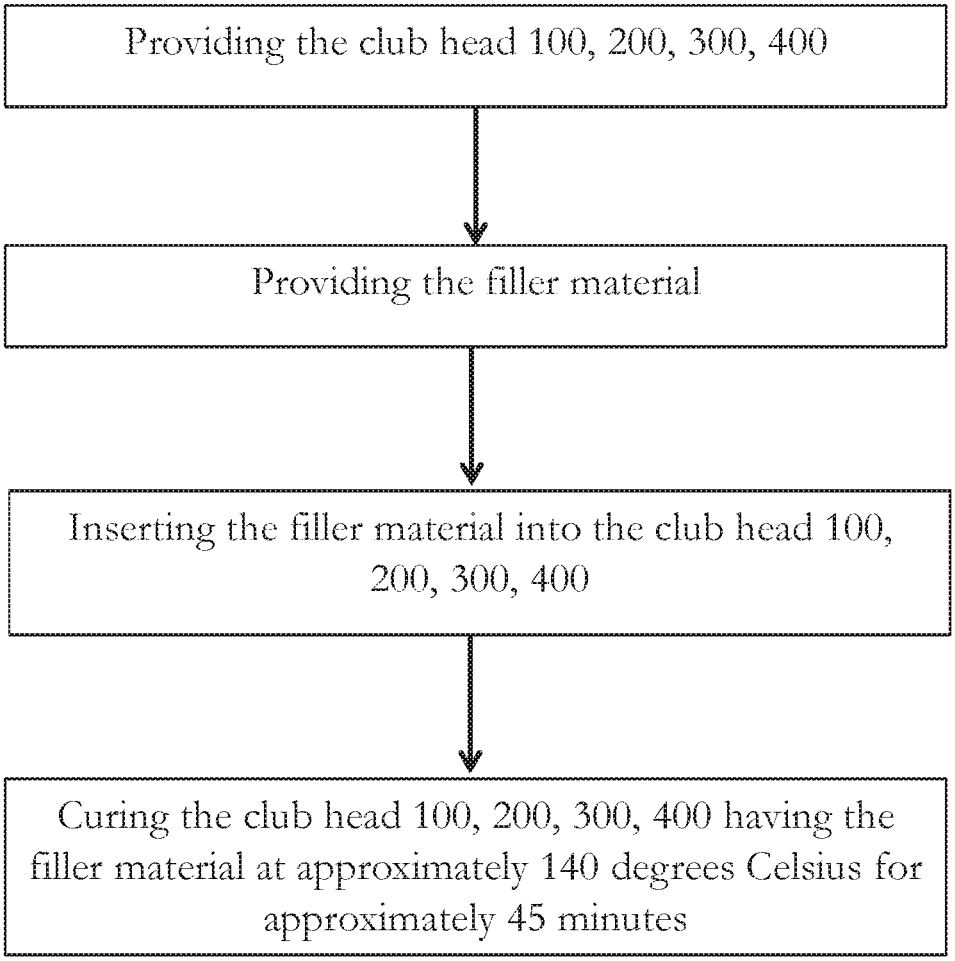
FIG. 53 shows a flow chart illustrating a method of manufacturing a club head having a filler material.

FIG. 53 illustrates an exemplary method of manufacturing the club head 100, 200, 300, 400 having the filler material is described herein. The method includes providing the club head 100 having apertures, providing the filler material, inserting the filler material into the hollow region of the club head 100, 200, 300, 400, and curing the club head 100, 200, 300, 400 having the filler material at approximately 140 degrees Celsius for approximately 45 minutes to allow the filler material to expand within the club head 100, 200, 300, 400. The filler material may be inserted into the club head 100, 200, 300, 400 such that the club head 100, 200, 300, 400 is oriented with the face positioned downward. This is beneficial in allowing the filler material to uniformly expand from the face 102 to avoid voids in filler material near the face 102. Further, this is beneficial in visually verifying the volume of expansion of the filler material within the club head 100, 200, 300, 400.

The method of manufacturing the club head 100, 200, 300, 400 having the filler material described herein and illustrated in FIG. 53 is merely exemplary and is not limited to the embodiments presented herein. The method can be employed in many different embodiments or examples not specifically depicted or described herein. In some embodiments, the processes of the method described can be performed in any suitable order. In other embodiments, one or more of the processes may be combined, separated, or skipped.

Further, additional processes may be added to the method of manufacturing the club head 100, 200, 300, 400 having the filler material. For example, weighting the club head 100, 200, 300, 400 prior to injecting the filler material and after curing to verify the weight of filler material added, blowing excess filler material from the club head 100, 200, 300, 400 prior to curing to ensure no filler material cures on the exterior portion of the club head 100, 200, 300, 400, or masking the apertures or other voids in the club head 100 to prevent expansion of the filler material outside of the club head 100, 200, 300, 400.

The filler material is described herein with reference to club head 100, 200, 300, 400. However, the filler material may be incorporated into any embodiment of the club head having apertures described herein. Further, the filler material may be incorporated in any capacity to any embodiment of the club head described herein.

The golf club heads with apertures and methods of manufacture discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment of golf club heads with edge configuration and methods of manufacture, and may disclose alternative embodiments of golf club heads with apertures and methods of manufacture. It is intended that the scope of golf club heads with apertures and methods of manufacture shall be defined by the appended claims.

All elements claimed in any particular claim are essential to golf clubs with apertures or methods of manufacture claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Although a particular order of actions is described herein, these actions may be performed in other temporal sequences. For example, two or more actions may be performed sequentially, concurrently, or simultaneously. Alternatively, two or more actions may be performed in reversed order. Further, one or more actions may not be performed at all. The apparatus, methods, and articles of manufacture described herein are not limited in this regard.

While the invention has been described in connection with various aspects, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

The invention claimed is:

1. A golf club head comprising:

a face, a heel, a toe, a top edge, and a sole;

a back defined opposite the face;

a crown extending between the top edge of the face to the back and between the heel to the toe, the crown comprising:

a plurality of apertures, a largest dimension of at least one aperture being less than or equal to 0.25 inch; and a hollow region defined at least in part by one or more of the face, the back, the crown, the sole, the heel, and the toe, wherein at least a portion of the hollow region includes a filler material; and wherein the filler material comprises expandable microspheres, each comprising a polymer shell encapsulating a gas.

2. The golf club head of claim 1, wherein each polymer shell comprises a material selected from the group consisting of: a homopolymer and a copolymer.

3. The golf club head of claim 2, wherein the copolymer comprises a material selected from the group consisting of: polyurethane, ethylene vinyl alcophol, ethylene vinylacetate, polyimide, silicone, polyvinyl alcohol, polyvinyl chloride, polystyrene, polyolefins, polyisocyanurate, styrene-acylonitrile, acrylonitrile butadiene styrene, acrylonitrile styrene acrylate, acrylonitrile butadiene, and polycaprolactate linked polymer.

4. The golf club head of claim 1, wherein each polymer shell encapsulates a gas selected from the group consisting of: a hydrochloroflurocarbon (HCFC), a hydrofluorocarbon (HFC), carbon dioxide, n-pentane, cyclo-pentane, N-pentane, iso-pentane, N-butane, iso-butane, isopentane, isohexane, isoheptane, isooctane, and sodium bicarbonate.

5. The golf club head of claim 1, wherein:

each polymer shell of the expandable microspheres comprises approximately 80% to 90% copolymer, <0.1% acrylonitrile, and <0.1% methacrylonitrile; and the polymer shell encapsulates a <20% isopentane gas.

6. The golf club head of claim 1, wherein:

each polymer shell comprises approximately 85-95% copolymer, <2% acrylonitrile, and <2% methacrylonitrile; and the polymer shell encapsulating a <20% isopentane gas.

7. The golf club head of claim 1, wherein the filler material is adjacent to one or more of the face, the back, the crown, the sole, the heel, and the toe.

8. The golf club head of claim 1, wherein the filler material completely fills the hollow region of the club head.

9. The golf club head of claim 1, wherein the filler material fills at least a portion of the plurality of apertures.

10. The golf club head of claim 1, further comprising a protective cover configured to engage the crown to cover the plurality of apertures.

11. The golf club head of claim 10, wherein:

the crown further comprises a recess within which the plurality of apertures is located;

the protective cover sits within the recess.

12. The golf club head of claim 1, wherein the number of the plurality of apertures is in a range of between 60 to 1500 apertures.

* * * * *